US012663177B2

(12) United States Patent
Ding et al.

(10) Patent No.: US 12,663,177 B2
(45) Date of Patent: Jun. 23, 2026

(54) AIR GUIDE COMPONENT, AIR OUTLET FRAME ASSEMBLY, AND AIR CONDITIONER

(71) Applicants: GD MIDEA AIR-CONDITIONING EQUIPMENT CO., LTD., Foshan (CN); MIDEA GROUP CO., LTD., Foshan (CN)

(72) Inventors: Penglei Ding, Foshan (CN); Liangrui Chen, Foshan (CN); Tao Zhang, Foshan (CN); Qiang Qin, Foshan (CN); Tiesheng Kang, Foshan (CN); Xianyou Mao, Foshan (CN); Hejie Zhou, Foshan (CN)

(73) Assignees: GD MIDEA AIR-CONDITIONING EQUIPMENT CO., LTD., Foshan (CN); MIDEA GROUP CO., LTD., Foshan (CN)

( * ) Notice: Subject to any disclaimer, the term of this patent is extended or adjusted under 35 U.S.C. 154(b) by 418 days.

(21) Appl. No.: 18/281,231

(22) PCT Filed: May 24, 2021

(86) PCT No.: PCT/CN2021/095503

§ 371 (c)(1),
(2) Date: Sep. 8, 2023

(87) PCT Pub. No.: WO2022/193434

PCT Pub. Date: Sep. 22, 2022

(65) Prior Publication Data

US 2024/0142136 A1 May 2, 2024

(30) Foreign Application Priority Data

Mar. 16, 2021 (CN) ..... 202110281729.0
Mar. 16, 2021 (CN) ..... 202110282999.3
Mar. 16, 2021 (CN) ..... 202120547468.8

(51) Int. Cl.
*F24F 13/08* (2006.01)
*F24F 1/0011* (2019.01)
(Continued)

(52) U.S. Cl.
CPC ..... *F24F 13/15* (2013.01); *F24F 1/0011* (2013.01)

(58) Field of Classification Search
CPC .. F24F 13/08; F24F 13/12; F24F 13/15; F24F 1/0011
See application file for complete search history.

(56) References Cited

FOREIGN PATENT DOCUMENTS

CN 101629754 A 1/2010
CN 104034006 A 9/2014
(Continued)

OTHER PUBLICATIONS

WO2010021383 and translation (Year: 2010).*
(Continued)

*Primary Examiner* — Steven S Anderson, II
(74) *Attorney, Agent, or Firm* — Anova Law Group, PLLC

(57) ABSTRACT

An air guide component includes an air guide assembly including an air guide plate assembly and a connector. The air guide plate assembly includes an outer air guide plate including an anti-disengagement structure and an inner air guide plate including a mounting structure having an avoidance port. The connector is disposed at the inner air guide plate and configured to be connected to an air guide drive mechanism. A part of the connector passes through the avoidance port. The connector, when at a first position, is connected to the air guide drive mechanism and is mounted and positioned through the mounting structure, and, when at
(Continued)

a second position, is separated from the air guide drive mechanism and is limited by the mounting structure and the anti-disengagement structure.

20 Claims, 36 Drawing Sheets

(51) Int. Cl.
*F24F 13/12* (2006.01)
*F24F 13/15* (2006.01)

(56) References Cited

FOREIGN PATENT DOCUMENTS

| | | | |
|---|---|---|---|
| CN | 204880587 | U | 12/2015 |
| CN | 106152460 | A | 11/2016 |
| CN | 106196305 | A | 12/2016 |
| CN | 206222455 | U | 6/2017 |
| CN | 208652867 | U | 3/2019 |
| CN | 212511728 | U | 2/2021 |
| EP | 2327938 | A1 | 6/2011 |
| JP | H1114134 | A | 1/1999 |
| JP | 2001304675 | A | 10/2001 |
| WO | 2015130073 | A2 | 9/2015 |

OTHER PUBLICATIONS

The World Intellectual Property Organization (Wipo) Written Opinion for PCT/CN2021/095503 Dec. 22, 2021 6 pages (including English translation).
The China National Intellectual Property Administration (CNIPA) The First Office Action for Chinese Application 202110282999. Dec. 8, 2023 16 Pages (With Translation).
The World Intellectual Property Organization (WIPO) International Search Report for PCT/CN2021/095503 Dec. 22, 2021 5 pages (including English translation).
The European Patent Office (EPO) Extended Search Report for EP Application No. 21931019.0 Jul. 16, 2024 11 Pages.
The China National Intellectual Property Administration (CNIPA) The Second Office Action for Chinese Application 202110282999 Aug. 30, 2024 23 Pages (With Translation).

* cited by examiner

AIR GUIDE COMPONENT, AIR OUTLET FRAME ASSEMBLY, AND AIR CONDITIONER

CROSS-REFERENCE TO RELATED APPLICATIONS

The present application is a National Stage Entry under 35 U.S.C. § 371 of International Application No. PCT/CN2021/095503, filed on May 24, 2021, which is based on and claims priority to Chinese Patent Application Nos. 202110281729.0, 202120547468.8, and 202110282999.3, all filed on Mar. 16, 2021, the entire disclosures of all of which are incorporated herein by reference.

FIELD

The present disclosure relates to the field of air treatment technologies and, more particularly, to an air guide component, an air outlet frame assembly, and an air conditioner.

BACKGROUND

An air guide component of an air conditioner can rotate an air guide assembly to different angular positions, thereby adjusting an air flow direction. However, in the related art, a challenge is posed by a fitting of the air guide component of the air conditioner in a manufacturing process. Moreover, a great deal of dust tends to be accumulated in the air conditioner over the course of long-term usage, and it is needed to dismount the air guide component from a whole machine and perform an operation such as cleaning and maintenance. Due to difficulty of dismounting the air guide component, it is inconvenient to clean and maintain the air guide component.

SUMMARY

The present disclosure aims to solve at least one of the technical problems in the related art. To this end, according to some embodiments of the present disclosure, there is provided an air guide component. In air guide component, by disposing a connector connected to an air guide drive mechanism at an air guide assembly and enabling the connector to be movable between a first position and a second position, the connector can be easily connected to and separated from the air guide drive mechanism. Therefore, mounting and dismounting of the air guide component become simple. In this way, mounting and dismounting efficiency of the air guide component is enhanced. As a result, maintenance and cleaning of the air guide component are facilitated. In addition, the connector on the air guide assembly can be prevented from falling off and becoming lost.

According to some embodiments of the present disclosure, there is also provided an air outlet frame assembly having the air guide component as mentioned above.

According to some embodiments of the present disclosure, there is also provided an air conditioner having the air outlet frame assembly as mentioned above.

According to embodiments of the present disclosure, there is provided an air guide component. The air guide component includes: an air guide assembly and a connector. The air guide assembly includes an air guide plate assembly which includes an outer air guide plate and an inner air guide plate disposed at an inner side of the outer air guide plate, and the outer air guide plate is provided with an anti-disengagement structure. The connector is disposed at the inner air guide plate and is adapted to be connected to an air guide drive mechanism that is configured to drive the air guide component to rotate, the inner air guide plate is provided with a mounting structure having an avoidance port, and a part of the connector passing through the avoidance port. The connector is movable between a first position and a second position. When the connector is at the first position, the connector is adapted to be connected to the air guide drive mechanism and is mounted and positioned through the mounting structure. When the connector is at the second position, the connector is separated from the air guide drive mechanism and is limited by the mounting structure and the anti-disengagement structure.

In the air guide component according to the present disclosure, by disposing the connector connected to the air guide drive mechanism at the air guide assembly and enabling the connector to be movable between the first position and the second position, the connector can be easily connected to and separated from the air guide drive mechanism. In this way, the mounting and dismounting of the air guide component become simple, the mounting and dismounting efficiency of the air guide component is enhanced, thereby facilitating the maintenance and cleaning of the air guide component. Moreover, when the air guide component is separated from the air guide drive mechanism, the connector can be limited through the cooperation between the mounting structure on the inner air guide plate and the anti-engagement structure on the outer air guide plate. In this way, the connector on the air guide assembly can be prevented from falling off and becoming lost to guarantee smooth mounting and dismounting of the air guide component.

According to some embodiments of the present disclosure, a rotation axis of the air guide component is parallel to a first direction, the connector is movable between the first position and the second position in the first direction, and the avoidance port extends in the first direction. The anti-disengagement structure is located at a side of the connector facing away from the air guide drive mechanism and located between the outer air guide plate and the inner air guide plate. When the connector is at the second position, the anti-disengagement structure cooperates with the part of the connector passing through the avoidance port, to restrict a movement of the connector in the first direction in a direction away from the air guide drive mechanism.

According to some embodiments of the present disclosure, the connector includes a connection member and a positioning member that are arranged in the first direction. The mounting structure has a mounting hole, the connection member passes through the mounting hole and is adapted to be connected to the air guide drive mechanism, and the positioning member partially passes through the avoidance port.

In some embodiments of the present disclosure, the connection member includes a connection post and a first limit stopper formed at an outer peripheral wall of the connection post. An inner peripheral wall of the mounting hole is provided with a second limit stopper. When the connector is located at the first position, the second limit stopper abuts against the first limit stopper in the first direction, to restrict a movement of the connector in the first direction and in a direction adjacent to the air guide drive mechanism.

In some embodiments of the present disclosure, the positioning member includes: a positioning member body located at a side of the inner air guide plate facing away from the outer air guide plate and a positioning protrusion disposed at a side of the positioning member body in a second direction perpendicular to the first direction. The positioning protrusion passes through the avoidance port and limits the positioning member in a third direction perpendicular to both the first direction and the second direction.

In a further embodiment, the mounting structure further includes a limit buckle formed at the side of the inner air guide plate facing away from the outer air guide plate and disposed at two opposite sides of the positioning member body in the third direction. A limit groove is formed between the limit buckle and the inner air guide plate, and the positioning member body cooperates with the limit groove, to limit the positioning member in the second direction.

In some embodiments of the present disclosure, the positioning member body cooperates with the limit groove, to limit the positioning member in the second direction and the third direction.

In some embodiments of the present disclosure, a plug protrusion is formed at each of two opposite side walls of the positioning member body in the third direction. When the connector is located at the first position, the plug protrusion is located at a side of the limit buckle adjacent to the connection member. When the connector is located at the second position, the plug protrusion is located at a side of the limit buckle facing away from the connection member. During insertion and pulling of the connector in the first direction, the plug protrusion is pressed against the limit buckle when located in the limit groove.

In some embodiments of the present disclosure, an elastic opening is formed at each of two opposite ends of the positioning member body in the third direction and extends in the first direction, an elastic arm is formed between the elastic opening and each of the two opposite side walls of the positioning member body in the third direction, and the plug protrusion is formed at the elastic arm.

In some embodiments of the present disclosure, the mounting structure further includes a limit rib plate extending in the first direction and located at each of the two opposite sides of the positioning member body in the third direction, the plug protrusion abuts against the corresponding limit rib plate in the third direction when the connector is located at the first position.

In some embodiments of the present disclosure, a cross section of the connection post is formed into a polygonal shape; and a cross section of a part of the mounting hole cooperating with the connection post is formed into a polygonal shape adapted to the polygonal shape of the cross section of the connection post.

In some embodiments of the present disclosure, the inner air guide plate includes: an inner air guide plate body and a first inner extension located at an end of the inner air guide plate body in the first direction and located at a side of the inner air guide plate body facing away from the outer air guide plate. An angle is formed between the first inner extension and the inner air guide plate body. The mounting hole is formed at the first inner extension, and the avoidance port is formed at the inner air guide plate body.

In some embodiments of the present disclosure, the outer air guide plate is provided with an air diffusion structure and is detachably connected to the inner air guide plate. The air guide assembly further includes: an air diffusion fan blade assembly disposed at the air guide plate assembly and a louver mechanism. The air diffusion fan blade assembly is at least partially located in an accommodation cavity formed by the outer air guide plate and the inner air guide plate, and the inner air guide plate has an air flowing hole formed at a position on the inner air guide plate corresponding to the air diffusion fan blade assembly. The louver mechanism is disposed at a side of the inner air guide plate facing away from the outer air guide plate.

In some embodiments of the present disclosure, the inner air guide plate is snapped with the outer air guide plate through a buckle assembly.

In some embodiments of the present disclosure, each of two side edges of the outer air guide plate in a width direction is snapped with a corresponding side edge of the inner air guide plate through the buckle assembly.

In some embodiments of the present disclosure, the buckle assembly includes an outer plate snap member disposed at the outer air guide plate and an inner plate snap member disposed at the inner air guide plate, and the outer plate snap member is snapped and engaged with the inner plate snap member in a length direction of the outer air guide plate.

In some embodiments of the present disclosure, two ends of the air guide plate assembly along a length of the air guide plate are a first end and a second end, respectively. Two sides of the air guide plate assembly along a width of the air guide plate are a first side and a second side, respectively. The outer plate snap member includes at least one first snap block disposed at the first side, and the inner plate snap member includes at least one first snap groove formed at the first side. Each of the at least one first snap groove has an open end close to the first end in a length direction of the air guide plate assembly and a closed end. The outer plate snap member includes at least one second snap groove formed at the second side, and the inner plate snap member includes at least one second snap block disposed at the second side. The snap groove has an open end close to the second end in the length direction of the air guide plate assembly and a closed end. When the outer air guide plate moves relative to the inner air guide plate in a direction from the first end to the second end, the at least one first snap block is snapped into the at least one first snap groove from the open end of the at least one first snap groove, and the at least one second snap block is snapped into the at least one second snap groove from the open end of the at least one second snap groove.

In some embodiments of the present disclosure, the at least one first snap block includes a plurality of first snap blocks arranged at intervals in the length direction of the air guide plate assembly, and the at least one first snap groove includes a plurality of first snap grooves arranged at intervals in the length direction of the air guide plate assembly. Each of the plurality of first snap blocks is snapped into the corresponding one of the plurality of first snap grooves. The at least one second snap block includes a plurality of second snap blocks arranged at intervals in the length direction of the air guide plate assembly, and the at least one second snap groove includes a plurality of second snap grooves arranged at intervals in the length direction of the air guide plate assembly. Each of the plurality of second snap blocks is snapped into the corresponding one of the plurality of second snap grooves.

In some embodiments of the present disclosure, the first snap groove has an open end close to the first side in a width direction of the air guide plate assembly, and the outer air guide plate is provided with at least one first limit buckle on the first side. The inner air guide plate is provided with a first limit rib on the first side, and the first limit rib is located at a side of the first snap groove facing away from the first side. The at least one first limit buckle is limited at a side of the first limit rib facing away from the first snap groove.

In some embodiments, the at least one first limit buckle includes a plurality of first limit buckles arranged at intervals in the length direction of the air guide plate assembly; and the first limit rib extends in the length direction of the air guide plate assembly.

In some embodiments of the present disclosure, the second snap groove has an open end close to the second side in a width direction of the air guide plate assembly. The outer air guide plate is provided with a second limit rib on the second side, the second limit rib is located at a side of the second snap groove facing away from the second side, and the inner air guide plate is provided with at least one second limit buckle on the second side. The at least second limit buckle is limited at a side of the second limit rib facing away from the second snap groove.

In some embodiments, the second limit rib extends in the length direction of the air guide plate assembly; and the at least one second limit buckle includes a plurality of second limit buckles arranged at intervals in the length direction of the air guide plate assembly.

According to some embodiments of the present disclosure, the outer air guide plate is fixedly connected to the inner air guide plate through a threaded fastener assembly.

In some embodiments of the present disclosure, the threaded fastener assembly includes a first threaded fastener, and an end of the outer air guide plate in a length direction of the outer air guide plate is fixedly connected to the inner air guide plate through the first threaded fastener.

In some embodiments of the present disclosure, the outer air guide plate includes an outer air guide plate body and an outer extension located at an end of the outer air guide plate body in a length direction of the outer air guide plate body. The inner air guide plate includes an inner air guide plate body and a second inner extension located at an end of the inner air guide plate body in a length direction of the inner air guide plate body. The first threaded fastener is a first screw, and the first screw passes through a first screw hole in the outer extension to be threadedly connected to a first screw post on the second inner extension.

In some embodiments of the present disclosure, the outer extension is provided with a first positioning structure. The second inner extension is provided with a second positioning structure at a side of the second inner extension facing towards the outer extension, and the first positioning structure and the second positioning structure are engaged with each other in an insertable manner in the length direction of the outer air guide plate.

In some embodiments, the first positioning structure is a positioning hole. The second positioning structure is a positioning post extending towards the outer extension until the positioning post is adjacent to the outer extension, and the positioning post is inserted into the positioning hole in the length direction of the outer air guide plate.

In some embodiments of the present disclosure, the threaded fastener assembly includes a second threaded fastener, and the outer air guide plate body is fixedly connected to the inner air guide plate body through the second threaded fastener.

In some embodiments, the inner air guide plate body has a second screw hole penetrating two side surfaces of the inner air guide plate body in a thickness direction of the inner air guide plate body. The inner side of the outer air guide plate body is provided with a second screw post. The second threaded fastener is a second screw passing through the second screw hole to be threadedly connected to the second screw post.

According to embodiments of the present disclosure, there is provided an air outlet frame assembly. The air outlet frame assembly includes an air outlet frame having at least one air outlet channel and the air guide component according to the embodiments of the present disclosure. An inner wall of the air outlet channel has a rotation hole. The air guide component is rotatably disposed in the air outlet channel, and the connector rotatably passes through the rotation hole.

In the air outlet frame assembly according to the present disclosure, through setting of the air guide component as mentioned above, the mounting and dismounting of the air guide component become simple, the mounting and dismounting efficiency of the air guide component is enhanced, thereby facilitating the maintenance and cleaning of the air guide component. In addition, the connector on the air guide assembly can be prevented from falling off and becoming lost.

According to embodiments of the present disclosure, there is provided an air conditioner. The air conditioner includes the above-mentioned air outlet frame assembly according to the embodiments of the present disclosure.

In the air conditioner according to the present disclosure, through the setting of the air outlet frame assembly as mentioned above, the mounting and dismounting of the air guide component become simple, the mounting and dismounting efficiency of the air guide component is enhanced, thereby facilitating the maintenance and cleaning of the air guide component. In addition, the connector on the air guide assembly can be prevented from falling off and becoming lost.

Additional aspects and advantages of the embodiments of present disclosure will be provided at least in part in the following description, or will become apparent in part from the following description, or can be learned from the practice of the embodiments of the present disclosure.

BRIEF DESCRIPTION OF THE DRAWINGS

These and other aspects and advantages of embodiments of the present disclosure will become apparent and more readily appreciated from the following descriptions made with reference to the accompanying drawings, in which.

Figure 1:
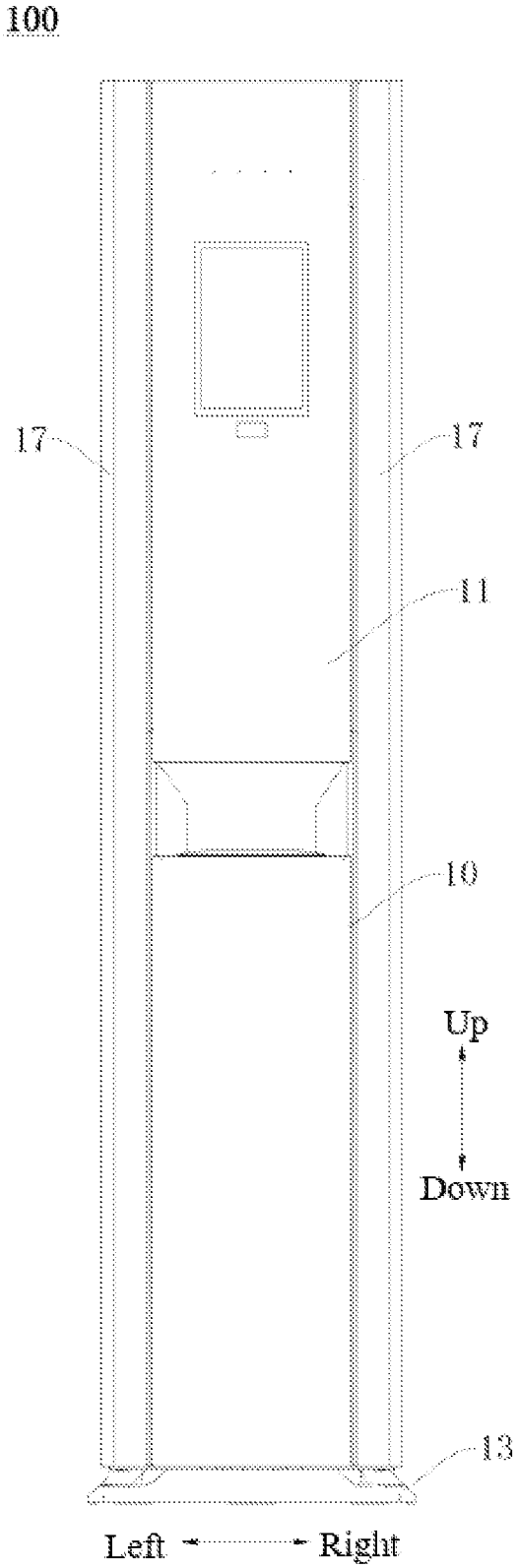
FIG. 1 is a front view of an indoor unit of an air conditioner according to some embodiments of the present disclosure, where an air outlet is closed by a door.
Figure 2:
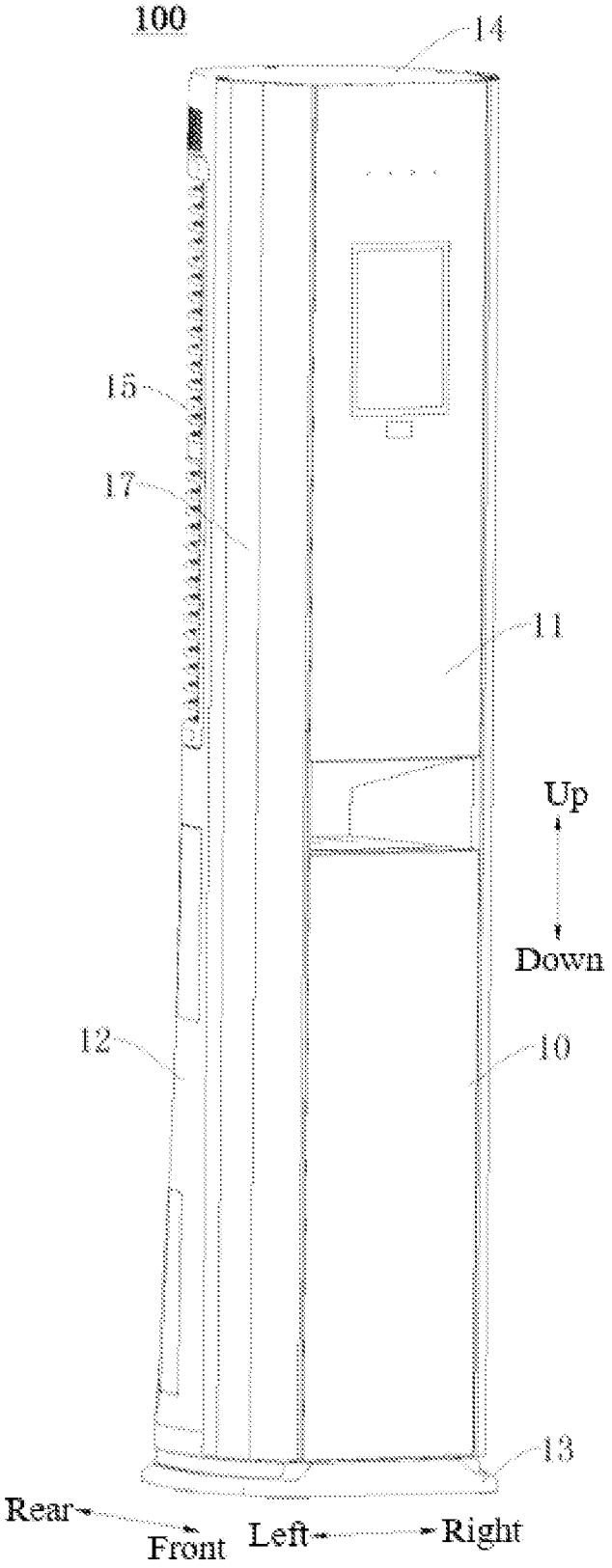
FIG. 2 is a perspective view of the indoor unit of the air conditioner illustrated in FIG. 1.
Figure 3:
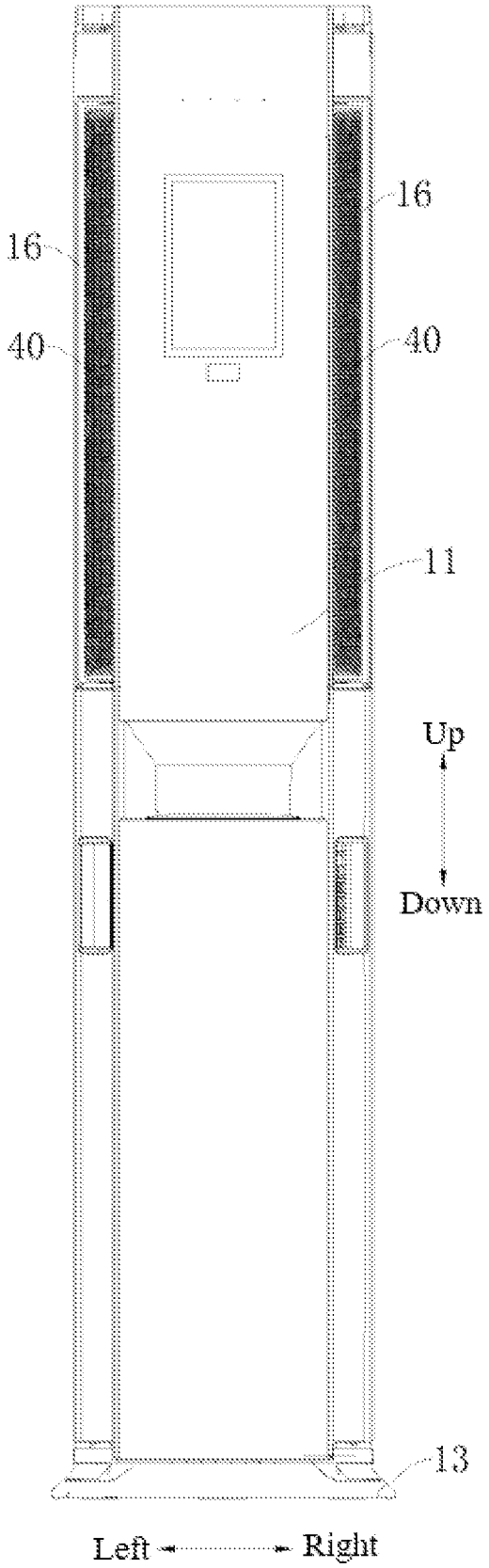
FIG. 3 is a front view of an indoor unit of an air conditioner according to some embodiments of the present disclosure, where a door is dismounted from an air outlet, and the air conditioner is in a windless mode.
Figure 4:
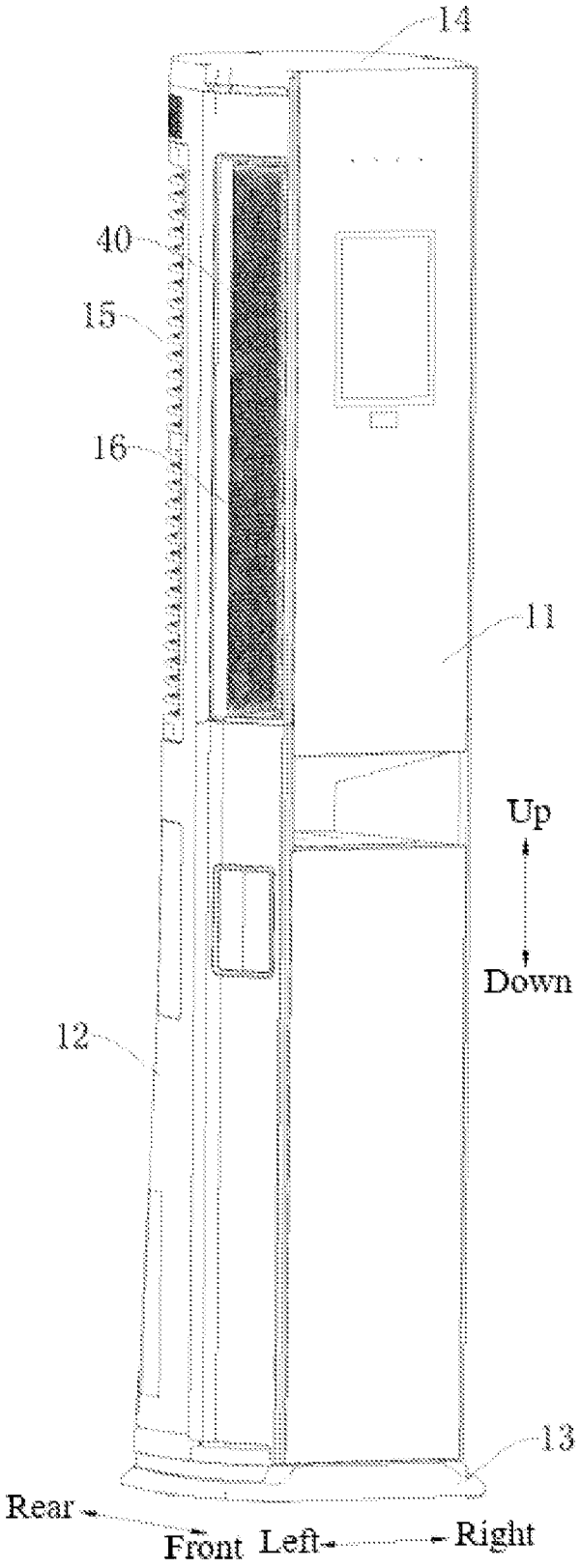
FIG. 4 is a perspective view of the indoor unit of the air conditioner illustrated in FIG. 3.

REFERENCE NUMERALS air conditioner indoor unit 100;

housing 10; front panel 11; back plate 12; base 13; top cover 14; air inlet 15; air outlet 16; door 17; support member 18; cooperation groove 181; fitting port 1811; protrusion member 182;

air outlet frame 20; air outlet channel 21; water receiving member 22; water receiver cavity 221; outer side wall 222; water retaining rib 223; rotation hole 224; shaft sleeve 23;

air guide drive mechanism 30; drive shaft 31; drive shaft sleeve 32;

air guide component 40; air guide assembly 401; accommodation cavity 4011; inner air guide assembly 402; first end 403; second end 404; first side 405; second side 406;

outer air guide plate 4; outer air guide plate body 4*a*; air diffusion structure 41; air diffusion hole 411; flow guide surface 42; flow guide 43; anti-disengagement structure 44; first snap block 451; second snap groove 452; first limit buckle 453; second limit rib 454; first positioning structure 455; second screw post 456; outer extension 4*b*; first screw hole 46;

louver drive mechanism 50;

inner air guide plate 5;

inner air guide plate body 51; limit buckle 511; limit groove 5111; limit rib plate 512; avoidance port 513; air flowing hole 514; first snap groove 515; second snap block 516; first limit rib 517; second limit buckle 518; second positioning structure 519; second screw hole 510;

first inner extension 52; mounting hole 521; second limit stopper 522; second inner extension 52*a*; first screw post 521*a;* slide assembly 53;

cooperation member 54; rotation member 541; abutment member 542; connection part 543;

first threaded fastener 55; second threaded fastener 56;

air diffusion fan blade assembly 61; rotor 611; rotor rotation shaft 6111; support ring 6112; rotor blade 6113; stator 612; stator hub 6121; stator hub 6122;

louver mechanism 62; connection rod 621; avoidance groove 6211; louver 622; louver rotation shaft 6221;

connector 7; connection member 71; connection post 711; shaft hole 7111; first limit stopper 712; positioning member 72; positioning member body 721; plug protrusion 722; elastic opening 723; reinforcement rib 724; positioning protrusion 725; elastic arm 726; and buckle handle 73.

DETAILED DESCRIPTION

The embodiments of the present disclosure will be described in detail below with reference to examples thereof as illustrated in the accompanying drawings, throughout which same or similar elements, or elements having same or similar functions, are denoted by same or similar reference numerals. The embodiments described below with reference to the accompanying drawings are illustrative only, and are intended to explain rather than limit the present disclosure.

An air guide component 40 according to the embodiments of the present disclosure is described below with reference to the accompanying drawings.

As illustrated in FIG. 5 to FIG. 10, according to embodiments of the present disclosure, there is provided an air guide component 40. The air guide component 40 is rotatably disposed in an air outlet channel 21 of an air conditioner and is driven to be rotated through an air guide drive mechanism 30. The air guide drive mechanism 30 may be a motor. The air guide drive mechanism 30 may be disposed on a side of the air outlet channel 21 in an axial of the air outlet channel 21 and is connected to the air guide component 40. Through rotation of the air guide component 40, airflow can be adjusted, for example, an airflow direction can be adjusted.

The air guide component 40 may include an air guide assembly 401 and a connector 7 disposed at an end of the air guide component 401 in a first direction (e.g., an up-down direction). For example, the connector 7 may be disposed at an upper end or a lower end of the air guide component 40, and the first direction is parallel to a rotation axis of the air guide assembly 401. The air guide assembly 401 may include an air guide plate assembly. The air guide plate assembly includes an outer air guide plate 4 and an inner air guide plate 5 disposed at an inner side of the outer air guide plate 4. The air guide assembly 401 may further include an inner air guide assembly 402 disposed at an inner side of the outer air guide plate 4. The inner air guide assembly 402 may at least include the inner air guide plate 5 as mentioned above. The connector 7 is disposed at the inner air guide plate 5. The connector 7 may be disposed at an end of the inner air guide plate 5 in the first direction (e.g., the up-down direction). For example, the connector 7 may be disposed at an upper end or a lower end of the inner air guide plate 5 and adapted to be connected to the air guide drive mechanism 30 that is configured to drive the air guide component 40 to rotate. The connector 7 is disposed at the inner air guide plate 5 of the air guide assembly 401 and connected to the air guide drive mechanism 30, and therefore the air guide drive mechanism 30 can be easily connected to the air guide component 40. Thus, the air guide component 40 can be easily driven to rotate by the air guide drive mechanism 30. The "inner side," as is the case with the inner air guide plate 5 disposed on the inner side of the outer air guide plate 4 and the inner air guide assembly 402 disposed in the inner side of the outer air guide plate 5, can be understood as a side close to a center of a housing 10 of the air conditioner when the air guide component 40 rotates to shield an air outlet end of the air outlet channel 21.

The outer air guide plate 4 is provided with an anti-disengagement structure 44. The inner air guide plate 5 of the air guide assembly 40 may be provided with a mounting structure that is configured to mount and position the connector 7 on the inner air guide plate 5 of the air guide assembly 401, and therefore the connector 7 is fixed relative to the air guide assembly 401. Based on the mounting structure may have an avoidance port 513 formed at the inner air guide plate 5, part of the connector 7 passes through the avoidance port 513. The avoidance port 513 is disposed at the inner air guide plate 5, and therefore the part of the connector 7 can passes through the avoidance port 513. Thus, the part of the connector 7 may be disposed relative to the anti-disengagement structure 44 in the first direction. As a result, the anti-disengagement structure 44 has a limiting effect on the connector 7 in the first direction.

The connector 7 is movable between a first position and a second position. For example, the connector 7 may be movable between the first position and the second position along the first direction, and the avoidance port 513 may extend along the first direction. When the connector moves between the first position and the second position along the first direction, a part of the connector 7 engaged with the avoidance port 513 may slide along the avoidance port 513, which has a guiding effect on a movement of the connector 7 along the first direction. Moreover, two side walls of the avoidance port 513 in a third direction have limiting effects on the connector 7 in the third direction. The third direction is perpendicular to the first direction.

When the connector 7 is at the first position, the connector 7 is mounted and positioned on the inner air guide plate 5 through the mounting structure, and therefore the connector 7 is mounted and positioned on the air guide assembly 401. In this case, the connector 7 is adapted to be connected to the air guide drive mechanism 30. Thus, the air guide component 40 can be connected to the air guide drive mechanism 30. When the connector 7 is at the second position, the connector 7 is separated from the air guide drive mechanism 30 by moving the connector 7 to the second position from the first position. In this case, the connector 7 is limited by the mounting structure on the inner air guide plate 5 and the anti-disengagement structure 44 on the outer air guide plate 4 to prevent the connector 7 from falling off from the air guide assembly 401. Thus, the connector 7 can be prevented from becoming lost.

Moreover, since the inner air guide plate 5 is provided with the mounting structure that is configured to mount and position the connector 7 and the outer air guide plate 4 is provided with the anti-disengagement structure 44, difficulty of mounting and dismounting of the connector 7 itself can be reduced, in addition to that the connector 7 can be prevented from falling off and becoming lost when the air guide component 40 is separated from the air guide drive mechanism 30. For example, when the connector 7 needs to be replaced due to wear failure over the course of long-term usage, the connector 7 is disengaged from the mounting structure on the inner air guide plate 5, and then the connector 7 may be dismounted and replaced with a new one. Then, the new connector 7 and the mounting structure on the inner air guide plate 5 cooperate with each other, and the new connector 7 is mounted.

For example, the anti-disengagement structure 44 may be located on a side of the connector 7 facing away from the air guide drive mechanism 30 and may be located between the outer air guide plate 4 and the inner air guide plate 5. When the connector 7 is at the second position, the anti-disengagement structure 44 cooperates with the part of the connector 7 passing through the avoidance port 513 to limit a movement of the connector 7 in the first direction and in a direction away from the air guide drive mechanism 30. In this way, the connector 7 can be prevented from falling off from the air guide assembly 401. As a result, the connector 7 can be prevented from becoming lost.

When the air guide component 40 needs to be mounted in the air outlet channel 21 of the air conditioner, the connector 7 may be moved from the second position to the first position. For example, an acting force is exerted on the connector 7 to enable the connector 7 to move, in the first direction and in a direction adjacent to the air guide drive mechanism 30, to the first position, so that the connector 7 is connected to the air guide drive mechanism 30. As a result, the air guide component 40 is connected to the air guide drive mechanism 30. In this way, mounting of the air guide component 40 is achieved, so that the dismounting is convenient and the operation is easy. When the connector 7 is located at the first position, the anti-disengagement structure 44 on the outer air guide plate 4 and the part of the connector 7 passing through the avoidance port 513 have a movement distance for the connector 7 to move in the first direction. The movement distance is greater than or equal to a distance between the first position and the second position in the first direction, i.e., the movement distance is greater than or equal to a movement distance of the connector 7 between the first position and the second position.

When the air guide component 40 needs to be dismounted from the air outlet channel 21 of the air conditioner, the connector 7 may be moved from the first position to the second position. For example, the acting force is exerted on the connector 7 to enable the connector 7 to move, in the first direction and in a direction away from the air guide drive mechanism 30, to the second position. Thus, the connector 7 is separated from the air guide drive mechanism 30. As a result, the air guide component 40 is also separated from the air guide drive mechanism 30. In this way, dismounting of the air guide component 40 is achieved, so that the dismounting is convenient and the operation is easy. When the connector 7 is located at the second position, the anti-disengagement structure 44 on the outer air guide plate 4 and the part of the connector 7 passing through the avoidance port 513 may abut against each other or have a small distance in the first direction. Therefore, the connector 7 is limited by the anti-disengagement structure 44 in the first direction and in a direction away from the air guide drive mechanism 30, which can prevent the connector 7 from falling off and becoming lost.

An example is given where the first direction is an up-down direction and the air guide drive mechanism 30 is located below the air guide component 40, a mounting dismounting process of the air guide component 40 are described herein.

When the air guide component 40 needs to be mounted in the air outlet channel 21 of the air conditioner, the connector 7 may be pressed downwards to enable the connector 7 to move from the second position to the first position. Therefore, the connector 7 is connected to the air guide drive mechanism 30. Moreover, the connector 7 cooperates with the mounting structure on the inner air guide plate 5, and the connector 7 is mounted and positioned at the first position through the mounting structure. As a result, the air guide component 40 is connected to the air guide drive mechanism 30. In this way, mounting of the air guide component 40 is achieved, so that the dismounting is convenient and the operation is easy. When the air guide component 40 needs to be dismounted from the air outlet channel 21 of the air conditioner, the connector 7 may be pulled upwards to enable the connector 7 to move from the first position to the second position. Therefore, the connector 7 is separated from the air guide drive mechanism 30. As a result, separation of the air guide component 40 from the air guide drive mechanism 30 is achieved. In this way, the dismounting of the air guide component 40 is achieved, so that the dismounting is convenient and the operation is easy.

In the air guide component 40 according to the embodiments of the present disclosure, by disposing the connector 7 that is connected to the air guide drive mechanism on the air guide assembly 401 and enabling the connector 7 to move between the first position and the second position, the connector 7 is easily connected to and separated from the air guide drive mechanism 30. Therefore, the mounting and dismounting operation of the air guide component 40 is simple and convenient. In this way, a mounting and dismounting efficiency of the air guide component 40 is enhanced. As a result, the maintenance and cleaning of the air guide component 40 are facilitated. In addition, when the air guide component 40 is separated from the air guide drive mechanism 30, the connector 7 can be limited by the mounting structure on the inner air guide plate 5 and the anti-disengagement structure 44 on the outer air guide plate 4. Therefore, the connector 7 on the air guide assembly 401 can be prevented from falling off and becoming lost to ensure that the air guide component 40 is successfully mounted and dismounted.

According to some embodiments of the present disclosure, referring to FIG. 6 to FIG. 8 and FIG. 10 to FIG. 12, the connector 7 may include a connection member 71 and a positioning member 72 that are arranged in the first direction. The connection member 71 is connected to the positioning member 72. The connector 7 may be an integral formed member. The mounting structure may have a mounting hole 521. The connection member 71 may pass through the mounting hole 521 and fixed relative to the mounting hole 521. The connection member 71 partially extends out of the mounting hole 521 and is adapted to be connected to the air guide drive mechanism 30, and the positioning member 72 partially passes through the avoidance port 513. When the connector 7 moves in the first direction, the positioning member 72 may slide along the avoidance port 513, and therefore the connector 7 moves stably in the first direction.

Moreover, due to setting of the mounting hole 521 through which the connection member 71 of the connector 7 passes, the connection member 71 can be limited in a direction perpendicular to the first direction to allow for more reliable mounting and positioning of the connector 7. When the connector 7 is at the first position, the connection member 71 of the connector 7 may be reliably engaged with the mounting hole 521 and is adapted to be connected to the air guide drive mechanism 30. When the connector 7 is at the second position, the connection member 71 of the connector 7 may be disengaged from the mounting hole 521, or the connection member 71 is at least partially disengaged from the mounting hole 521, and the connection member 71 is separated from the air guide drive mechanism 30.

In this embodiment, an example is still given where the first direction is the up-down direction and the air guide drive mechanism 30 is located below the air guide component 40, the mounting dismounting process of the air guide component 40 are described herein.

When the air guide component 40 needs to be mounted in the air outlet channel 21 of the air conditioner, the connector 7 may be pressed downwards to enable the connector 7 to move from the second position to the first position. In this case, the connection member 71 of the connector 71 is fitted into the mounting hole 521. Therefore, the connection member 71 and the mounting hole 521 are relatively fixed, and at the same time, the connector 7 is connected to the air guide drive mechanism 30. Moreover, the connector 7 cooperates with the mounting structure on the inner air guide plate 5, and the connector 7 is mounted and positioned at the first position through the mounting structure. As a result, the air guide component 40 is connected to the air guide drive mechanism 30. In this way, the mounting of the air guide component 40 is achieved, so that the mounting is convenient and the operation is easy.

When the air guide component 40 needs to be dismounted from the air outlet channel 21 of the air conditioner, the connector 7 can be pulled upwards to enable the connector 7 to move from the first position to the second position.

Thus, the connection member 71 of the connector 7 is separated from the air guide drive mechanism 30. In this case, the connection member 71 is at least partially separated from the mounting hole 521. As a result, the air guide component 40 is separated from the air guide drive mechanism 30. In this way, the dismounting of the air guide component 40 is achieved, so that the dismounting is convenient and the operation is easy.

According to some embodiments of the present disclosure, referring to FIG. 6 to FIG. 8 and FIG. 10 to FIG. 16, the connection member 71 may include a connection post 711 and a first limit stopper 712. The first limit stopper 712 may be formed on an outer peripheral wall of the connection post 711. For example, when the first direction is an up-down direction and the mounting hole 521 is formed at a lower end of the air guide assembly 401, the first limit stopper 712 may be formed at a top of the connection post 711. The first limit stopper 712 may extend in a circumferential direction of the connection post 71 and be of an annular shape, and a bottom of the positioning member 72 may be connected to the first limit stopper 712. An inner peripheral wall of the mounting hole 521 may be provided with a second limit stopper 522. The second limit stopper 522 may extend in a circumferential direction of the mounting hole 521 and be of an annular shape.

When the connector 7 is at the first position, the connection post 711 of the connector 7 is fitted into the mounting hole 521, the second limit stopper 522 and the first limit stopper 712 may abut against each other in the first direction, and the first limit stopper 712 is located on a side of the second limit stopper 522 adjacent to the positioning member 72 to restrict a movement of the connector 7 in the first direction and in a direction adjacent to the air guide drive mechanism 30. Therefore, when the connector 7 is moved from the second position to the first position, the connector 7 can be limited in the first position through abutting fit between the second limit stopper 522 and the first limit stopper 712. In this way, excessive displacement of the connector 7 due to immoderate force is avoided, ensuring the reliable mounting and positioning of the connector 7, and enabling the connector 7 to move from the second position to the first position accurately.

For example, when the connector 7 is moved to the first position by pressing the connector 7, since the second limit stopper 522 in the mounting hole 521 at this time can limit the connector 7 to continue moving downwards, an operator feels larger resistance, which indicates that the connector 7 has moved accurately to the first position. In addition, when the connector 7 moves to the second position, although the connection member 71 is at least partially separated from the mounting hole 521, the second limit stopper 522 in the mounting hole 521 still can limit the connector 7 downwards. In this way, the connector 7 is prevented from moving downwards and falling off from the mounting hole 521.

In some embodiments of the present disclosure, referring to FIG. 6 to FIG. 8 and FIG. 10 to FIG. 14, the positioning member 72 may include a positioning member body 721 and a positioning protrusion 725. The positioning member body 721 may be located at a side of the inner air guide plate 5 facing away from the outer air guide plate 4. The positioning protrusion 725 may be disposed on a side of the positioning member body 721 in a second direction (e.g., a front-rear direction). For example, the positioning protrusion 725 may be formed a front side of the positioning member body 721 and passes through the avoidance port 513. Therefore, the positioning protrusion 725 and the anti-disengagement structure 44 on the outer air guide plate 4 are opposite to each other in the first direction, and the positioning member 72 is limited in a third direction by the two side walls of the avoidance port 513 in the third direction. The second direction is perpendicular to the first direction, and the third direction is perpendicular to the first direction and the second direction. Since the positioning member 72 may include the positioning member body 721 and the positioning protrusion 725, it is convenient for the positioning member 72 to partially pass through the avoidance port 513. In the process that the connector 7 moves in the first direction, the positioning member 72 slides along the avoidance port 513, which ensures that the connector 7 moves reliably and stably in the first direction. Moreover, the avoidance port 513 has a limiting effect on the positioning member 72 in the third direction.

It should be noted that whether the connector 7 is at the first position or the second position, the positioning protrusion 725 of the positioning member 72 is always engaged with the avoidance port 513. In this way, when at the first position, the connector 7 can be reliably mounted and positioned at the first position. When at the second position, the connector 7 can be prevented from falling off from the third direction. Therefore, a better limiting effect is achieved.

In some embodiments, referring to FIG. 12 to FIG. 16, the positioning member body 721 may be in a shape of a flat plate, and the positioning protrusion 725 may be in a U shape with an upward opening. Therefore, high structural strength of the positioning member 72 is guaranteed. The anti-disengagement structure 44 may be formed as a protruding block. Thus, the anti-disengagement structure 44 has a simple structure, which is convenient for processing and molding.

In some embodiments, referring to FIG. 12 to FIG. 16, the positioning member body 721 may be provided with a reinforcement rib 724. The reinforcement rib 724 is located on a side of the positioning member body 721 facing away from the positioning protrusion 725. The reinforcement rib 724 may extend to the connection member 71 and be connected to the connection member 71. The reinforcement rib 724 can increase the connection strength between the positioning member 72 and the connection member 71 while enhancing the structural strength of the positioning member 72. Therefore, an overall structural strength of the connector 7 is improved.

In a further embodiment of the present disclosure, referring to FIG. 6 to FIG. 8 and FIG. 10 to FIG. 14, the mounting structure may further include a limit buckle 511 formed on the side of the inner air guide plate 5 facing away from the outer air guide plate 4. The limit buckle 511 may be disposed on two opposite sides of the positioning member body 721 in the third direction (e.g., a left-right direction). The limit groove 5111 may be formed between the limit buckle 511 and the inner air guide plate 5. Each of two ends of the positioning member body 721 in the third direction may cooperate with a limit groove 5111 on each of the two sides to at least limit the positioning member 72 in the second direction (e.g., a front-back direction). Therefore, through the mounting hole 521, the avoiding opening 513, and the limit buckle 511 that are described above, the connector 7 can be limited in a plurality of directions. Thus, the connector 7 is reliably mounted and positioned on the inner air guide plate 5 when at the first position, and the connector 7 can be better prevented from falling off and becoming lost when at the second position.

It should be noted that whether the connector 7 is at the first position or the second position, the two ends of the positioning member body 721 in the third direction cooperate with the limit grooves 5111 on the two sides all the time. In this way, when at the first position, the connector 7 can be reliably mounted and positioned at the first position. When at the second position, the connector 7 can be prevented from falling off from the second direction. Therefore, the better limiting effect is achieved.

In some embodiments, the positioning member body 721 cooperates with the limit groove 5111 to limit the positioning member 72 in the second direction and the third direction. Through cooperation between the positioning member body 721 and the limit groove 5111, the positioning member body 721 can be limited in a plurality of directions. Therefore, the connector 7 is reliably limited.

For example, as illustrated in FIG. 6 to FIG. 8 and FIG. 10 to FIG. 14, the first direction is the up-down direction, the second direction is the front-rear direction, and the third direction is the left-right direction. The limit grooves 5111 are formed by the limit buckles 511 on the left side and the right side of the positioning member body 721 and the inner air guide plate 5. The positioning member body 721 is limited by the left and right limit grooves 5111 in the left-right direction and the front-rear direction.

Figure 12:
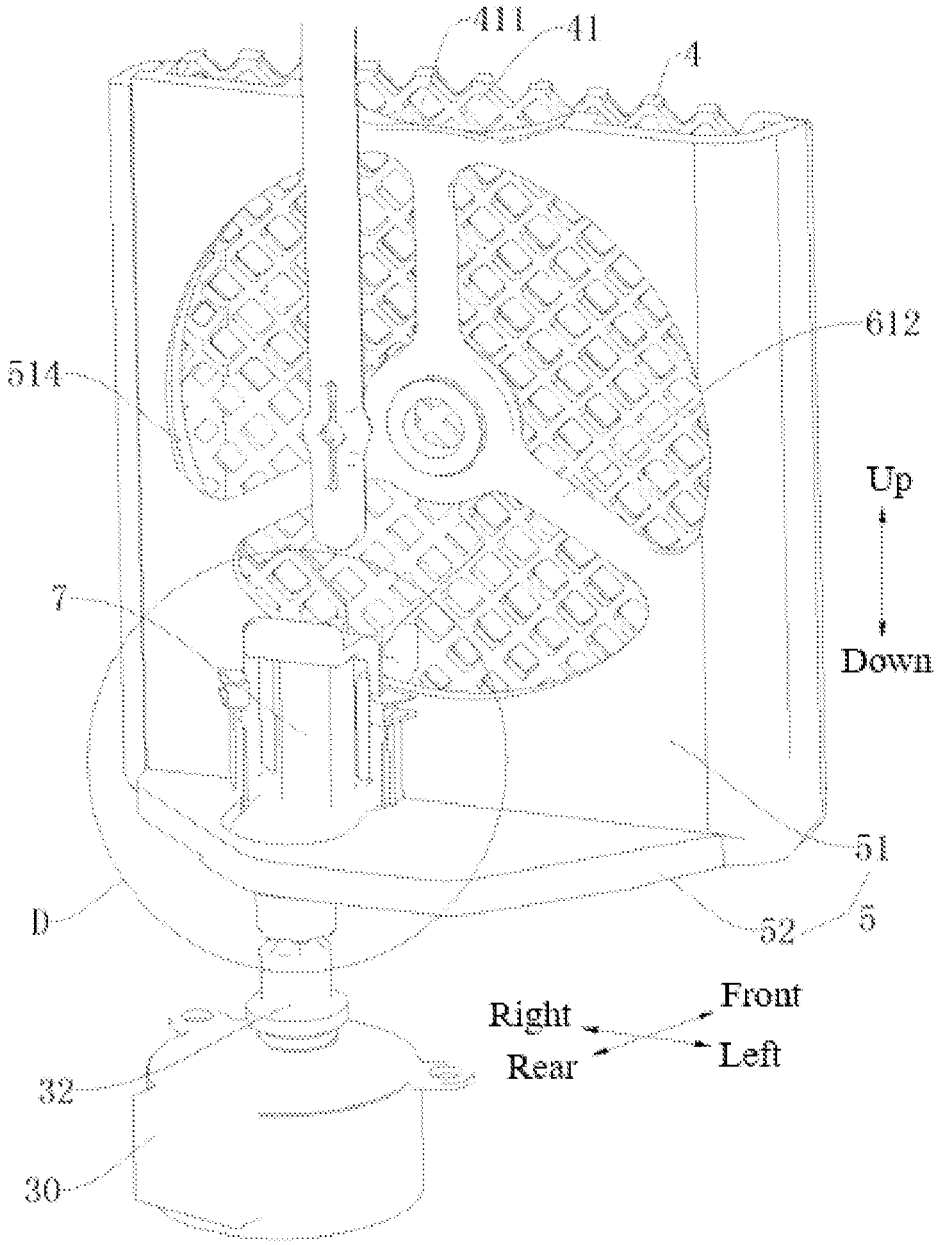
FIG. 12 is a fitting diagram of an air guide component and an air guide drive mechanism according to some embodiments of the present disclosure.
Figure 13:
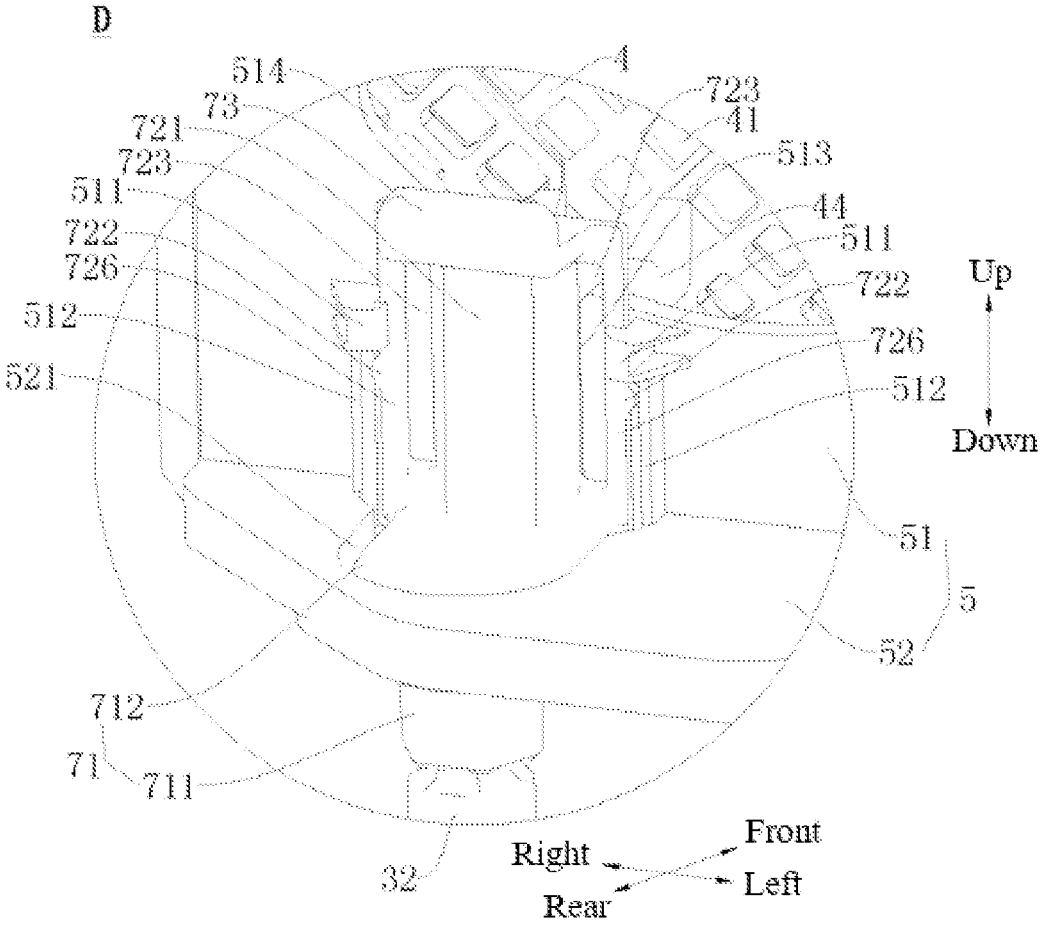
FIG. 13 is an enlarged view at a position D illustrated in FIG. 12.
Figure 14:
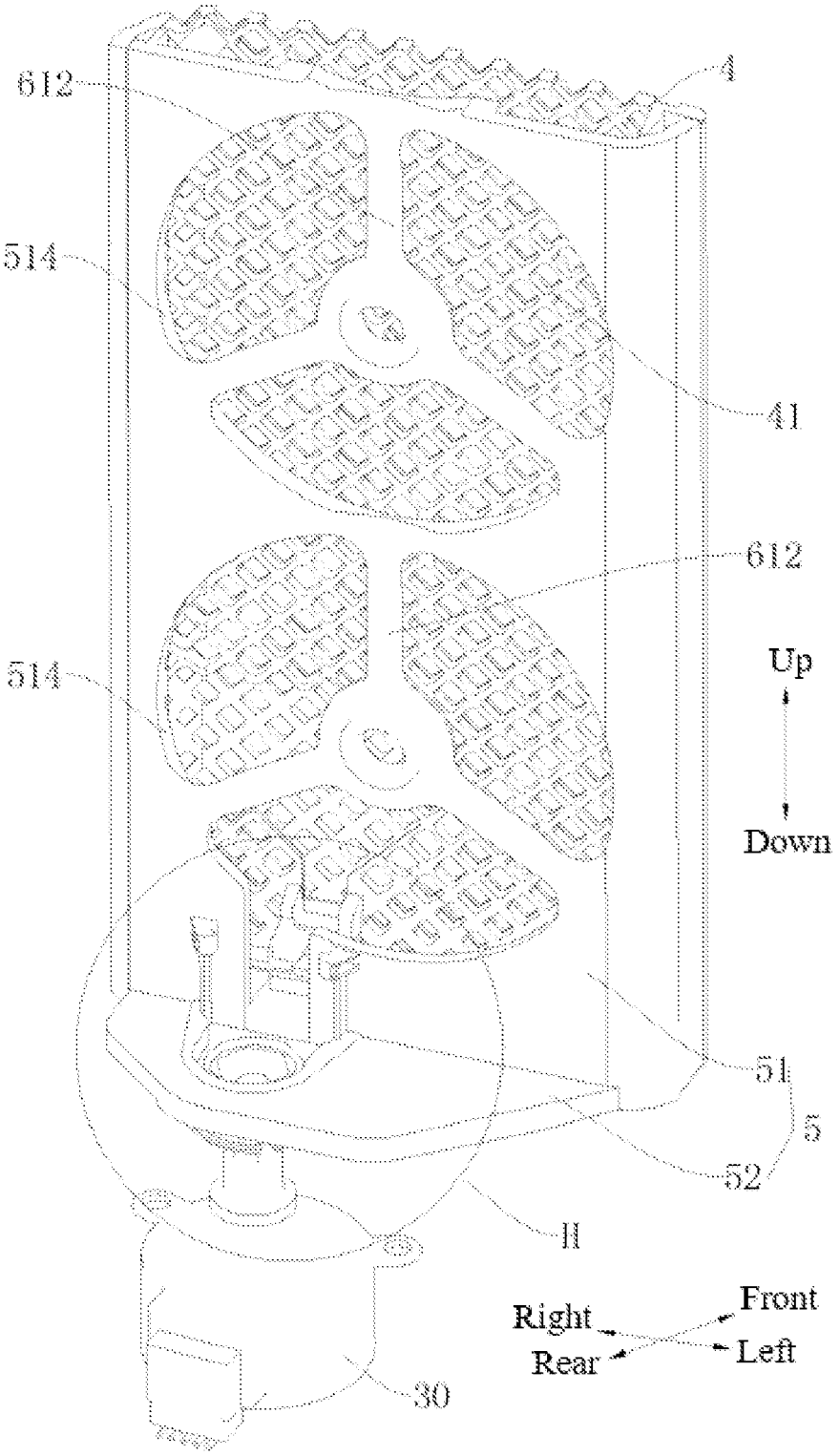
FIG. 14 is a fitting diagram of an air guide component and an air guide drive mechanism according to some embodiments of the present disclosure, whose connector is dismounted from an air guide assembly.
Figure 15:
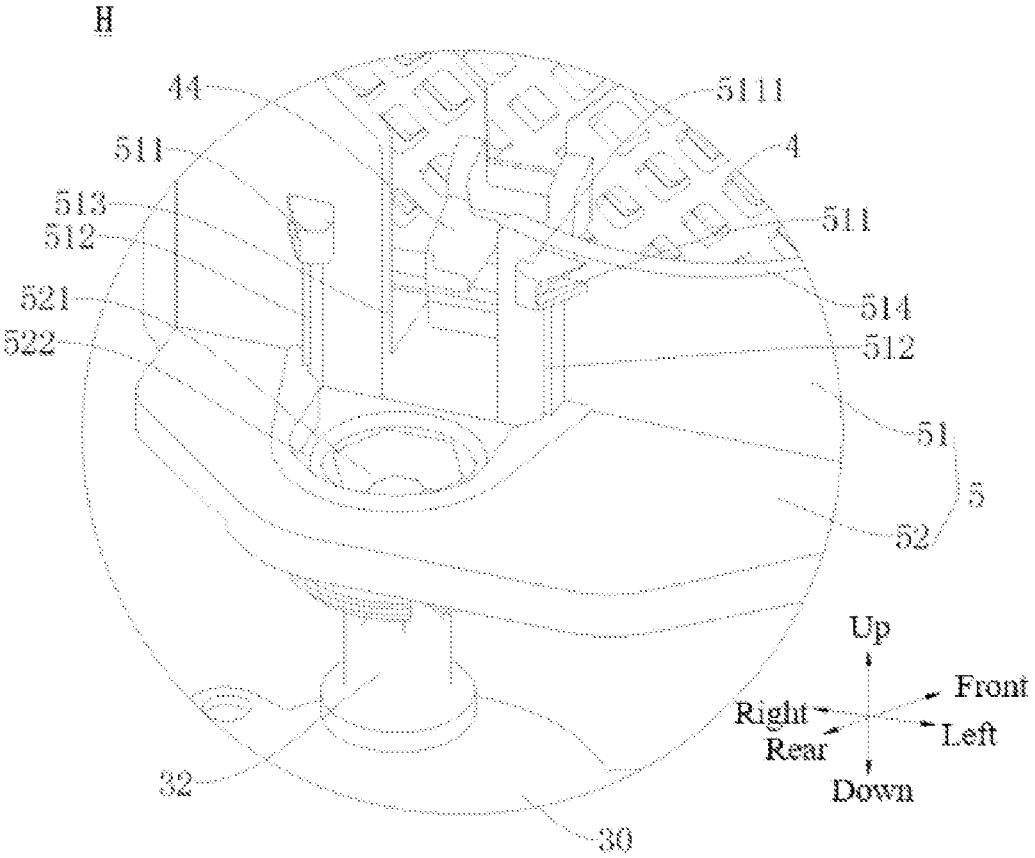
FIG. 15 is an enlarged view at a position H illustrated in FIG. 14.
Figure 16:
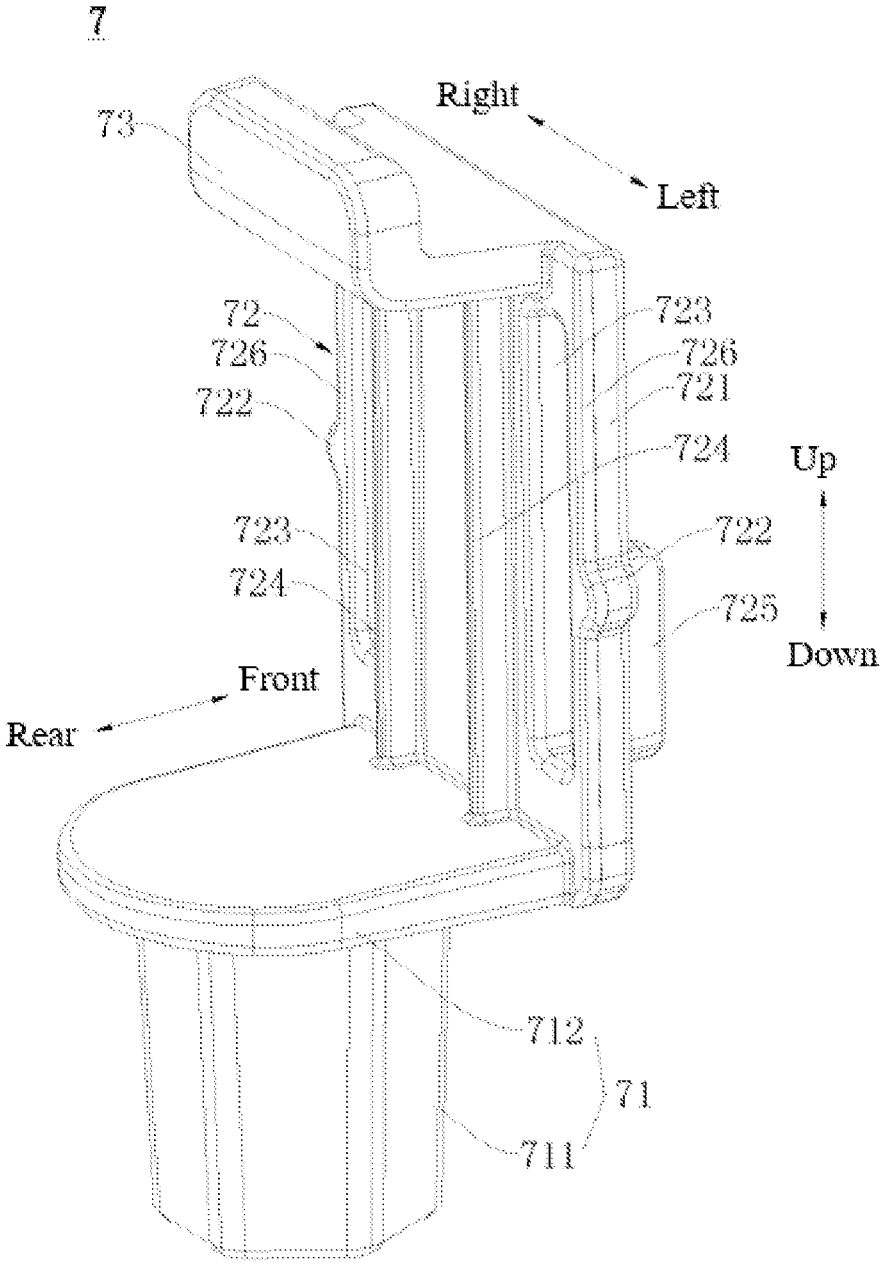
FIG. 16 is a perspective view of a connector of an air guide component according to some embodiments of the present disclosure.

In some embodiments of the present disclosure, referring to FIG. 12 to FIG. 14, a plug protrusion 722 may be formed on the positioning member body 721, and may be formed on two opposite side walls of the positioning member body 721 in the third direction. When the connector 7 is at the first position, the plug protrusion 722 is located on a side of the limit buckle 511 adjacent to the connection member 71. In this case, the limit buckle 511 can limit the plug protrusion 722 in the first direction and in a direction away from the air guide drive mechanism 30, which ensures that the connector 7 is further reliably positioned in the first position. When the connector 7 is at the second position, the plug protrusion 722 is located on a side of the limit buckle 511 facing away from the connection member 71. In this case, the limit buckle 511 can limit the plug protrusion 722 in the first direction and in a direction adjacent to the air guide drive mechanism 30, which ensures that the connector 7 is reliably limited at the second position. Therefore, the connector 7 can be better prevented from falling off and becoming lost.

During insertion and pulling of the connector 7 in the first direction, the plug protrusion 722 is pressed against the limit buckle 511 when located in the limit groove 5111. Therefore, an operator may feel obvious resistance. In addition, when the plug protrusion 722 passes through the limit groove 5111, since the plug protrusion 722 is extruded and reset, there exists an obvious sound during the insertion and pulling process. Thus, the operator can be prompted that the connector 7 is inserted and plugged in place.

Still, an example is given where the first direction is the up-down direction and the mounting hole 521 is formed below the air guide assembly 401. When the air guide component 40 needs to be mounted in the air outlet channel 21 of the air conditioner, the connector 7 may be pressed downwards to enable the connector 7 to move from the second position to the first position. In this case, the connection member 71 of the connector 7 is fitted into the mounting hole 521. Therefore, the connection member 71 is fixed relative to the mounting hole 521, and at the same time, the connector 7 is connected to the air guide drive mechanism 30. Moreover, the connector 7 cooperates with the mounting structure on the inner air guide plate 5, and the connector 7 is mounted and positioned at the first position through the mounting structure. As a result, the air guide component 40 is connected to the air guide drive mechanism 30. In this way, the mounting of the air guide component 40 is achieved, so that the mounting is convenient and the operation is easy.

In the process that the connector 7 moves from the second position to the first position, the plug protrusion 722 on the positioning member body 721 moves downwards together with the positioning member body 721 and passes through the limit groove 5111, and the plug protrusion 722 is squeezed. When moving below the limit buckle 511, the plug protrusion 722 is disengaged from the limit groove 5111, and is reset with a sound. Therefore, the operator is prompted that the connector 7 has been inserted into the mounting hole 521 and is mounted in place. Moreover, in this case, since the limit buckle 511 is located on an upper side of the plug protrusion 722, the connector 7 can be further limited in an upward direction to better position the connector 7 at the first position.

When the air guide component 40 needs to be dismounted from the air outlet channel 21 of the air conditioner, the connector 7 can be pulled upwards to enable the connector 7 to move from the first position to the second position. Thus, the connection member 71 of the connector 7 is separated from the air guide drive mechanism 30. In this case, the connection member 71 is at least partially separated from the mounting hole 521. In this way, the separation of the air guide component 40 and the air guide drive mechanism 30 is achieved. As a result, the dismounting of the air guide component 40 is achieved, so that the dismounting is convenient and the operation is easy. In the process that the connector 7 moves from the first position to the second position, the plug protrusion 722 on the positioning member body 721 moves upwards along with the positioning member body 721 and passes through the limit groove 5111, and the plug protrusion 722 is squeezed. When moving above the limit buckle 511, the plug protrusion 722 is disengaged from the limit groove 5111 and is reset with a sound. The operator is prompted that the connector 7 has been pulled up in place. Moreover, in this case, since the limit buckle 511 is located on a lower side of the plug protrusion 722, the connector 7 can be limited in a downward direction to prevent the connector 7 from falling off.

In some embodiments, referring to FIG. 12 to FIG. 14, an elastic opening 723 is formed on the positioning member body 721. Two elastic opening 723 may be provided and located at two opposite ends of the positioning member body 721 in the third direction and extends along the first direction, respectively. An elastic arm 726 is formed between the elastic opening 723 and each of the two opposite side walls of the positioning member body 721 in the third direction. The plug protrusion 722 is formed on the elastic arm 726. For example, two elastic openings 723 are located at the left end and the right end of the positioning member body 721, respectively. A left part of the positioning member body 721 located on the left elastic opening 723 is formed as an elastic arm 726, and a right part of the positioning member body 721 located on the right elastic opening 723 is also formed as an elastic arm 726. The limit grooves 5111 formed between the two limit buckles 511 and the inner air guide plate 5 cooperate with the two elastic arms 726, respectively. Therefore, the positioning member 72 can be limited in the left-right direction (i.e., the second direction).

Therefore, through the elastic opening 723 formed on the positioning member body 721, the elastic arm 726 having an elastic deformation capability may be formed at each of the two ends of the positioning member body 721. In addition, the elastic arm 726 can elastically deform in the second direction, and an elastic deformation space is provided for the elastic arm 726 by the elastic opening 723. When the connector moves in the first direction and the plug protrusion 722 is located in the limit groove 5111, the plug protrusion 722 can be easily squeezed by the limit buckle 511. When plug protrusion 722 is squeezed by the limit buckle 511, the elastic arm 726 is also squeezed and thus elastically deformed. After the insertion protrusion 722 passes through the limit groove 5111, the elastic arm 726 is reset, and therefore the plug protrusion 722 is reset.

In some embodiments, when the reinforcement rib 724 as mentioned above is disposed on the positioning member body 721, the reinforcement rib may be located between the two elastic openings 723 and disposed adjacent to the elastic opening 723.

In a further embodiment of the present disclosure, referring to FIG. 12 to FIG. 14, the mounting structure may further include a limit rib plate 512. The limit rib plate 512 may extend in the first direction. Two limit rib plates 512 may be provided and located on the two opposite sides of the positioning member body 721 in the third direction. When the connector 7 is located at the first position, the plug protrusion 722 abuts against a corresponding limit rib plate 512 in the third direction. In this way, the position limit effect on the positioning part 72 in the third direction can be further enhanced. Moreover, when the connector 7 moves in the first direction, the plug protrusion 722 can slide along the limit rib plate 512. Thus, a reliable stability of the connector 7 moving in the first direction is further improved.

In some embodiments of the present disclosure, referring to FIG. 12 to FIG. 14, a cross section of the connection post 711 may be formed into a polygon, a cross section of a part of the mounting hole 521 engaged with the connection post 711 is also formed into a polygonal shape. In addition, a shape of the cross section of the engaged part of the mounting hole 521 and the connection post 711 is adapted to a shape of the cross section of the connection post 711. For example, the cross section of the connection post 711 may be formed into a hexagonal shape, and the cross section of the part of the mounting hole 521 engaged with the connection post 711 may also be formed into a hexagonal shape. Therefore, the cross section of the connection post 711 is in a polygonal shape, and the cross section of the part of the mounting hole 521 engaged with the connection post 711 is also in a polygonal shape. Thus, the connection post 711 can be stably and reliably engaged with the mounting hole 521 and is fixed relative to the inner peripheral wall of the mounting hole 521. In this way, when the air guide drive mechanism 30 is connected to the connection post 711 and the connector 7 is driven by the air guide drive mechanism 30 to rotate, the connection post 711 can be prevented from moving relative to the air guide assembly 401. As a result, the air guide drive mechanism 30 can stably and reliably drive the whole air guide component 40 to rotate.

In some embodiments, the air guide drive mechanism 30 may be a motor. A drive shaft sleeve 32 may be sleeved on an outer side of a drive shaft 31 of the air guide drive mechanism 30. The drive shaft sleeve 32 is an insulating member. The drive shaft sleeve 32 is fixed relative to the drive shaft 31. A shaft hole 7111 is formed in the connection post 711 of the connector 7. When the air guide drive mechanism 30 is connected to the connector 7, a drive shaft 31 sleeved with drive shaft sleeve 32 can be fitted into the shaft hole 7111, and therefore connection and detachment between the connector 7 and the air guide drive mechanism 30. For example, the connector 7 may be pressed in the first direction, and therefore the drive shaft 31 of the air guide drive mechanism 30 is fitted into the shaft hole 7111 of the connector 7. Thus, the air guide member 40 can be connected to the air guide drive mechanism 30. The connector 7 may also be pulled up in the first direction, and therefore the shaft hole 7111 of the connector 7 is disengaged from the drive shaft 31 of the air guide drive mechanism 30. Thus, separation of the air guide component 40 from the air guide drive mechanism 30 is achieved.

In some embodiments, a cross section of the drive shaft 31 may also be in a polygonal shape (e.g., a hexagon), a part of the drive shaft sleeve 32 engaged with the shaft hole 7111 of the connection post 711 may also be formed into a polygonal shape (e.g., the hexagon), and the shaft hole 7111 in the connection post 711 may also be formed into a polygonal shape (e.g., the hexagon).

Figure 10:
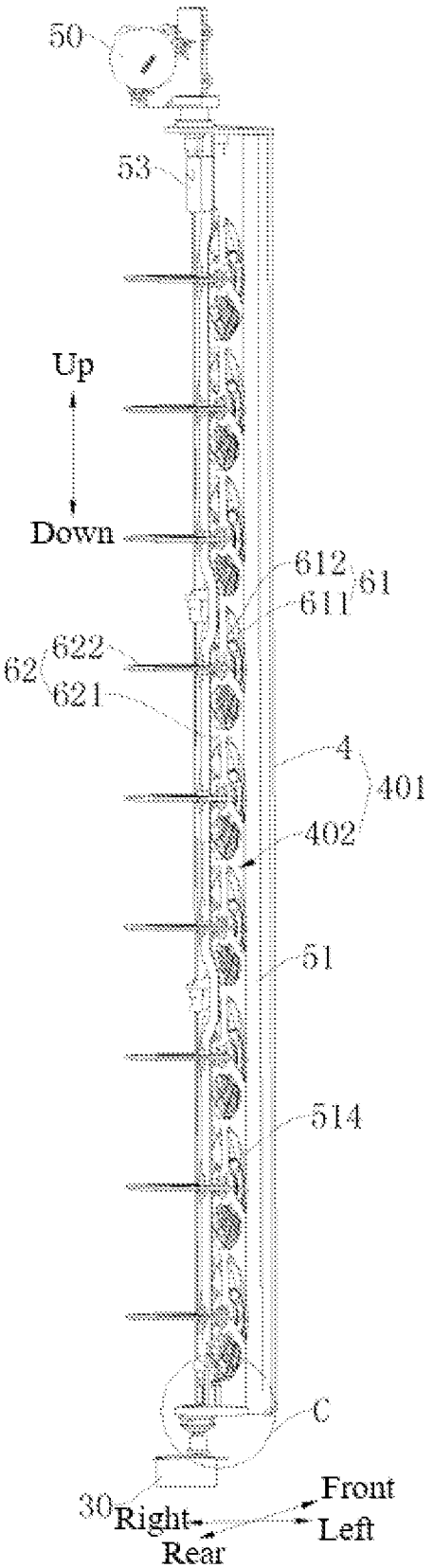
FIG. 10 is a fitting diagram of an air guide component, an air guide drive mechanism, and a louver drive mechanism according to some embodiments of the present disclosure.
Figure 11:
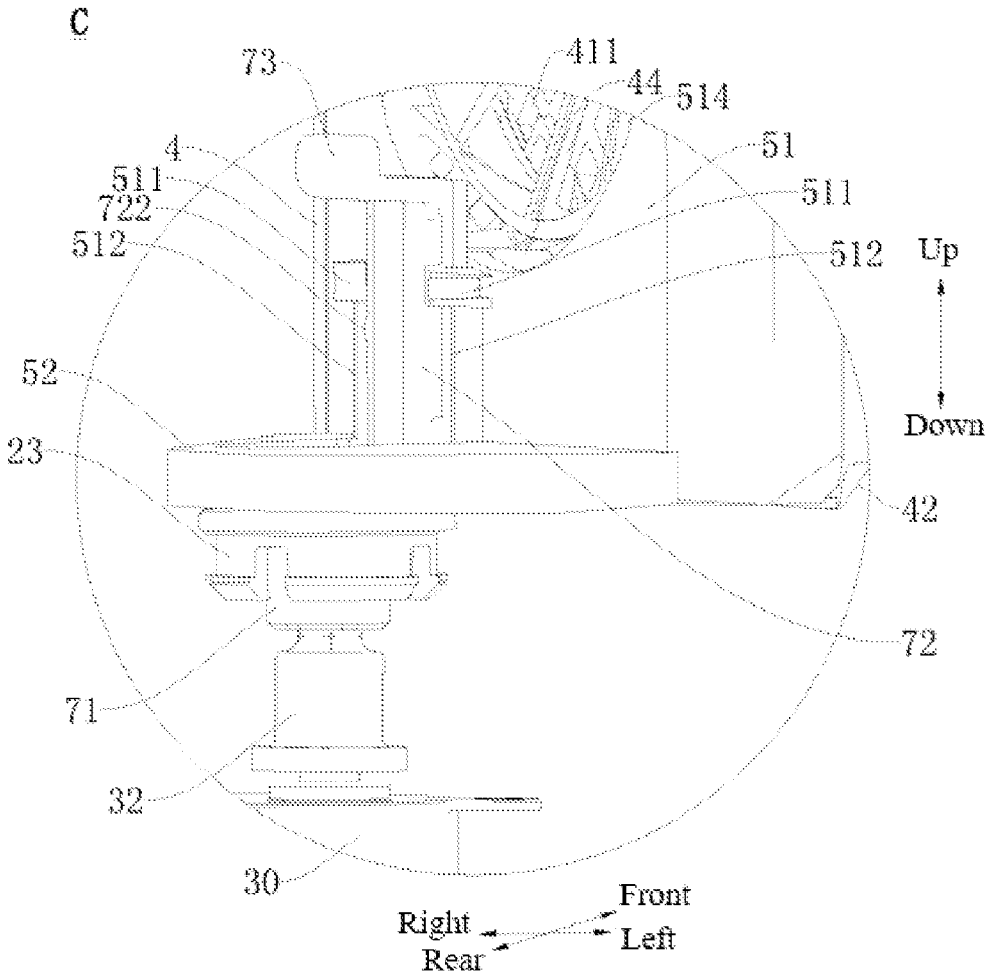
FIG. 11 is an enlarged view at a position C illustrated in FIG. 10.

In some embodiments of the present disclosure, referring to FIG. 10 to FIG. 12, the inner air guide plate 5 may include an inner air guide plate body 51 and a first inner extension 52. The first inner extension 52 may be located at an end of the inner air guide plate body 51 in the first direction. For example, the first inner extension 52 may be connected to a lower side of the inner air guide plate body 51, and the first inner extension 52 is located on a side of the inner air guide plate body 51 facing away from the outer air guide plate 4. An angle is formed between the first inner extension 52 and the inner air guide plate body 51, which may range from 80 to 100°. For example, when an angle between the first inner extension 52 and the inner air guide plate body 51 is 90°, the mounting hole 521 may be formed on the first inner extension 52, and the avoidance port 513 as mentioned above is formed on the inner air guide plate body 51. Therefore, it is convenient for formation of the mounting hole 521 and the avoidance port 513 as well as the mounting of the connector 7. The limit buckle 511 and the limit rib plate 512 that are described above are both formed on the inner air guide plate body 51. The two limit buckles 511 are located on two opposite sides of the avoidance port 513 in the third direction, and the two limit rib plates 512 are also located on two opposite sides of the avoidance port 513 in the third direction.

Referring to FIG. 5 to FIG. 16, an air guide component 40 according to some specific embodiments of the present disclosure will be described below.

In this embodiment, the first direction is an up-down direction, the second direction is a front-rear direction, and the third direction is a left-right direction. The air guide component 40 includes the outer air guide plate 4 and the inner air guide assembly 402 that are described above. The inner air guide assembly 402 includes an inner air guide plate 5, an air diffusion fan blade assembly 61, and a louver mechanism 62. The inner air guide plate 5 may be connected to the outer air guide plate 4. Each of the air diffusion fan blade assembly 61 and the louver mechanism 62 is disposed on the inner air guide plate 5. The inner air guide plate 5 includes the inner air guide plate body 51 and the first inner extension 52 that are described above. The first inner extension 52 is connected to the lower side of the inner air guide plate body 51 and located on the side of the inner air guide plate body 51 facing away from the outer air guide plate 4.

The connector 7 includes the connection member 71 and the positioning member 72 that are described above. The connection member 71 includes the connection post 711 and the first limit stopper 712 that are described above. The shaft hole 7111 is formed in the connection post 711. The positioning member 72 includes the positioning member body 721 and the positioning protrusion 725 that are described above, and a buckle handle 73. The positioning member body 721 is connected to a top of the connection member 71. A bottom of the positioning member body 721 is connected to the first limit stopper 712. The buckle handle 73 is connected to a top of the positioning member body 721. The positioning protrusion 725 is disposed on a front side of the positioning member body 721. An elastic opening 723 is formed on each of two ends of the positioning member body 721. The elastic opening 723 is in an elongated shape and extends along the up-down direction. Each of a left part of the positioning member body 721 located on the left elastic opening 723 and a right part of the positioning member body 721 located on the right elastic opening 723 is formed as an elastic arm 726. A plug protrusion 722 is formed on each elastic arm 726. A reinforcement rib 724 may be further formed on the positioning member body 721 and located between the two elastic openings 723. At least one reinforcement rib 724 is provided. For example, a plurality of reinforcement ribs 724 (e.g., two) may be provided. When the plurality of reinforcement ribs 724 is provided, the plurality of reinforcement ribs 724 is arranged at intervals in the left-right direction. Each of the plurality of reinforcement ribs 724 extends in the up-down direction, and a lower end of each of the plurality of reinforcement ribs 724 extends to the connection member 71 and is connected to the connection member 71.

The mounting structure includes the avoidance port 513, the mounting hole 521, the limit buckle 511, and the limit rib plate 512 that are described above. The mounting hole 521 is formed on the first inner extension 52. An inner peripheral wall of the mounting hole 521 is provided with the second limit stopper 522 as mentioned above. An anti-disengagement structure 44 is disposed on the outer air guide plate 4 and located on a rear side of the outer air guide plate 4 (i.e., a side of the outer air guide plate 4 adjacent to the inner air guide plate 5). The avoidance port 513 is formed at a lower end of the inner air guide plate body 51. The avoidance port 513 penetrates the inner air guide plate body 51 in the front-rear direction and is in communication with the mounting hole 521 located on the first inner extension 52. The limit buckle 511 and the limit rib plate 512 are disposed on the inner air guide plate body 51 and located on a rear side of the inner air guide plate body 51 (i.e., a side of the inner air guide plate body 51 facing away from the outer air guide plate 4). Two limit buckles 511 are provided, which are not only located on the left side and the right side of the positioning part body 721, but also on the left side and the right side of the avoidance port 513, respectively. Two limit rib plates 512 are also provided, which are located not only on the left side and the right side of the positioning member body 721, but also on the left side and the right side of the avoidance port 513. Each of the two limit rib plates 512 is located below a limit buckle 511 on a corresponding side and is connected to the corresponding limit buckle 511.

In some embodiments, the connector 7 may be an integral formed member, which thus simplifies a processing and molding procedure of the connector 7.

In some embodiments, the anti-disengagement structure 44 may be integrally formed with the outer air guide plate 4, and the limit buckle 511 and the limit rib plate 512 may be integrally formed with the inner air guide plate 5.

When the air guide component 40 needs to be mounted in the air outlet channel 21 of the air conditioner, the connector 7 may be pressed downwards to enable the connector 7 to move from the second position to the first position. In this case, the connection member 71 of the connector 7 is fitted into the mounting hole 521, and therefore the connection member 71 is fixed relative to the mounting hole 521, and at the same time, the connector 7 is connected to the air guide drive mechanism 30. Moreover, the connector 7 cooperates with the mounting structure on the inner air guide plate 5, and the connector 7 is mounted and positioned at the first position through the mounting structure. As a result, the air guide component 40 is connected to the air guide drive mechanism 30. In this way, the mounting of the air guide component 40 is achieved, which is convenient and easy to operate.

In the process that the connector 7 moves from the second position to the first position, the plug protrusion 722 on the positioning member body 721 moves downward along with the positioning member body 721 and passes through the limit groove 5111, and the plug protrusion 722 is squeezed. When moving below the limit buckle 511, the plug protrusion 722 is disengaged from the limit groove 5111, and is reset with a sound. Therefore, the operator is prompted that the connector 7 has been inserted into the mounting hole 521 and is mounted in place. Moreover, in this case, since the limit buckle 511 is located on an upper side of the plug protrusion 722, the connector 7 can be further limited in an upward direction to better position the connector 7 at the first position.

When the air guide component 40 needs to be dismounted from the air outlet channel 21 of the air conditioner, the connector 7 may be pulled upwards to enable the connector 7 to move from the first position to the second position. Thus, the connection member 71 of the connector 7 is separated from the air guide drive mechanism 30. In this case, the connection member 71 is at least partially separated from the mounting hole 521. In this way, the separation of the air guide component 40 and the air guide drive mechanism 30 is achieved. As a result, the dismounting of the air guide component 40 is achieved, which is convenient to dismount and easy to operate. In the process that the connector 7 moves from the first position to the second position, the plug protrusion 722 on the positioning member body 721 moves upwards along with the positioning member body 721 and passes through the limit groove 5111, and the plug protrusion 722 is squeezed. When moving above the limit buckle 511, the plug protrusion 722 is disengaged from the limit groove 5111 and is reset with a sound. Therefore, the operator is prompted that the connector 7 has been pulled up in place. Moreover, in this case, since the limit buckle 511 is located on a lower side of the plug protrusion 722, the connector 7 can be limited in a downward direction to prevent the connector 7 from falling off.

According to some embodiments of the present disclosure, referring to FIG. 5 to FIG. 12 and FIG. 24 to FIG. 27, an air diffusion structure 41 configured for airflow to pass through may be formed on the outer air guide plate 4 and may include a plurality of air diffusion holes 411. The air guide assembly 402 further includes an air diffusion fan blade assembly 61 and a louver mechanism 62. The air diffusion fan blade assembly 61 may be disposed on the air guide plate assembly. For example, the air diffusion fan blade assembly 61 may be disposed on the inner air guide plate 5, may also be disposed on the outer air guide plate 4, and may also have a connection relation with both the inner air guide plate 5 and the outer air guide plate 4. At least part of the air diffusion fan blade assembly 61 is located in an accommodation cavity 4011 formed by the outer air guide plate 4 and the inner air guide plate 5. An air flowing hole 514 is formed at a position on the inner air guide plate 5 corresponding to the air diffusion fan blade assembly 61. The louver mechanism 62 is disposed on the side of the inner air guide plate 5 facing away from the outer air guide plate 4 and can adjust an airflow direction. The connection between the inner air guide plate 5 and the outer air guide plate 4 can facilitate formation of the accommodation cavity 4011, and the accommodation cavity 4011 can facilitate accommodating the at least part of the fan blade assembly.

The louver mechanism 62 can synchronously rotate along with the air guide plate assembly. When the air guide component 40 rotates to a position where the air outlet end of the air outlet channel 21 is shielded, the louver mechanism 62 is located on an inner side of the air guide plate assembly. When the air guide component 40 rotates to a position where the air outlet end of the air outlet channel 21 is opened, the louver mechanism 62 is exposed at an air outlet 16 of the air conditioner.

Further, the louver mechanism 62 is rotatably disposed on the air guide plate assembly, i.e., the louver mechanism 62 is rotatable relative to the air guide plate assembly. When the air guide component 40 rotates to the position where the air outlet end of the air outlet channel 21 is opened, a louver 622 can guide the airflow to the air outlet 16. Rotation of the louver 622 can adjust an air outlet direction to meet different requirements of a user. When the air guide component 40 rotates to the position where the air outlet end of the air outlet channel 21 is shielded, the louver 622 guides the airflow to the inner air guide plate 5, and the airflow enters the accommodation cavity 4011 through the air flowing hole 514. Rotation of the louver 622 can adjust an air inlet direction of the airflow entering the accommodation cavity 4011.

When the air guide component 40 is used in the air conditioner, the airflow may sequentially flow through the louver mechanism 62, the air flowing hole 514, and the air diffusion fan blade component 61 for flow diffusion, and then is blown to the outer air guide plate 4, and finally is blown into a room through the air diffusion structure 41 on the outer air guide plate 4. In this way, after the airflow passes through the air guide assembly 401, the blown airflow can be softer and closer to natural wind. In addition, in the process of achieving the air diffusion effect, the airflow enters the accommodation cavity 4011 between the inner air guide plate 5 and the outer air guide plate 4 through a larger air flowing hole 514. Moreover, the air diffusion effect is achieved by means of the air diffusion fan blade assembly 61 and the air diffusion structure 41 on the outer air guide plate 4. Compared with a scheme that an air diffusion holes is formed on each of the inner air guide plate and the outer air guide plate attached to the inner air guide plate, air diffusion resistance can be reduced, and the air diffusion effect is improved.

Therefore, the air conditioner according to the present disclosure has a normal air supply mode and a windless mode. When the air conditioner is in the windless mode, the air guide component 40 rotates to a position where the air outlet end of the air outlet channel 21 is closed. Airflow subjected to heat exchange in the housing 10 is guided by the louver mechanism 62 and then enters into the containment cavity 4011 through the air holes 514. The air diffusion fan blade assembly 61 can diffuse the airflow in the containment cavity 4011. The diffused airflow may flow out of the air diffusion structure 41. The air diffusion structure 41 can further diffuse the airflow, and therefore the airflow of the air conditioner is uniform and comfortable. Thus, a windless feeling is realized. When the air conditioner is in the normal air supply mode, the air guide member 40 rotates to a position that opens the air outlet end of the air outlet channel 21. In this case, there is larger air volume, which can realize rapid refrigeration or heating.

The inner air guide plate 5 is detachably connected to the outer air guide plate 4, which facilitates a fitting of the air guide component 40 and the cleaning and maintenance of the air guide component 40.

For example, during the fitting of the air guide component 40, the air diffusion fan blade component 61 may be first fitted on the inner air guide plate 5 and/or the outer air guide plate 4, and then the inner air guide plate 5 and the outer air guide plate 4 are connected together. Finally, the louver mechanism 62 is fitted on the inner air guide plate 5. Therefore, the inner air guide plate 5 is detachably connected to the outer air guide plate 4, which can facilitate the fitting of the air guide component 40 and thus saves fitting time of the operator.

For another example, when in use, the user can detach the inner air guide plate 5 from the outer air guide plate 4 and therefore take out air diffusion fan blade assembly 61. As a result, it is convenient for the user to clean at least one of the inner air guide plate 5, the outer air guide plate 4, the air diffusion fan blade assembly 61, or the louver mechanism 62. After the cleaning is completed, it is also convenient for the user to fit the inner air guide plate 5, the outer air guide plate 4, the air diffusion fan blade assembly 61, and the louver mechanism 62 together.

In some embodiments of the present disclosure, referring to FIG. 5 to FIG. 12 and FIG. 24 to FIG. 27, the air diffusion blade assembly 61 may be disposed on the inner air guide plate 5 and may include a rotor 611 capable of rotating. A plurality of rotors 611 is arranged at intervals rows in the first direction (e.g., the up-down direction) and located in the accommodation cavity 4011 between the outer air guide plate 4 and the inner air guide plate 5. The air flowing hole 514 is formed at a position on the inner air guide plate 5 opposite to the rotor 611. The air flowing holes 514 and the rotors 611 are in equal quantity and have one-to-one correspondence. When the air guide component 40 is used in the air conditioner, the airflow can pass through the air flowing hole 514 under the guide of the louver mechanism 62 and then flow through a plurality of rotors 611. The plurality of rotors 611 capable of rotating can allow the airflow to form a swirling flow, and the airflow is blown to the outer air guide plate 4 and finally blown into the room through the air diffusion structure 41 on the outer air guide plate 4. In this way, after the airflow passes through the air guide assembly 401, the blown airflow can be softer and closer to the natural wind.

In some embodiments of the present disclosure, referring to FIG. 5 to FIG. 12 and FIG. 24 to FIG. 27, the air diffusion fan blade assembly 61 may be disposed on the inner air guide plate 5 and may include a stator 612 fixed relative to the inner air guide plate 5. The air flowing hole 514 may be formed on the inner air guide plate 5, and the stator 612 may be disposed in the air flowing hole 514. The air flowing holes 514 and the stators 612 are in equal quantity and have one-to-one correspondence. The stator 612 is disposed in each air flowing hole 514. When the air guide component 40 is used in the air conditioner, the airflow can pass through the air flowing hole 514 under the guide of the louver mechanism 62 and flow through the plurality of stators 612 to be diffused. Then, the airflow flows through the plurality of stators 612. The plurality of rotary stators 612 can allow the airflow to form the swirling flow, and the airflow is blown to the outer air guide plate 4 and finally blown into the room through the air diffusion structure 41 on the outer air guide plate 4. In this way, after the airflow passes through the air guide assembly 401, the blown airflow can be softer and closer to the natural wind.

In some embodiments of the present disclosure, referring to FIG. 5 to FIG. 12 and FIG. 24 to FIG. 27, the air diffusion fan blade assembly 61 may be disposed on the inner air guide plate 5, and may include a rotor 611 capable of rotating and a stator 612 fixed relative to the inner air guide plate 5. A plurality of rotors 611 is arranged at intervals rows in the first direction (e.g., the up-down direction) and located in the accommodation cavity 4011 between the outer air guide plate 4 and the inner air guide plate 5. The air flowing hole 514 is formed at a position on the inner air guide plate 5 opposite to the rotor 611. The air flowing holes 514 and the rotors 611 are in equal quantity and have one-to-one correspondence. The stator 612 may be disposed in each of the air flowing holes 514. When the air guide component 40 is used in the air conditioner, the airflow can pass through the air flowing hole 514 under the guide of the louver mechanism 62 and flow through the plurality of stators 612 to be diffused, and then flow through a plurality of rotors 611. The plurality of rotors 611 capable of rotating can allow the airflow to form a swirling flow, and the airflow is blown to the outer air guide plate 4 and finally blown into the room through the air diffusion structure 41 on the outer air guide plate 4. In this way, after the airflow passes through the air guide assembly 401, the blown airflow can be softer and closer to the natural wind.

For example, in some specific embodiments of the present disclosure, referring to FIG. 5 to FIG. 12 and FIG. 24 to FIG. 27, the air guide assembly 401 includes an outer air guide plate 4 and an inner air guide assembly 402. The inner air guide assembly 402 includes an inner air guide plate 5, an air diffusion fan blade assembly 61, and a louver mechanism 62. The inner air guide plate 5 may be detachably connected to the outer air guide plate 4. Both the air diffusion fan blade assembly 61 and the louver mechanism 62 are disposed on the inner air guide plate 5. The fan blade assembly 61 may include a stator 612 and a rotary rotor 611. A plurality of rotors 611 is arranged at intervals in an up-down direction and located in the accommodation cavity 4011 between the outer air guide plate 4 and the inner air guide plate 5. An air flowing hole 514 is formed at a position of the inner air guide plate 5 opposite to the rotor 611. The air flowing holes 514 and the rotors 611 are in equal number and have one-to-one correspondence. The stator 612 is disposed in each air flowing hole 514 and fixed relative to the inner air guide plate 5. The louver mechanism 62 is disposed on a side of the inner air guide plate 5 facing away from the outer air guide plate 4. The louver mechanism 62 includes a connection rod 621 and a plurality of louvers 622. The connection rod 621 extends in the up-down direction and is movable in the up-down direction. The plurality of louvers 622 are arranged at intervals in the up-down direction. Each of the plurality of louvers 622, the connection rod 621, and the inner air guide plate 5 are rotatably connected. The louvers 622 and the air flowing holes 514 are in equal quantity and have one-to-one correspondence.

In this embodiment, the stator 612 disposed in each air flowing hole 514 includes a stator hub 6121 and a plurality of stator hubs 6122. The plurality of stator hubs 6122 is arranged at intervals in a circumferential direction of the stator hub 6121. An end of each of the plurality of stator hubs 6122 is connected to an outer peripheral wall of the stator hub 6121, and another end of each of the plurality of stator hubs 6122 is connected to an inner peripheral wall of the air flowing hole 514. Each rotor 611 includes a rotor rotation shaft 6111 and a plurality of rotor blades 6113. The plurality of rotor blades 6113 are arranged in a circumferential direction of the rotor rotation shaft 6111. Further, each rotor 611 may further include a support ring 6112. The support ring 6112 may be annularly disposed on an outer peripheral side of the rotor rotation shaft 6111, and the rotor 6113 may be connected to the support ring 6112 to increase a structural strength of the rotor 611. In some embodiments, a plurality of supporting rings 6112 may be provided and spaced apart from each other in a radial direction. A plurality of groups of rotor blades 6113 may be provided. Each of the plurality of groups of rotor blades 6113 has a plurality of rotor blades 6113 disposed between two adjacent supporting rings 6112, and two ends of each rotor blade 6113 are connected to two adjacent supporting rings 6112, respectively. Each louver 622 has a louver rotation shaft 6221. The louver rotation shaft 6221 of each louver 622 is connected to and fixed relative to the rotor rotation shaft 6111 of a corresponding rotor 611. The rotor rotation shaft 6111 of each rotor 611 is rotatably fitted into a corresponding stator hub 6121. Since the rotor rotation shaft 6111 of each rotor 611 is connected to the louver rotation shaft 6221, the corresponding rotor 611 can be synchronously driven to rotate when the louver rotates.

A louver drive mechanism 50 configured to drive the louver mechanism 62 to move may be disposed above the louver mechanism 62, and may include a louver drive motor, a drive gear, and a drive rack. The drive gear is fixedly connected to a motor shaft of the louver drive motor and engaged with the drive rack, and the drive rack is connected to the connection rod 621. During operation of the louver drive motor, the drive gear is driven to rotate. Since the drive gear is engaged with the drive rack, the drive rack can be driven to move in the up-down direction, and then the connection rod 621 is driven to move in the up-down direction. Further, the plurality of louvers 622 are driven to swing. In this way, the plurality of louvers 622 can swing to a set direction or swing back and forth.

Further, the air guide component 40 may further include a slide assembly 53 disposed at an upper end of the air guide component 401. The slide assembly 53 includes a mounting block, a slider, and a slide cover. The mounting block may be detachably mounted on the inner air guide plate 5. For example, a notch is formed in the lower end of the inner air guide plate 5, and the mounting block is engaged with the notch and fixed relative to the inner air guide plate 5. A slide groove extending in the up-down direction is formed in the mounting block, and the slider is slidably engaged with the slide groove in the up-down direction. The connection rod 621 is connected to the slider, and the drive rack as mentioned above is also connected to the slider. The slide cover can cover a side of the slider connected to the connection rod 621. During the operation of the louver drive motor, the drive gear is driven to rotate. Since the drive gear is engaged with the drive rack, the drive rack is driven to move in the up-down direction, and then the slider can be driven to move in the up-down direction. The slider slides along the slide groove when moving, and therefore the slider can move stably in the up-down direction, and then the connection rod 621 can be driven to move stably in the up-down direction. Further, the plurality of louvers 622 is driven to swing. In this way, the plurality of louvers 622 can swing to the set direction or swing back and forth.

When the air outlet end of the air outlet channel 21 is opened by means of the air guide component 40, the plurality of louvers 622 are exposed at the air outlet 16 and can guide the airflow out of the air outlet 16. The connection rod 621 can be driven to move up-down by driving the louver mechanism 62, and therefore the plurality of louvers 622 can be driven to swing. When the air outlet end of the air outlet channel 21 is shielded by the air guide component 40, the plurality of louvers 622 is located on the inner side of the air guide plate assembly. The plurality of louvers 622 can guide the airflow to the inner air guide plate 5. The airflow passes through the air flowing hole 514 to be preliminarily diffused by the stator 612 and then enters the accommodation cavity 4011. The rotor 611 located in the accommodation cavity 4011 can be driven to rotate through swinging of the louver 622. The rotating rotor 611 can allow the airflow to form the swirling flow and further scatter the airflow. The scattered airflow can flow out of the accommodation cavity 4011 through the plurality of air diffusion holes 411 on the outer air guide plate 4. In this way, the uniform and comfortable air is provided by the air conditioner.

In addition, the plurality of rotors 611 and the stators 612 are arranged in one-to-one correspondence with the plurality of air flowing holes 514, and therefore the airflow entering each air flowing hole 514 can be conveniently scattered. Thus, volume of soft air of the air conditioner can be increased. As a result, the air conditioner can perform better in the refrigeration or the heating.

The plurality of stators 612 may be integrally formed with the inner air guide plate 5. During the fitting of the air guide member 40, the plurality of rotors 611 may be first fitted on the inner air guide plate 5, and then the inner air guide plate 5 and the outer air guide plate 4 are connected together, and finally the louver mechanism 62 is fitted on the inner air guide plate 5. The inner air guide plate 5 is detachably connected to the outer air guide plate 4, which facilitates the fitting of the air guide component 40. On the one hand, it is easy to implement in manufacturing, and therefore the fitting time of the operator can be saved. On the other hand, when in use, the user can detach the inner air guide plate 5 and the outer air guide plate 4 and then take out the plurality of rotors 611. In this way, an internal structure of the air guide component 40 can be conveniently cleaned.

According to some embodiments of the present disclosure, referring to FIG. 24 to FIG. 32, the inner air guide plate 5 and the outer air guide plate 4 are snapped with each other through a buckle assembly. Therefore, it is convenient for the inner air guide plate 5 to be detachably connected to the outer air guide plate 4 through the buckle assembly.

In some embodiments of the present disclosure, referring to FIG. 24 to FIG. 32, each of two side edges of the outer air guide plate 4 in a width direction is snapped with a corresponding side edge of the inner air guide plate 5 through the buckle assembly. Therefore, the two side edges of the outer air guide plate 4 in the width direction are fixed to the corresponding side edges of the inner air guide plate 5. During the use of the air guide component 40, integrity is good. That is, during the use of the air guide component 40, the two side edges of the inner air guide plate 5 and the outer air guide plate 4 are prone to curling and deformation. Moreover, the buckle assembly is disposed on each of the two side edges of the inner air guide plate 5 and the outer air guide plate 4, which can facilitate the fitting operation and thus reduce a mounting difficulty of the inner air guide plate 5 and the outer air guide plate 4.

According to some embodiments of the present disclosure, the buckle assembly includes an outer plate snap member disposed on the outer air guide plate 4 and an inner plate snap member disposed on the inner air guide plate 5. The outer plate snap member is snapped and engaged with the inner plate snap member in a length direction of the outer air guide plate 4. The length direction herein may be the up-down direction as illustrated in FIG. 24 to FIG. 30. Therefore, the inner air guide plate 5 and the outer air guide plate 4 can be connected in the length direction through the outer plate snap member and the inner plate snap member. Thus, a probability of curling or deformation of the two ends of the inner air guide plate 5 and the outer air guide plate 4 in the length direction can be reduced. As a result, the air guide plate assembly exhibits better integrity. Moreover, the outer plate snap member and the inner plate snap member are snapped with each other along the length direction of the outer air guide plate 4, and therefore the connection strength between the inner air guide plate 5 and the outer air guide plate 4 is better.

In some specific examples, referring to FIG. 24 to FIG. 32, two ends of the air guide plate assembly along a length of the air guide plate are a first end 403 and a second end 404, respectively, and two sides of the air guide plate assembly along a width direction of the air guide plate are a first side 405 and a second side 406, respectively. It should be noted that the length direction of the air guide plate assembly (e.g., referring to the up-down direction in the accompanying drawings) is the same as the length direction of the outer air guide plate 4, and the width direction of the air guide plate assembly (e.g., referring to the left-right direction in the accompanying drawings) is the same as the width direction of the outer air guide plate 4. The outer plate snap member includes at least one first snap block 451 disposed at the first side 405, and the inner plate snap member includes at least one first snap groove 515 formed at a corresponding side of the inner air guide plate 5 (i.e., the first side 405). The first snap groove 514 having an open end close to the first end 403 in a length direction of the air guide plate assembly and a closed end. The outer plate snap member includes at least one second snap groove 452 formed at the second side 406, and the inner plate snap member includes at least one second snap block 516 disposed at a corresponding side of the inner air guide plate 5 (i.e., the second side 406). The second snap groove 452 having an open end close to the second end 404 in the length direction of the air guide plate assembly and a closed end.

When the outer air guide plate 4 moves relative to the inner air guide plate 5 in a direction from the first end 403 to the second end 404, the first snap block 451 is snapped into the first snap groove 515 from the open end of the first snap groove 515, and the second snap groove 452 is sleeved into the second snap block 516 from the open end of the second snap groove 452. Therefore, the first snap block 451 and the first snap groove 515 are reliably fitted together, and the second snap block 516 and the second snap groove 452 are reliably installed together. The inner air guide plate 5 can be reliably connected to the first side 405 of the outer air guide plate 4 through the first snap block 451 and the first snap groove 515, and the inner air guide plate 5 can be reliably connected to the second side 406 of the outer air guide plate 4 through the second snap block 516 and the second snap groove 452. Due to the two pairs of connection structures of the first snap block 451 and the first snap groove 515 as well as the second snap block 516 and the second snap groove 452, each of the two sides of the inner air guide plate 5 and the outer air guide plate 4 in the width direction can be connected, allowing for a more reliable connection between the inner air guide plate 5 and the outer air guide plate 4.

In addition, when it is needed to dismount the inner air guide plate 5 and the outer air guide plate 4, the outer air guide plate 4 can move away from the inner air guide plate 5 in a direction from the second end 404 to the first end 403. The first snap block 451 slides, in the first snap groove 515, to the open end of the first snap groove 515, and may be detached from the open end of the first snap groove 515. The second snap block 516 slides, in the second snap groove 452, to the open end of the second snap groove 452, and may be detached from the open end of the second snap groove 452. Therefore, through the engagement between the two snap blocks and the two snap grooves, mounting and detachment between the inner air guide plate 5 and the outer air guide plate 4 can be facilitated while enhancing connection reliability.

Further, the at least one first snap block 451 includes a plurality of first snap blocks 451 arranged at intervals in the length direction of the air guide plate assembly, and the at least one first snap groove 515 includes a plurality of first snap grooves 515 arranged at intervals in the length direction of the air guide plate assembly. Each of the plurality of first snap blocks is snapped into the corresponding one of the plurality of first snap grooves. The at least one second snap block 516 includes a plurality of second snap blocks 516 arranged at intervals in the length direction of the air guide plate assembly, and the at least one second snap groove 452 includes a plurality of second snap grooves 452 arranged at intervals in the length direction of the air guide plate assembly. Each of the plurality of second snap blocks 516 is snapped into the corresponding one of the plurality of second snap grooves 452. It can be understood that the inner air guide plate 5 can be connected to the first side 405 of the outer air guide plate 4 in the length direction through the first snap block 451 and the first snap groove 515, and the inner air guide plate 5 can be connected to the second side 406 of the outer air guide plate 4 in the length direction through the second snap block 516 in the second snap grooves 452. Moreover, the outer plate snap member is snapped and engaged with the inner plate snap member along the length direction of the outer air guide plate 4, and therefore the connection strength between the inner air guide plate 5 and the outer air guide plate 4 is better.

In some embodiments of the present disclosure, referring to FIG. 24 to FIG. 32, the first snap groove 515 has an open end close to the first side 405 in the width direction of the air guide plate assembly. The outer air guide plate 4 on the first side 405 is provided with at least one first limit buckle 453. A corresponding side of the inner air guide plate 5 (i.e., on the first side 405) is further provided with a first limit rib 517. The first limit rib 517 is located on a side of the first snap groove 515 facing away from the first side 405. The first limit buckle 453 is limited on a side of the first limit rib 517 facing away from the first snap groove 515. Therefore, the outer air guide plate 4 cannot move relative to the inner air guide plate 5 from the second side 406 to the first side 405. Thus, the first snap block 451 is prevented from being detached from the first snap groove 515, which further enhances the reliability of the connection between the inner air guide plate 5 and the outer air guide plate 4. In addition, since the first snap groove 515 has an open end facing away from the second side 406 in the width direction of the air guide plate assembly, the first snap groove 515 can be easily fitted with the first snap block 451. In this way, both machining precision and the fitting difficulty are reduced.

Further, when the first snap groove 515 has a closed end close to the second side 406 in the width direction of the air guide plate assembly, the first snap block 451 can be limited. When the first snap groove 515 has an open end facing away from the second side 406 in the width direction of the air guide plate assembly, the first snap groove 515 can be easily fitted with the first snap block 451. In this way, both the machining precision and the fitting difficulty are reduced. However, since the end of the first snap groove 515 facing away from the second side 406 in the width direction of the air guide plate assembly is open, the first snap block 451 may be disengaged from the open side of the first snap groove 515, causing instability in mounting of the air guide plate 5 and the outer air guide plate 4. To this end, the first limit buckle 453 is limited on the side of the first limit rib 517 facing away from the first snap groove 515. Therefore, the first limit rib 517 is limited on a side of the first limit buckle 453 facing away from the first snap groove 515. Thus, the outer air guide plate 4 cannot move relative to the inner air guide plate 5 from the second side 406 to the first side 405. As a result, the first snap block 451 cannot be disengaged from the first snap groove 515, which further enhances the reliability of the connection between the inner air guide plate 5 and the outer air guide plate 4.

Further, the at least one first limit buckle 453 includes the plurality of first limit buckles 453 arranged intervals in the length direction of the air guide plate assembly; and the first limit rib 517 extends in the length direction of the air guide plate assembly. Therefore, more positions of the inner air guide plate 5 and the outer air guide plate 4 are limited in the length direction. Thus, effectiveness of position limiting can be enhanced.

In some embodiments of the present disclosure, the second snap groove 452 has an open end close to the second side 406 in a width direction of the air guide plate assembly. The outer air guide plate 4 is provided with a second limit rib 454 on the second side 406, and the second limit rib 454 is located at a side of the second snap groove 452 facing away from the second side 406. A corresponding side of the inner air guide plate 5 (i.e., on the second side 406) is provided with at least one second limit buckle 518, and the second limit buckle 518 is limited at a side of the second limit rib 454 facing away from the second snap groove 452. Therefore, the outer air guide plate 4 cannot move relative to the inner air guide plate 5 from the first side 405 to the second side 406. Thus, the second snap block 516 cannot be disengaged from the second snap groove 452, which further enhances the reliability of the connection of the inner air guide plate 5 and the outer air guide plate 4. In addition, since the end of the second snap groove 452 facing away from the first side 405 in the width direction of the air guide plate assembly is open, the second snap groove 452 can be easily fitted with the second snap block 516. In this way, both the machining precision and the fitting difficulty are reduced.

Further, when the second snap groove 452 has a closed end close to the first side 405 in the width direction of the air guide plate assembly, the second snap block 516 can be limited. When the second snap groove 452 has an open end facing away from the first side 405 in the width direction of the air guide plate assembly, the second snap groove 452 can be easily fitted with the second snap block 516. In this way, both the machining precision and the fitting difficulty are reduced. However, since the end of the second snap groove 452 facing away from the first side 405 in the width direction of the air guide plate assembly is open, the second snap block 516 may be disengaged from the open side of the second snap groove 452, causing the instability in the mounting of the air guide plate 5 and the outer air guide plate 5. To this end, the second limit buckle 518 is limited on the side of the second limit rib 454 facing away from the second snap groove 452. Therefore, the second limit rib 454 is limited on a side of the second limit buckle 518 close to the second snap groove 452. Thus, the outer air guide plate 4 cannot move relative to the inner air guide plate 5 from the first side 405 to the second side 406. As a result, the second snap block 516 cannot be disengaged from the second snap groove 452, which further enhances the reliability of the connection between the inner air guide plate 5 and the outer air guide plate 4.

Further, the second limit rib 454 extends along the length direction of the air guide plate assembly; and the at least one second limit buckle 518 includes a plurality of second limit buckles 518 arranged at intervals along the length direction of the air guide plate assembly. Therefore, more positions of the inner air guide plate 5 and the outer air guide plate 4 are limited in the length direction. Thus, the effectiveness of position limiting can be enhanced.

In some embodiments of the present disclosure, referring to FIG. 24 to FIG. 32, the outer air guide plate 4 is fixedly connected to the inner air guide plate 5 through a threaded fastener assembly. Therefore, the connection strength of the inner air guide plate 5 and the outer air guide plate 4 can be enhanced. Thus, the inner air guide plate 5 cannot be easily disengaged from the outer air guide plate 4. In addition, through the connection of the threaded fastening assembly, it is convenient for the inner air guide plate 5 and the outer air guide plate 4 to be fitted together and detached from each other.

Further, the threaded fastening assembly includes a first threaded fastener 55, and an end of the outer air guide plate 4 in a length direction of the outer air guide plate 4 is fixedly connected to the inner air guide plate 5 through the first threaded fastener 55. The end of the outer air guide plate 4 in the length direction of the outer air guide plate 4 and the inner air guide plate 5 can be reliably connected together through the first threaded fastener 55. Moreover, the first threaded fastener 55 can also limit, in the length direction, relative displacement of the inner air guide plate 5 to the outer air guide plate 4, and therefore the outer air guide plate 4 cannot slide off from the inner air guide plate 5. Thus, the reliability of the air guide plate assembly is guaranteed.

Further, the outer air guide plate 4 includes an outer air guide plate body 4*a* and an outer extension 4*b* located at an end of the outer air guide plate body 4*a* in the length direction of the outer air guide plate body 4*a*. For example, the outer extension 4*b* may be connected to an upper end of the outer air guide plate body 4*a*. An end of the outer extension 4*b* is connected to a top of the outer air guide plate body 4*a*, and another end of the outer extension 4*b* extends inwards (which refers to a direction adjacent to the center of the housing 10). The inner air guide plate 5 includes an inner air guide plate body 51 and a second inner extension 52*a* located at an end in a length direction of the inner air guide plate body 51. For example, the second inner extension 52*a* may be connected to an upper end of the inner air guide plate body 51. An end of the second inner extension 52*a* is connected to a top of the inner air guide plate body 51, and another end of the second inner extension 52*a* extends inwards (which refers to the direction adjacent to the center of the housing 10). During the fitting of the outer air guide plate 4 and the inner air guide plate 5, the outer air guide plate body 4*a* and the inner air guide plate body 51 may be stacked in the front-rear direction, the outer extension 4*b* and the second inner extension 52*a* are stacked in the up-down direction, and the outer extension 4*b* covers an upper side of the second inner extension 52*a*. The first threaded fastener 55 is a first screw, and the first screw passes through the first screw hole 46 on the outer extension 4*b* and then is threadedly connected to a first screw post 521*a* on the inner air guide plate 5. The outer extension part 4*b* can provide a mounting environment for the first screw, facilitating setting of the first screw. Through the outer extension 4*b*, it is convenient to connect the outer air guide plate 4 to the inner air guide plate 5.

Further, the outer extension 4*b* is provided with a first positioning structure 455, and the second inner extension 52*a* is provided with a second positioning structure 519 at a side of the second inner extension 52*a* facing towards the outer extension 4*b* has. The first positioning structure 455 and the second positioning structure 519 are engaged with each other in an insertable manner in the length direction of the outer air guide plate 4. Therefore, during the fitting of the inner air guide plate 5 and the outer air guide plate 4, when the outer air guide plate 4 moves towards and the inner air guide plate 5 from the first end 403 to the second end 404, the first positioning structure 455 and the second positioning structure 519 can be easily engaged with each other in the insertable manner. Thus, the inner air guide plate 5 and the outer air guide plate 4 can be positioned with each other, facilitating the fitting of the inner air guide plate 5 and the outer air guide plate 4. In some embodiments, the first positioning structure 455 may be a positioning hole, and the second positioning structure 519 may be a positioning post extending towards the outer extension 4*b*. The positioning post is inserted into the positioning hole along the length direction of the outer air guide plate 4.

In some embodiments of the present disclosure, referring to FIG. 24 to FIG. 32, the threaded fastener assembly includes a second threaded fastener 56. The outer air guide plate body 4*a* is fixedly connected to the inner air guide plate body 51 through the second threaded fastener 56. Thus, the connection strength of the inner air guide plate 5 and the outer air guide plate 4 can be further enhanced through the second threaded fastener 56.

Further, the inner air guide plate body 51 has a second screw hole 510 penetrating two side surfaces of the inner air guide plate body 51 in a thickness direction of the inner air guide plate body 51. The inner side of the outer air guide plate body 4*a* is provided with a second screw post 456. The second threaded fastener 56 is a second screw. The second screw passes through the second screw hole 510 and then is threadedly connected to the second screw post 456. The second screw post 456 can be conveniently connected to the second screw, and therefore the outer air guide plate body 4*a* is conveniently connected to the inner air guide plate body 51. Further, the second screw post 456 may be formed as a solid post. A threaded hole is formed on the solid post, and the second screw may be connected to the threaded hole. The solid post can enhance the connection strength of the second screw and the second screw column 456, and therefore the inner air guide plate 5 and the outer air guide plate 4 are connected more stably and cannot shake.

In some embodiments of the present disclosure, one inner air guide plate 5 is provided and has a length equal to a length of the outer air guide plate 4; or a plurality of inner air guide plates 5 are sequentially arranged in the length direction of the outer air guide plate 4, and a total size of the plurality of inner air guide plates 5 in the length direction of the outer air guide plate 4 is equal to the length of the outer air guide plate 4. Therefore, the air guide plate assembly exhibits better integrity. In addition, since the total size of the plurality of inner air guide plates 5 in the length direction of the outer air guide plate 4 is equal to the length of the outer air guide plate 4, arrangement of the air flowing hole 514 is facilitated to enable more air flowing holes 514 to be arranged on the inner air guide plate 5. Thus, more airflow may flow into the accommodation cavity 4011 through the plurality of air flowing holes 514. At the same time, each of the plurality of air holes 514 may correspond to the air diffusion hole 411. Therefore, more airflow may be blown out from the air diffusion hole 411. As a result, the air outlet volume of the air conditioner is increased.

The air guide component 40 according to the embodiments of the present disclosure will be described below with reference to FIG. 5 to FIG. 12 and FIG. 15 to FIG. 22. The air guide component 40 has a flow guide surface 42.

Referring to FIG. 17 to FIG. 21, the air guide component 40 may be rotatably disposed on the air outlet channel 21 of the air conditioner. The air guide component 40 can adjust the airflow through the rotation of the air guide component 40, for example, the airflow direction can be adjusted. A water receiving member 22 is formed at a bottom of the air outlet channel 21 and fixed relative to the air outlet channel 21. The water receiving member 22 may be an individual molded member and is mounted on a bottom surface of the air outlet channel 21 after processed into molding. The water receiving member 22 may also be formed by an inner bottom wall of the air outlet channel 21 and an inner peripheral wall of the air outlet channel 21. For example, when the air conditioner includes an air outlet frame 20 and the air outlet channel 21 is formed on the air outlet frame 20, the water receiving member 22 may be integrally formed with the air outlet frame 20. The water receiving member 22 is located on a bottom surface of the air guide component 40. The air guide component 40 is rotatable relative to the water receiving member 22. A water receiver cavity 221 may be formed in the water receiving member 22. The water receiving member 22 can receive condensate water on the air guide component 40, and the condensate water on the air guide component 40 may flow downward into the water receiver cavity 221 of the water receiving member 22.

During refrigeration of the air conditioner, the condensate water generated on the air guide component 40 flows downwards along the air guide component 40 into the water receiver cavity 221 of the water receiving member 22. Since the water receiving member 22 can receive the condensate water generated on the air guide component 40, the condensate water generated on the air guide component 40 can be effectively prevented from dripping onto a ground or other components in the air conditioner (for example, dropping into components like an electric control box and an electric motor in the air conditioner, which may easily cause a safety hazard). In this way, inconvenience for the user caused by the condensate water dripping onto the ground can be effectively avoided. Moreover, the safety hazard is reduced.

A part of the outer wall surface of the air guide component 40 adjacent to the water receiving member 22 may be formed as the flow guide surface 42. The flow guide surface 42 may extend to the bottom surface of the air guide component 40 and is configured to guide condensate water on the air guide component 40 into the water receiver cavity 221. The condensate water on the air guide component 40 flows downwards along the outer wall surface of the air guide component 40 to the flow guide surface 42 at the bottom of the air guide component 40, and the condensate water can be quickly and effectively guided into the water receiver cavity 221 of the water receiving part 22 under the guidance of the flow guide surface 42. Therefore, the condensate water on the outer wall surface of the air guide component 40 can be prevented from dripping onto the ground. It should be noted that the "outer wall surface of the air guide component 40" is an wall surface of the air guide component 40 facing outwards the position of the air guide component 40 at which the air outlet end of the air outlet channel 21 is closed.

In some embodiments, the air guide component 40 may be an air guide plate and may also include the air guide plate and other air guide structures.

In the air guide component 40 according to the embodiments of the present disclosure, since the water receiving member 22 is disposed at the bottom of the air outlet channel 21, and the water receiving member 22 is located on the bottom surface of the air guide component 40, the condensate water generated on the air guide component 40 may be received. In addition, since the part of the outer wall surface of the air guide component 40 adjacent to the water receiving member 22 is formed as the flow guide surface 42, the condensate water generated on the air guide component 40 is guided into the water receiver cavity 221 of the water receiving member 22 under the guidance of the flow guide surface 42. In this way, the condensate water on the air guide component 40 is effectively prevented from dripping onto the ground and on the other components in the air conditioner. Therefore, the inconvenience for the user caused by the condensate water dropping onto the ground can be effectively avoided. Moreover, the safety hazard is reduced.

Figure 8:
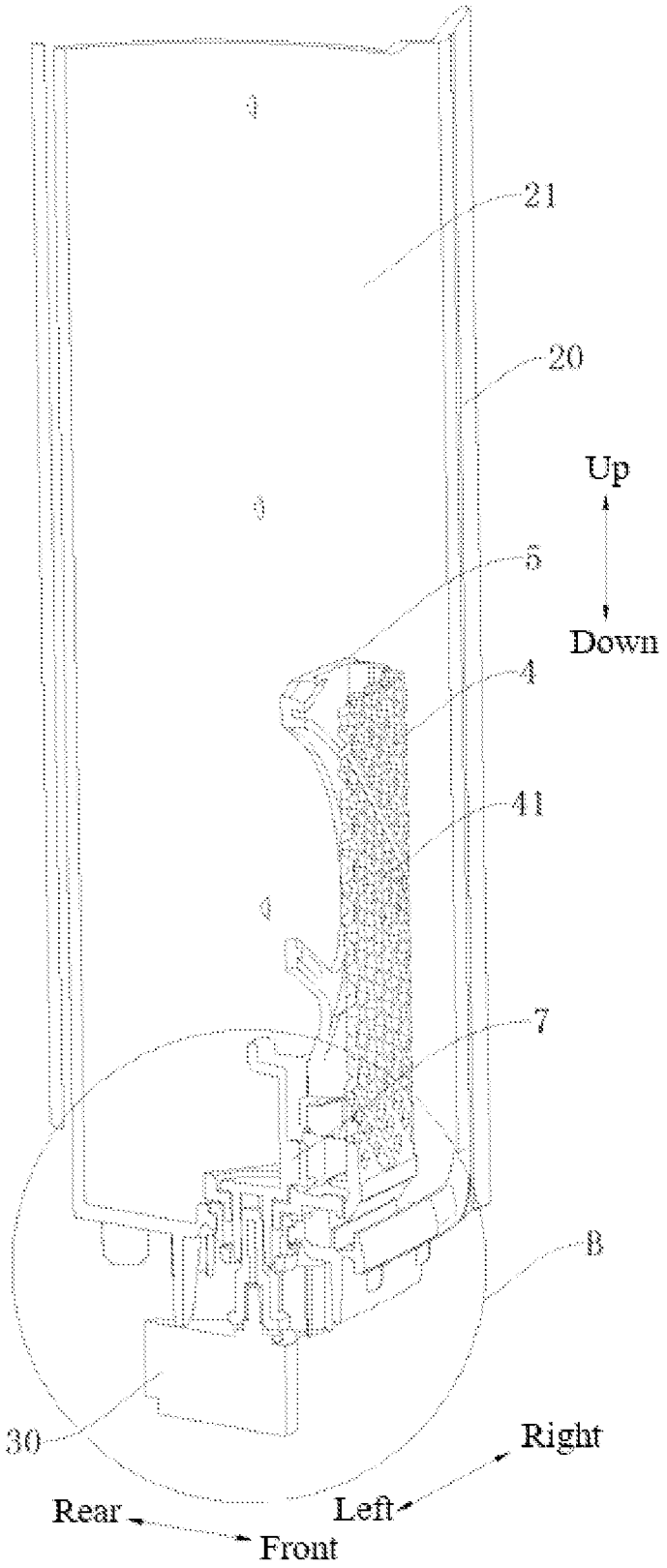
FIG. 8 is a partial structural diagram of an air outlet frame assembly according to some embodiments of the present disclosure.
Figure 9:
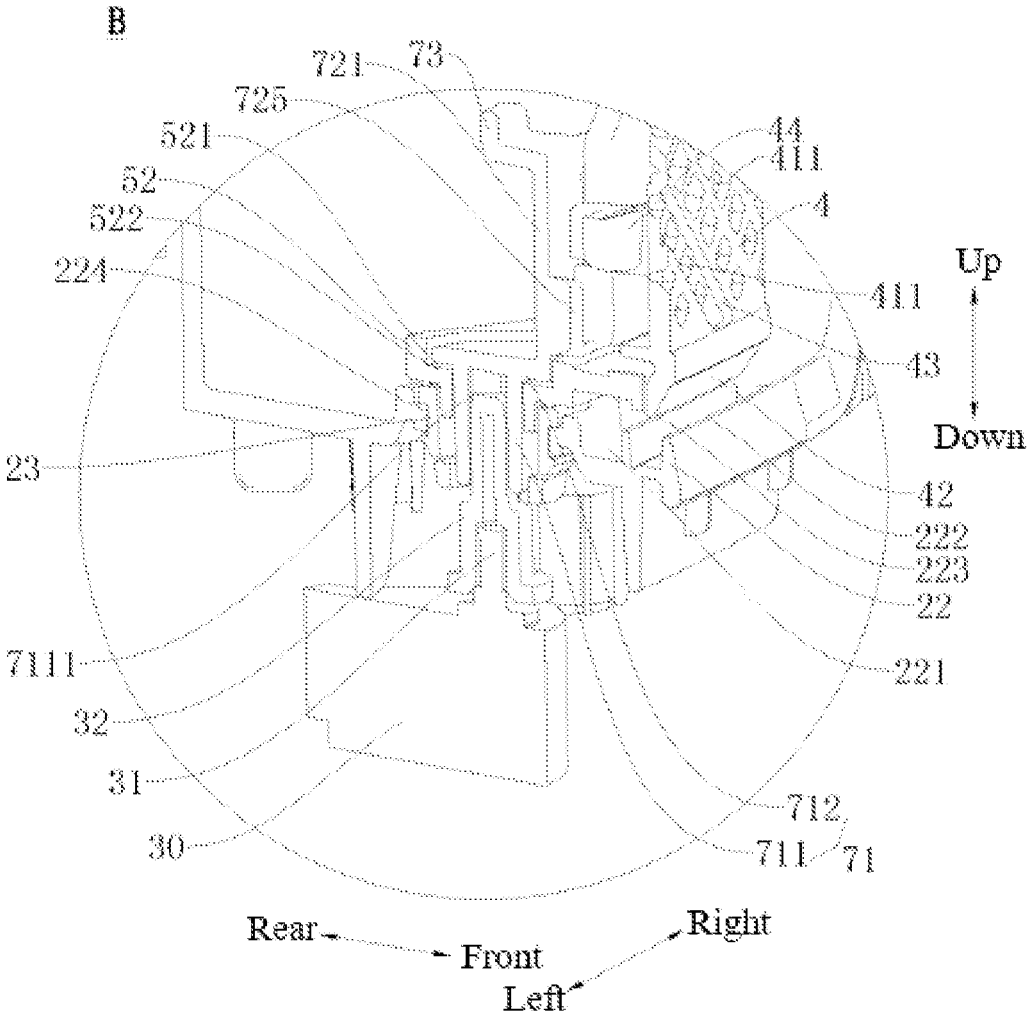
FIG. 9 is an enlarged view at a position B illustrated in FIG. 8.
Figure 18:
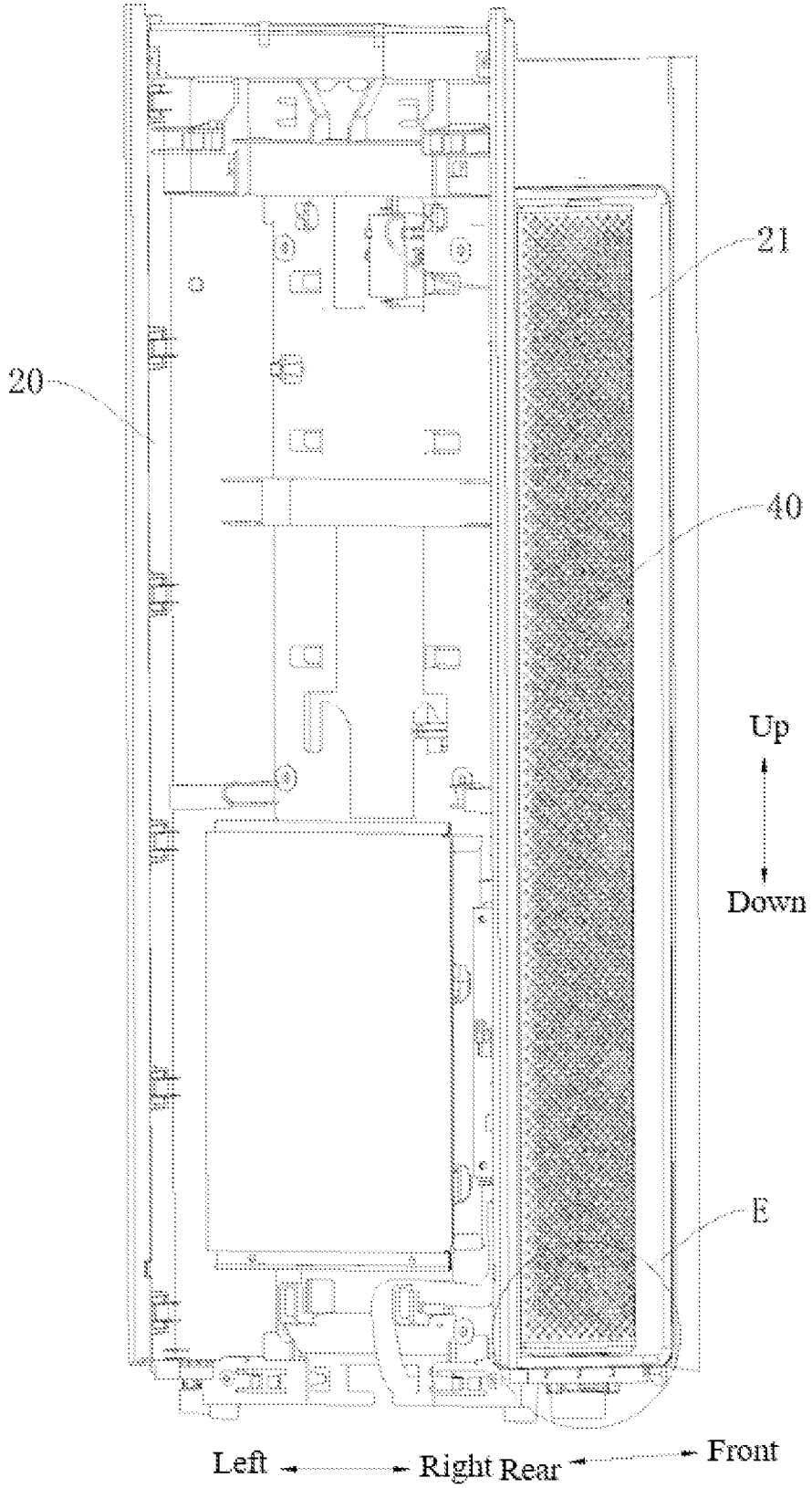
FIG. 18 is a perspective view of an air outlet frame assembly according to some embodiments of the present disclosure, where the air conditioner is in a windless mode.
Figure 19:
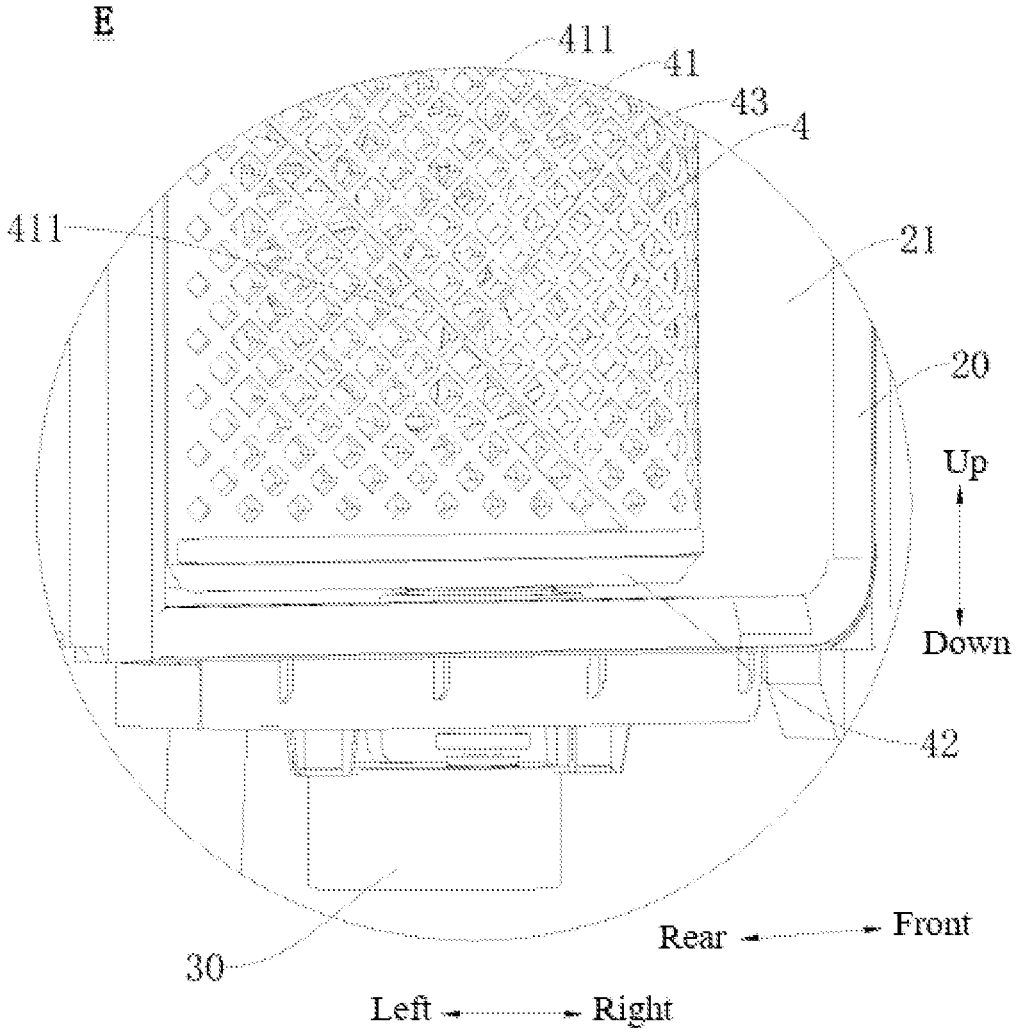
FIG. 19 is an enlarged view at a position E illustrated in FIG. 18.
Figure 20:
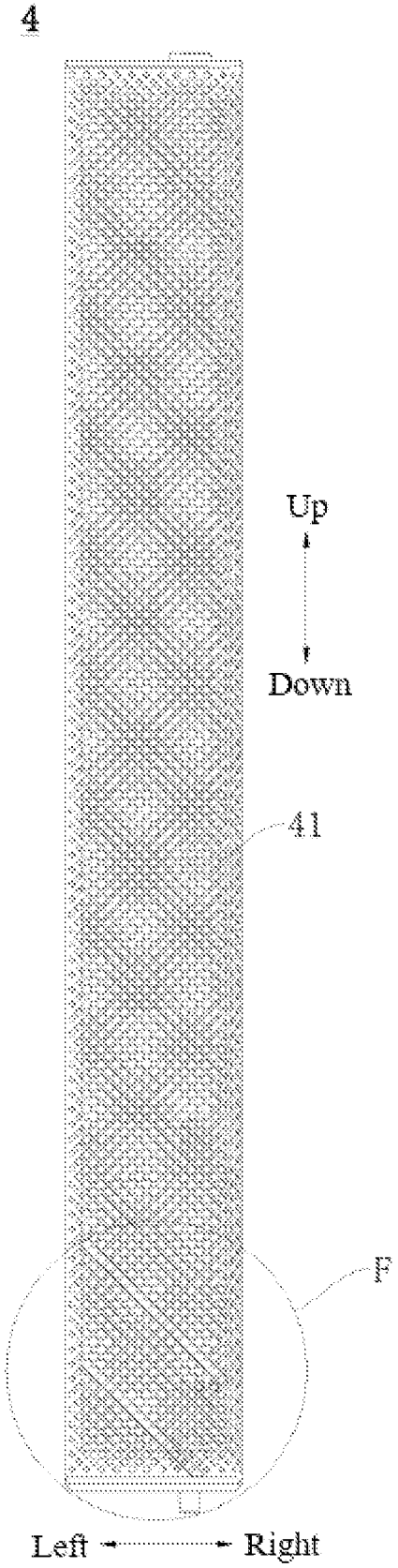
FIG. 20 is a front view of an outer air guide plate of an air guide component according to some embodiments of the present disclosure.

According to some embodiments of the present disclosure, referring to FIG. 8, FIG. 18, and FIG. 20, at least part of the flow guide surface 42 extends obliquely inwards in a direction from top to bottom (the "obliquely extending inwards" refers to extending obliquely towards a direction adjacent to the center of the air conditioner, relative to the position of the air guide component 40 at which the air outlet end of the air outlet channel 21 is closed). For example, in a direction relative to the user, the at least part of the flow guide surface 42 obliquely extends backwards in the direction from top to bottom. For example, a part of the flow guide surface 42 may extend obliquely inwards in the direction from top to bottom, or a whole flow guide surface 42 may extend obliquely inwards in the direction from top to bottom. By extending the at least part of the flow guide surface 42 obliquely inwards in a direction from top to bottom, when the condensate water on the air guide component 40 flows downwards to the flow guide surface 42, the flow guide surface 42 can guide the condensate water downwards to flow inwards into the water receiver cavity 221 of the water receiving member 22. Therefore, the flow guide surface 42 serves to facilitate better flow guiding.

In some embodiments, in the direction from top to bottom, the flow guide surface 42 extends along a straight line, a broken line, or a curve. As a result, the flow guide surface 42 is structured more flexibly and adaptably, and serves to facilitate better flow guiding simultaneously.

According to some embodiments of the present disclosure, a projection of a bottom edge of the flow guide surface 42 adjacent to the water receiving member 22 on a horizontal plane may be located in a projection of the water receiver cavity 221 in the horizontal plane. In the process of the condensate water on the air guide component 40 flowing downwards along the outer wall of the air guide component 40, because the projection of the bottom edge of the flow guide surface 42 on the horizontal plane is located in the projection of the water receiver cavity 221 in the horizontal plane, the condensate water can be guided into the water receiver cavity 221 of the water receiving member 22 through the flow guide surface 42 at the bottom of the air guide component 40. In this way, the condensate water on the outer wall surface of the air guide component 40 can be better prevented from dripping onto the ground.

Further, the projection of the flow guide surface 42 on the horizontal plane is at least partially located in the projection of the water receiving member 22 in the horizontal plane. As a result, when the condensate water on the air guide component 40 flows downwards to the flow guide surface 42, it can be ensured that all the condensate water on the flow guide surface 42 flows into the water receiving member 22. In this way, the safety hazard and inconvenience caused by the condensate water dripping out of the water receiving member 22 can be better avoided.

According to some embodiments of the present disclosure, referring to FIG. 8 and FIG. 18, the at least part of the flow guide surface 42 is located in the water receiver cavity 221. For example, the part of the flow guide surface 42 may be located in the water receiver cavity 221, or the whole flow guide surface 42 may be located in the water receiver cavity 221. By enabling the at least part of the flow guide surface 42 to be located in the water receiver cavity 221, the condensate water on the air guide component 40 flowing downwards to the flow guide surface 42 can be better guided into the water receiver cavity 221 of the water receiving member 22. A part of the inner side wall of the water receiver cavity 221 opposite to the flow guide surface 42 may be spaced apart from the flow guide surface 42, and therefore a flow guide space between the inner side wall of the water receiver cavity 221 and the flow guide surface 42. By enabling the part of the inner side wall of the water receiver cavity 221 opposite to the flow guide surface 42 to be spaced apart from the flow guide surface 42, when the condensate water on the air guide member 40 flows downward to the flow guide surface 42, the flow guide space may provide a flow space for the condensate water that flows to the flow guide surface 42, preventing the condensate water flowing onto the flow guide surface 42 from falling out of the water receiving member 22, further effectively preventing the condensate water on the air guide member 40 from falling onto the ground.

According to some embodiments of the present disclosure, a part of the outer wall surface of the air guide component 40 adjacent to the water receiving member 22 is recessed inwards (the "recessed inwards" refers to being recessed in a direction facing towards the center of the air conditioner, relative to the position of the air guide component 40 at which the air outlet end of the air outlet channel 21) to form the flow guide surface 42. Therefore, other parts of the outer wall surface of the flow guide surface 42 opposite to the air flow assembly are recessed inwards. In this way, when the condensate water on the air guide component 40 flows downwards to the flow guide surface 42, the condensate water on the air guide component 40 may flow inwards into the water receiver cavity 221 of the water receiving member 22 under the guidance of the flow guide surface 42. Thus, the condensate water on the air guide component 40 can be effectively prevented from falling onto the ground.

According to some embodiments of the present disclosure, at least a part of the inner side wall of the water receiver cavity 221 is formed as a flow diversion surface. The flow diversion surface extends to an upper end surface of the water receiving member 22 and obliquely extends facing towards a center adjacent to the water receiver cavity 221 from top to bottom. In this way, a water receiving area of the water receiver cavity 221 can be increased. In addition, when the condensate water on the air guide component 40 drips onto the flow diversion surface of the water receiving member 22, the condensate water may be diverted into the water receiver cavity 221 under the guidance of the flow diversion surface. In this way, a probability that the condensate water on the air guide component 40 drips outside the water receiving member 22 is further reduced. Therefore, both the safety hazard and the inconvenience for the user are minimized.

In some embodiments, the part of the flow guide surface 42 located in the water receiver cavity 221 is opposite to and spaced apart from the flow diversion surface, and therefore a space formed between the flow guide surface 42 and the flow diversion surface may constitute the at least part of the flow guide space as mentioned above. The condensate water flowing downwards from the air guide component 40 onto the flow guide surface 42 and the condensate water dripping from the air guide component 40 onto the flow diversion surface may both be accommodated in the flow guide space and quickly and smoothly flow into the water receiver cavity 221.

According to some embodiments of the present disclosure, referring to FIG. 8, FIG. 18, and FIG. 20, a flow guide structure configured to guide the condensate water onto the flow guide surface 42 may further be formed on the outer wall surface of the air guide component 40. The flow guide structure may be located on an upper side of the flow guide surface 42. Condensate water on the outer wall surface of the air guide component 40 may be guided onto the flow guide surface 42 through the flow guide structure, and then is guided into the water receiver cavity 221 of the water receiving member 22 through the flow guide surface 42. Therefore, the condensate water on the outer wall surface of the air guide component 40 can be better guided into the water receiver cavity 221 of the water receiving member 22 through the arranged flow guide structure and the flow guide surface 42. The flow guide structure may include at least one flow guide 43 of an elongated shape. The flow guide 43 may be formed as a flow guide groove or a flow guide convex rib. For example, one or a plurality of flow guides 43 may be provided. The flow guide 43 extends obliquely downwards. When the plurality of flow guides 43 is provided, the plurality of flow guides 43 are generally arranged at intervals in the up-down direction. The condensate water on the outer wall surface of the air guide component 40 is obliquely guided downwards by the flow guide 43 onto the flow guide surface 42, and then is guided into the water receiver cavity 221 of the water receiving member 22 through the flow guide surface 42.

It should be noted that "a plurality of" in the present disclosure refers to two or more.

In some embodiments of the present disclosure, an angle between the flow guide 43 and the horizontal direction ranges from 30° to 60°. For example, an angle between the flow guide 43 and the horizontal direction is 45°. Therefore, the flow guide 43 can serve to facilitate flow diversion to improve a flow diversion effect.

In some embodiments of the present disclosure, referring to FIG. 8, FIG. 18 and FIG. 20, an air diffusion structure 41 configured for airflow to pass through is formed on the outer wall surface of the air guide component 40. In this way, when the air guide component 40 is used in the air conditioner, the air conditioner may have a normal air supply mode and a windless mode. In the normal air supply mode, the air guide component 40 rotates to the position where the air outlet end of the air outlet channel 21 is opened. In this case, the air guide component 40 serves to adjust the wind direction. In the windless mode, the air guide component 40 rotates to the position where the air outlet end of the air outlet channel 21 is closed, and the airflow flows into the room through the air diffusion structure 41 on the air guide component 40. Therefore, the airflow can be diffused. As a result, a windless feeling can be realized.

The flow guide 43 may be formed as a flow guide recess, and a part of the air diffusion structure 41 is formed on a bottom wall of the flow guide groove. In this way, the flow guide structure and the air diffusion structure 41 are fused together, which reduces incongruity of the flow guide structure. As a result, an appearance of the air guide component 40 is more aesthetically pleasing, and processing and molding of the flow guide recess and the arrangement of the air diffusion structure 41 are facilitated.

In some embodiments of the present application, referring to FIG. 8, FIG. 18 and FIG. 20, the air diffusion structure 41 may include a plurality of groups of air diffusion holes 411 arranged side by side, and each of the plurality of groups of air diffusion holes 411 may include a plurality of air diffusion holes 411 arranged obliquely. An extension direction of the flow guide 43 may be parallel to an arrangement direction of the plurality of air diffusion holes 411 in the group of air diffusion holes 411, and at least a part of the group of air diffusion holes 411 are formed on a bottom wall of the flow guide 43. Therefore, the incongruity of the flow guide structure can be significantly reduced. As a result, the appearance of the air guide component 40 is more aesthetically pleasing, and the processing and molding of the flow guide recess and the arrangement of the air diffusion structure 41 are facilitated.

According to some embodiments of the present disclosure, referring to FIG. 9 and FIG. 17 to FIG. 20, the air guide assembly 401 includes the outer air guide plate 4 and the inner air guide assembly 402. The outer wall surface of the outer air guide plate 4 constitutes the outer wall surface of the air guide assembly 401, and the air diffusion structure 41 is formed on the outer air guide plate 4. The inner air guide assembly 402 may include the inner air guide plate 5, the air diffusion fan blade assembly 61, and the louver mechanism 62. The inner air guide plate 5 may be connected to the outer air guide plate 4. The air diffusion fan blade assembly 61 is disposed on the inner air guide plate 5. The louver mechanism 62 is disposed on the side of the inner air guide plate 5 facing away from the outer air guide plate 4. Therefore, the air guide component 40 not only serves to adjust the air flow direction, but also to diffuse the airflow, allowing the air conditioner to realize the windless mode and the normal air supply mode.

Figure 5:
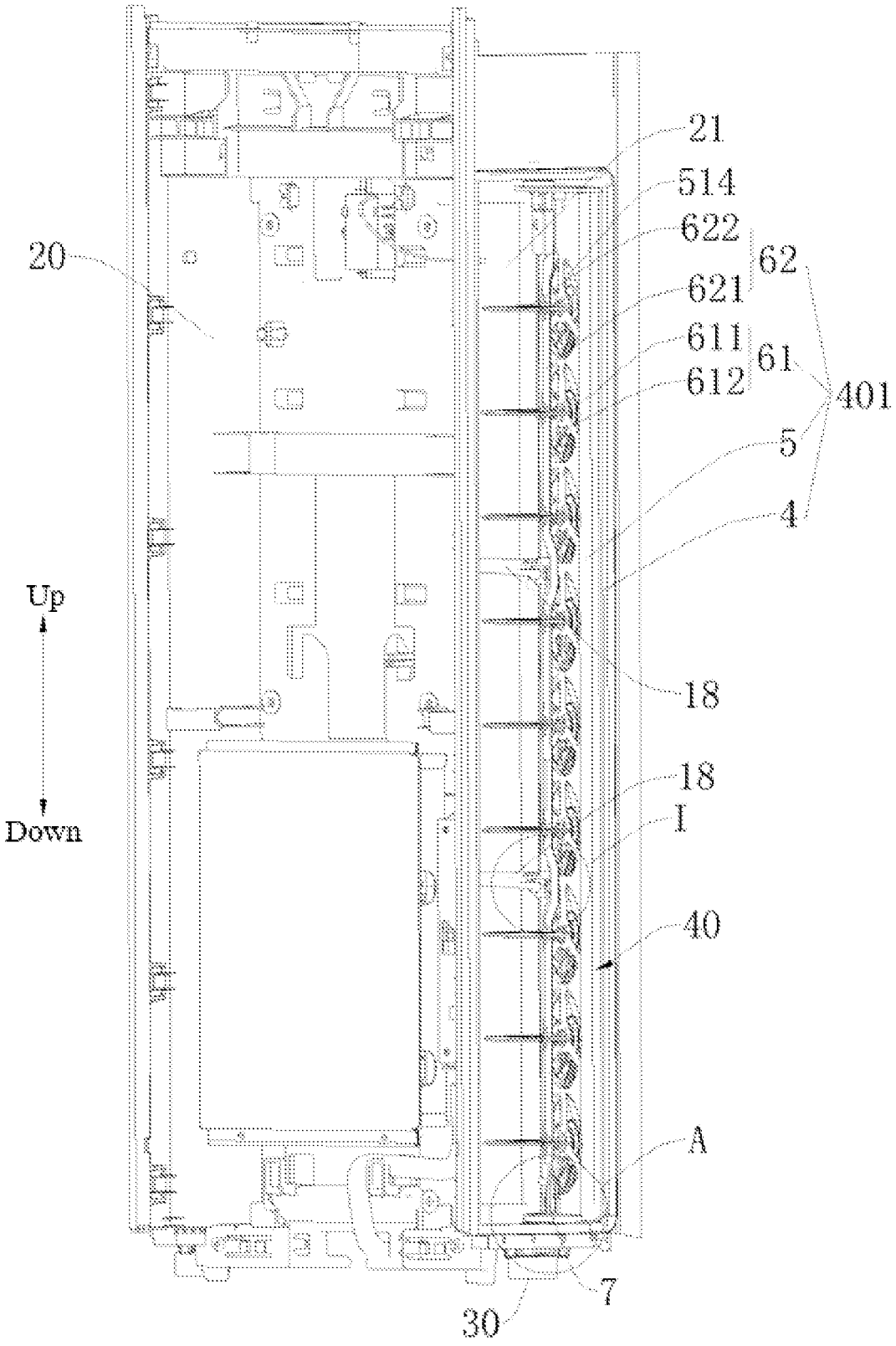
FIG. 5 is a perspective view of an air outlet frame assembly according to some embodiments of the present disclosure, where an air conditioner is in a normal air supply mode.
Figure 6:
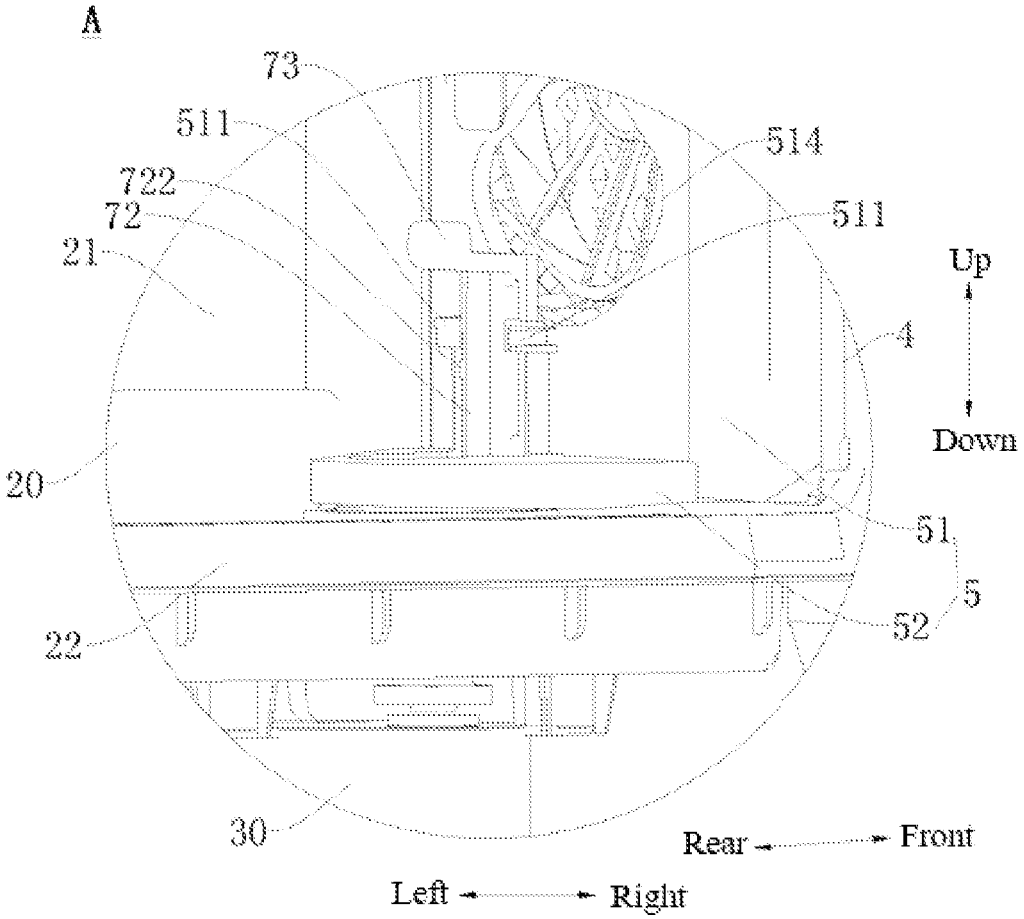
FIG. 6 is an enlarged view at a position A illustrated in FIG. 5.
Figure 7:
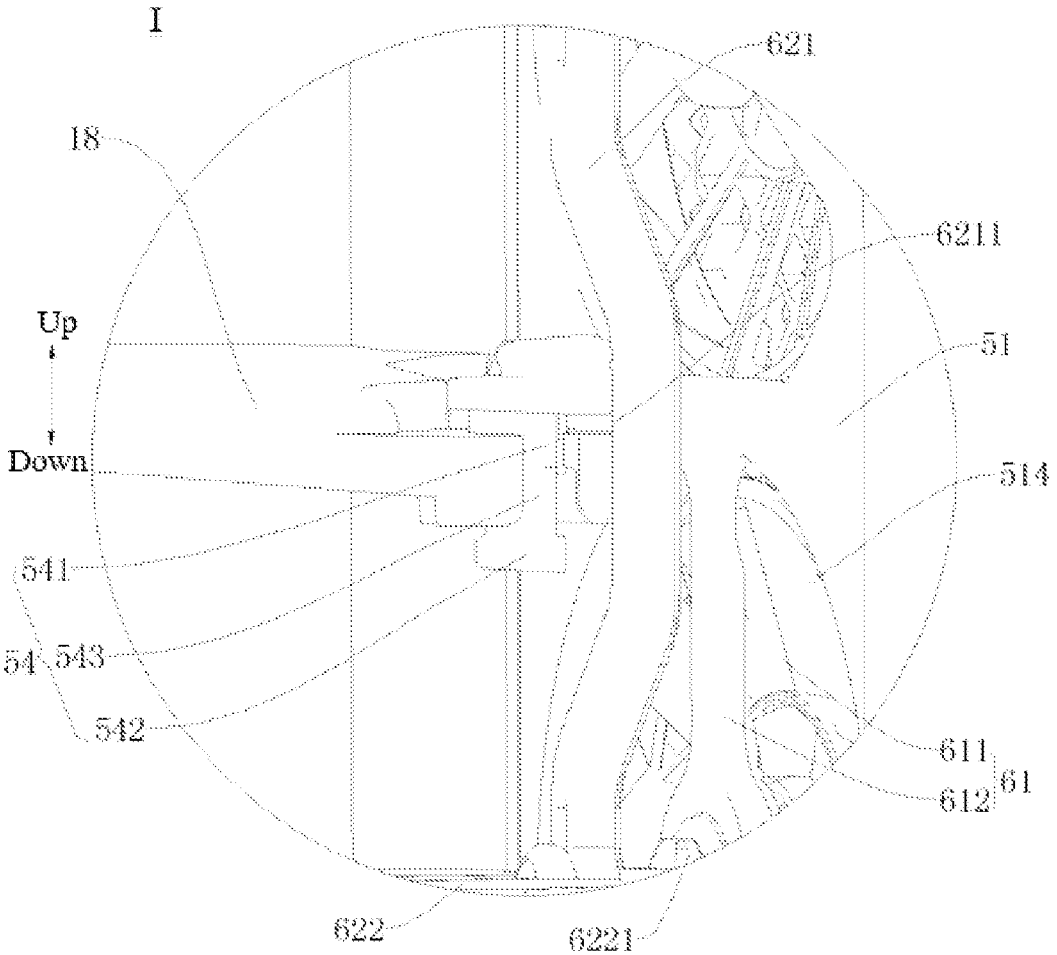
FIG. 7 is an enlarged view at a position I illustrated in FIG. 5.
Figure 17:
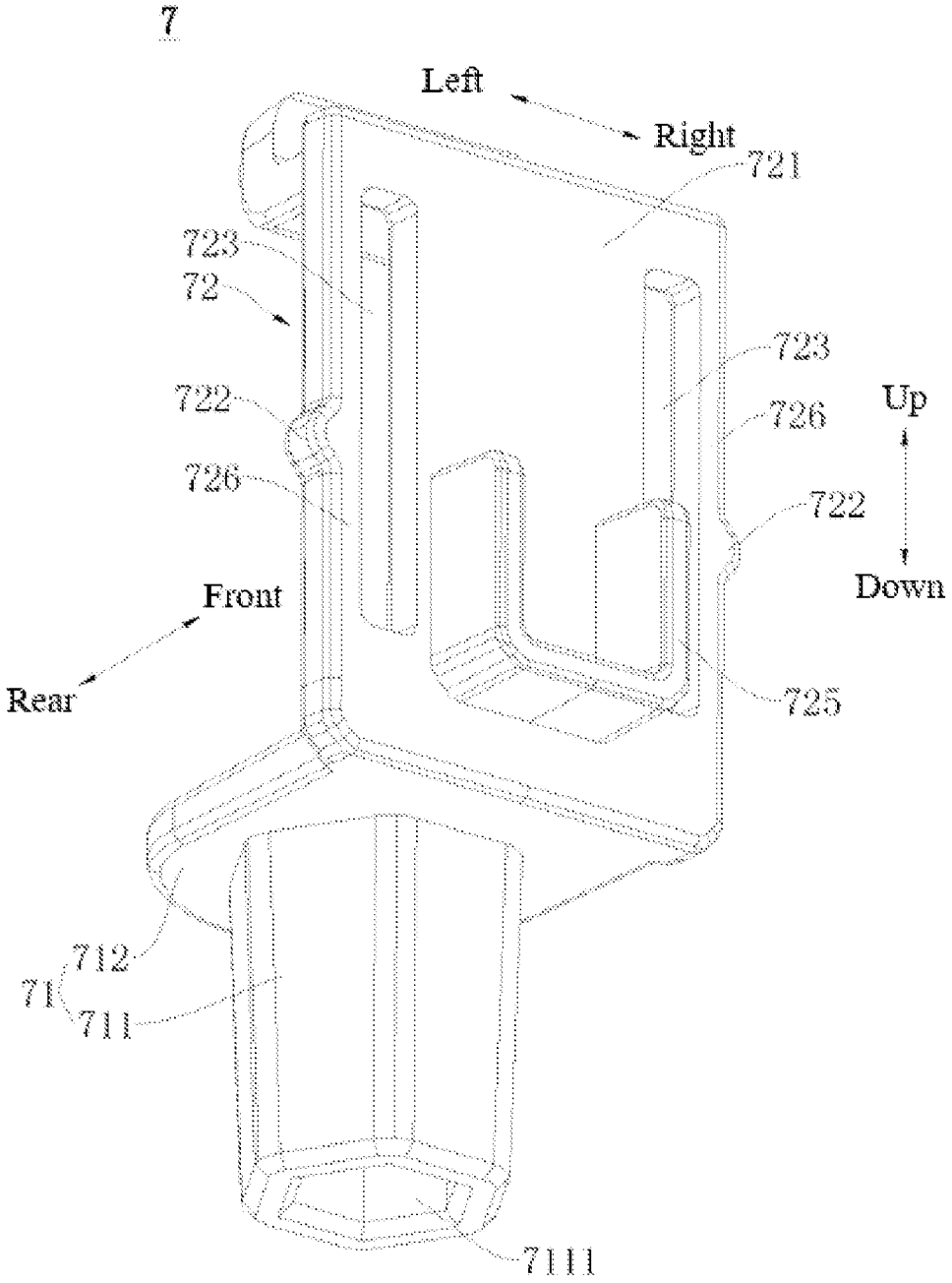
FIG. 17 is a perspective view of the connector illustrated in FIG. 16 from another angle.

Referring to FIG. 5, FIG. 7 and FIG. 17, According to embodiments of the present disclosure, there is provided an air outlet frame assembly including an air outlet frame 20 and an air guide component 40. At least one air outlet channel 21 is formed on the air outlet frame 20. For example, one air outlet channel 21 may be formed on the air outlet frame 20, or a plurality of air outlet channels 21 may also be formed on the air outlet frame 20, e.g., two air outlet channels 21. The air guide component 40 is the air guide component 40 according to the embodiments of the present disclosure. The air guide component 40 is rotatably disposed in the air outlet channel 21. The connector 7 rotatably passes through a rotation hole 224, for example, the connection member 71 of the connector 7 rotatably passes through the rotation hole 224. The air guide drive mechanism 30 configured to drive the air guide component 40 to rotate may be disposed on the air outlet frame 20 and located on a side of the air outlet channel 21.

In some embodiments, a shaft sleeve 23 may be disposed in the rotation hole 224, and the connection member 71 passes through the shaft sleeve 23. In this way, friction and wear between the connection member 71 and the rotation hole 224 can be reduced.

In some embodiments of the present disclosure, a drainage hole may not be formed on the water receiving member 22, and the condensate water received in the water receiver cavity 221 of the water receiving member 22 may be evaporated by natural air drying.

In some other embodiments of the present disclosure, the drainage channel may be formed on the water receiving member 22, and the condensate water flowing into the water receiving member 22 may flow into a water receiving tray of a heat exchanger at a bottom surface of a heat exchanger component through the drainage channel. For example, the water receiving tray of the heat exchanger may be connected to the water receiving member 22 and located at lower level than the water receiving member 22.

In the air outlet frame assembly according to the embodiments of the present disclosure, through setting of the air guide component 40 as mentioned above, the mounting and dismounting of the air guide component 40 become simple. In this way, the mounting and dismounting efficiency of the air guide component 40 are enhanced, facilitating the maintenance and cleaning of the air guide component. In addition, the connector 7 on the air guide assembly 401 can be prevented from falling off and becoming lost.

Figure 21:
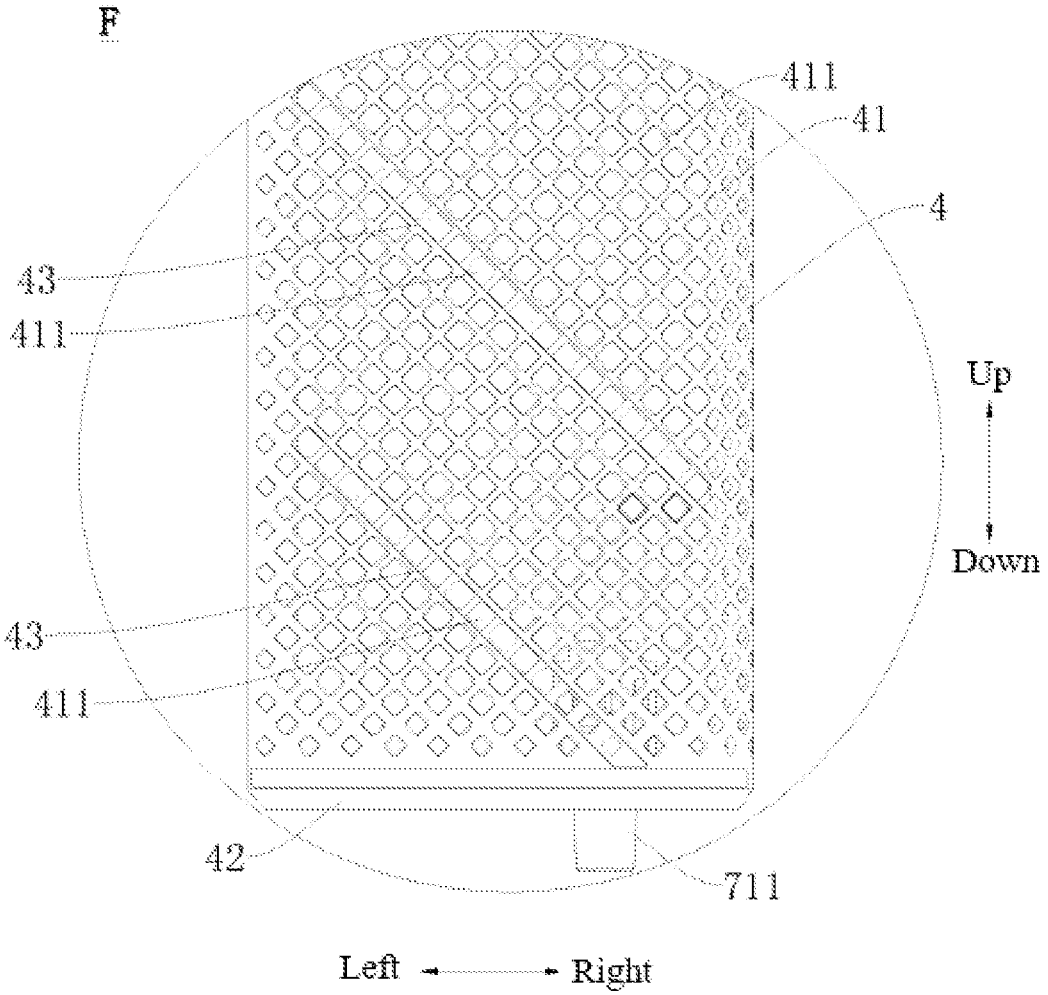
FIG. 21 is an enlarged view at a position F illustrated in FIG. 20.
Figure 22:
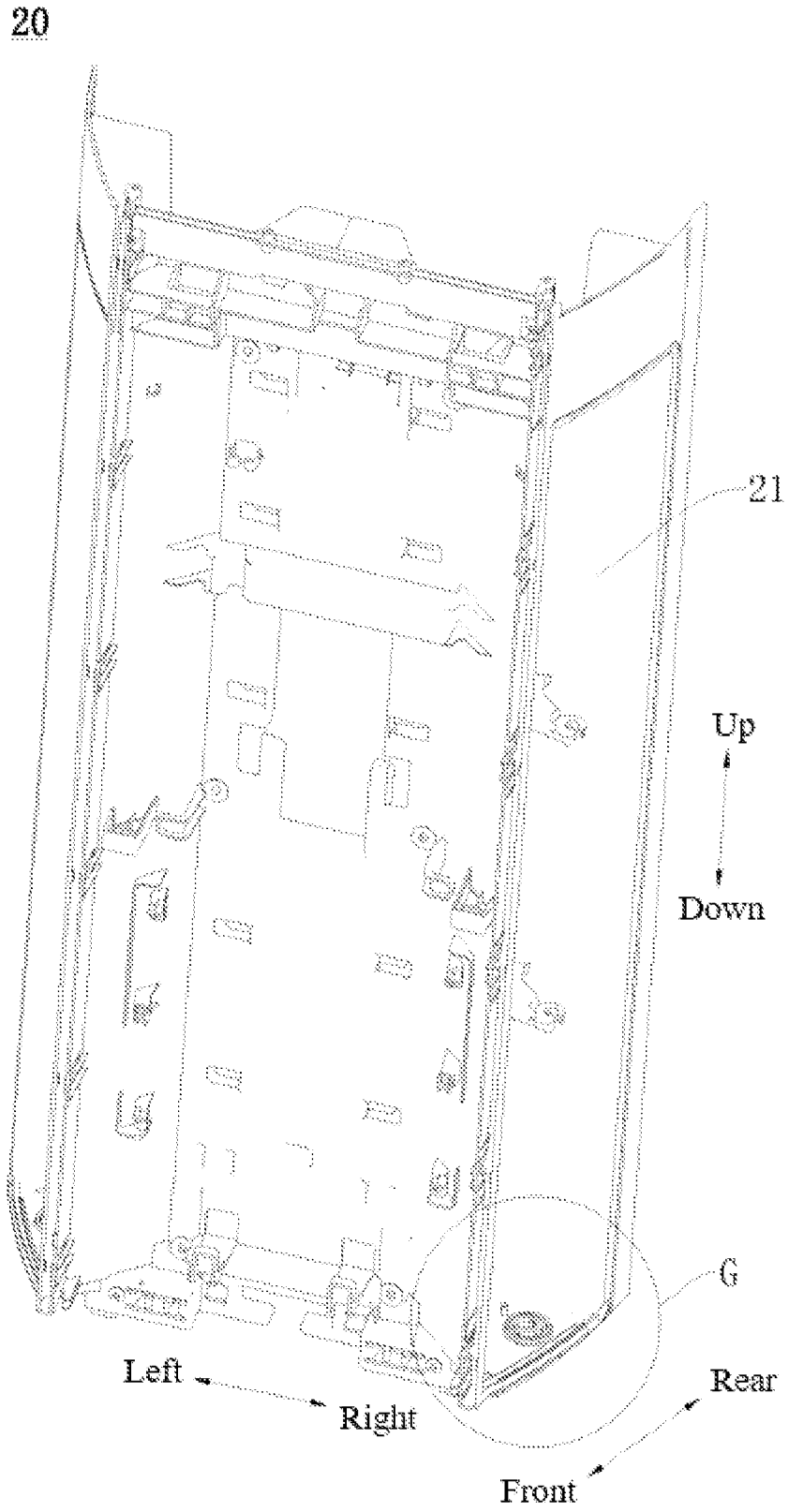
FIG. 22 is a perspective view of an air outlet frame according to some embodiments of the present disclosure.
Figure 23:
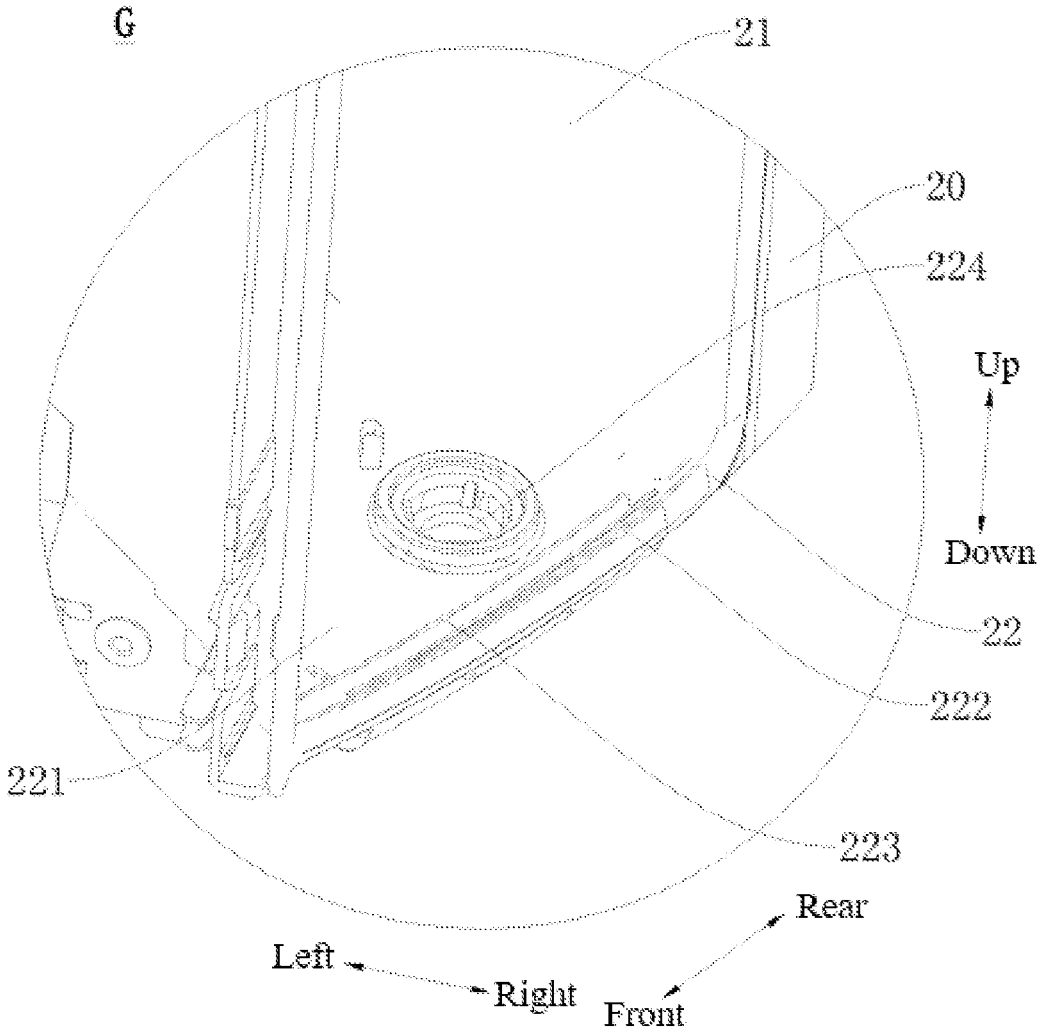
FIG. 23 is an enlarged view at a position G illustrated in FIG. 22.
Figure 24:
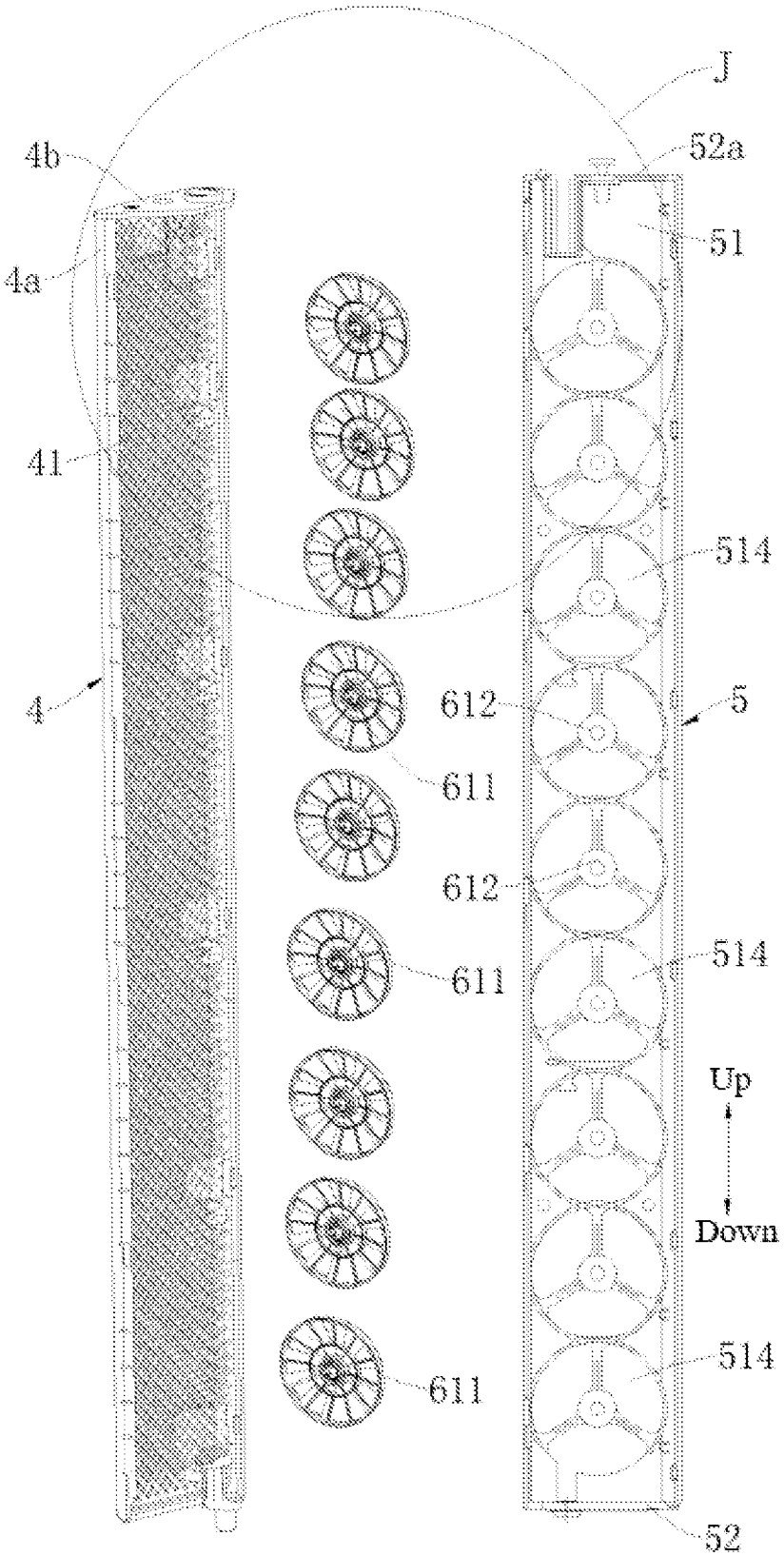
FIG. 24 is an exploded view of a partial structure of an air guide component according to some embodiments of the present disclosure.
Figure 25:
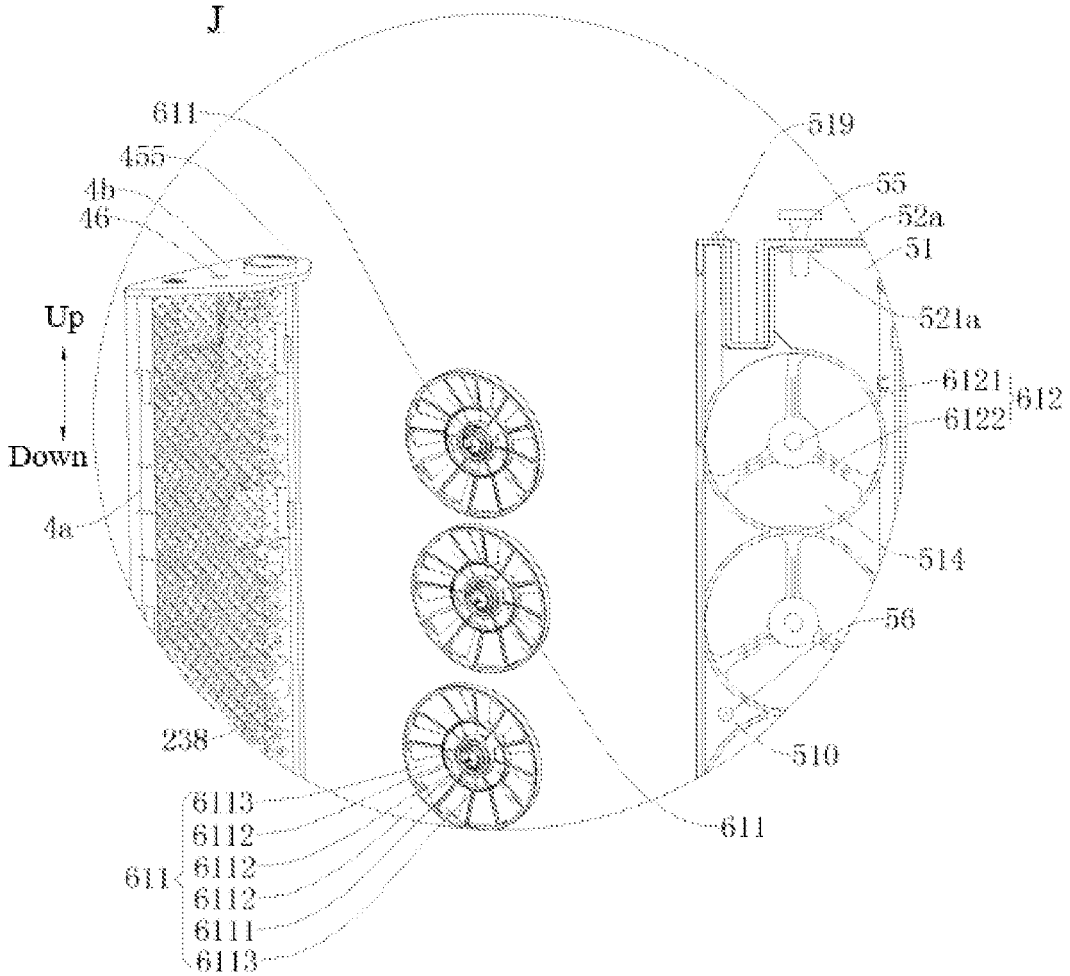
FIG. 25 is a partial enlarged view at a position J illustrated in FIG. 24.
Figure 26:
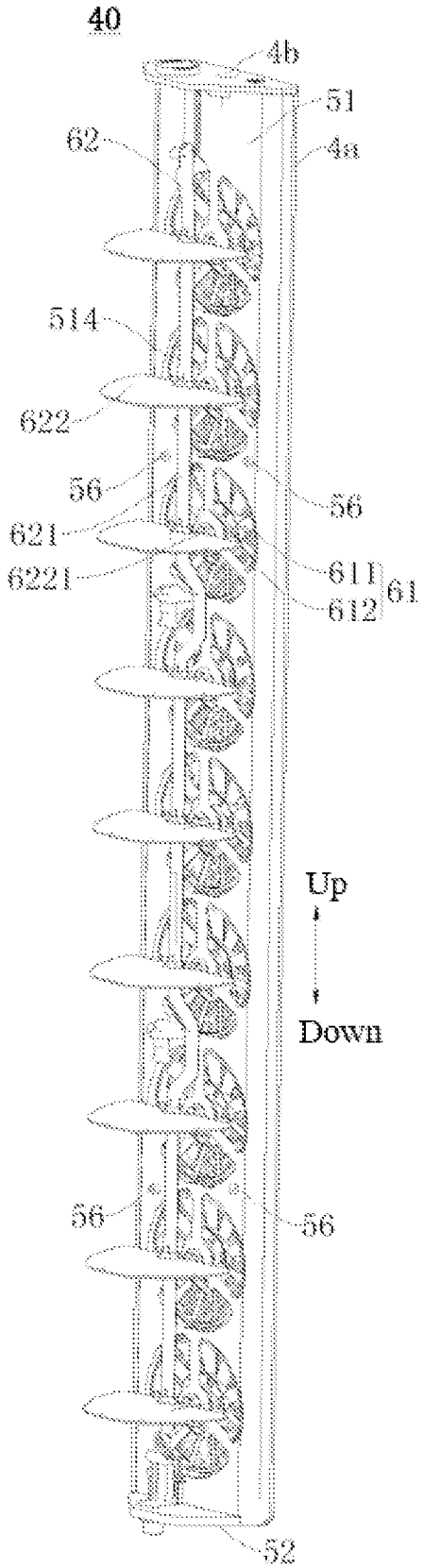
FIG. 26 is a perspective fitting view of an air guide component according to some embodiments of the present disclosure.
Figure 27:
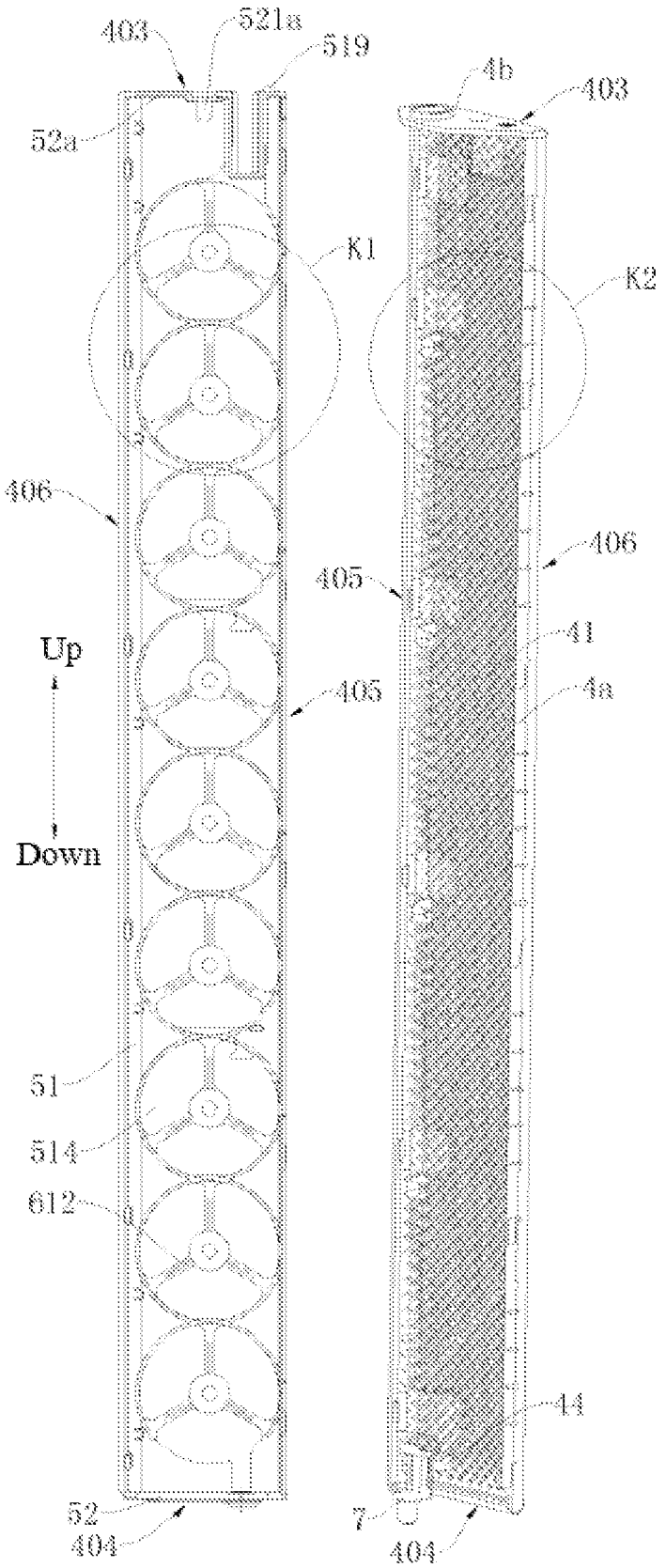
FIG. 27 is an exploded view of an air guide plate assembly of an air guide component according to some embodiments of the present disclosure.
Figure 28:
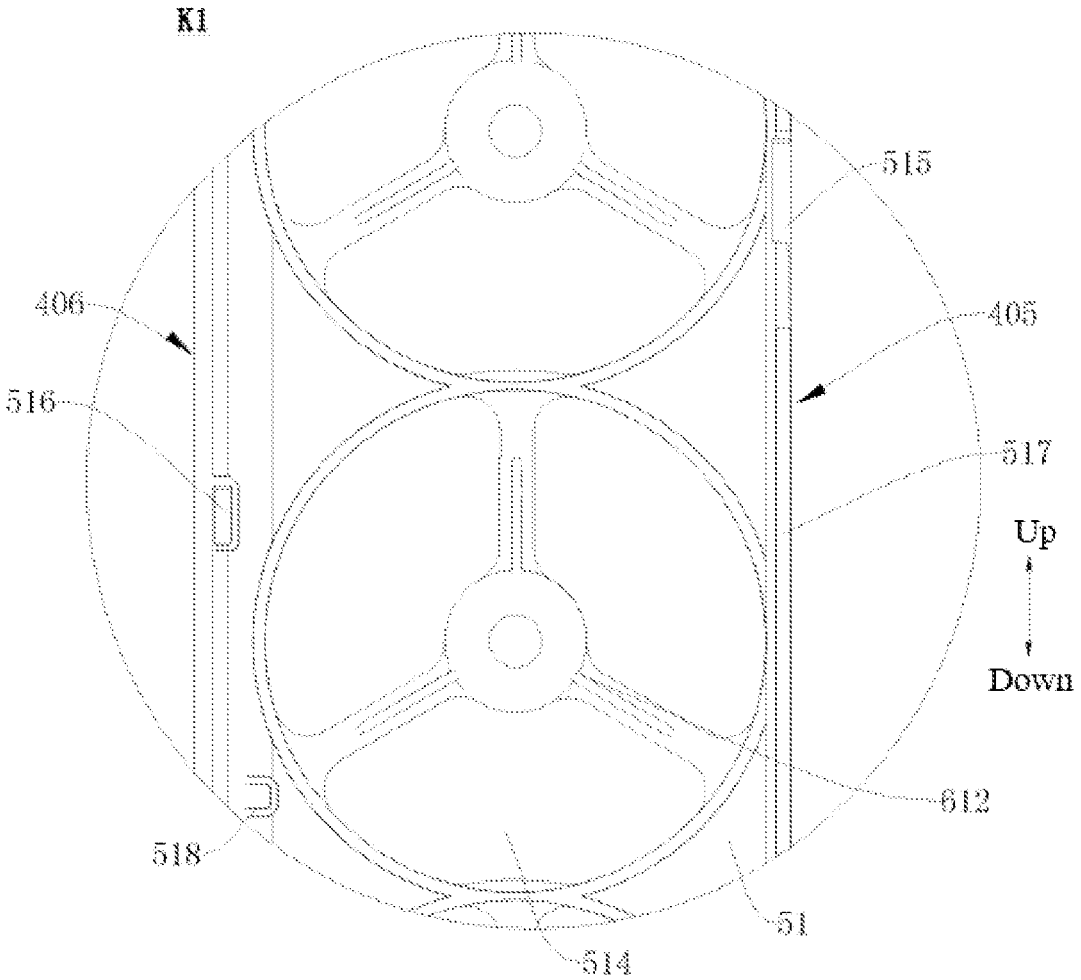
FIG. 28 is a partial enlarged view at a position K1 illustrated in FIG. 27.
Figure 29:
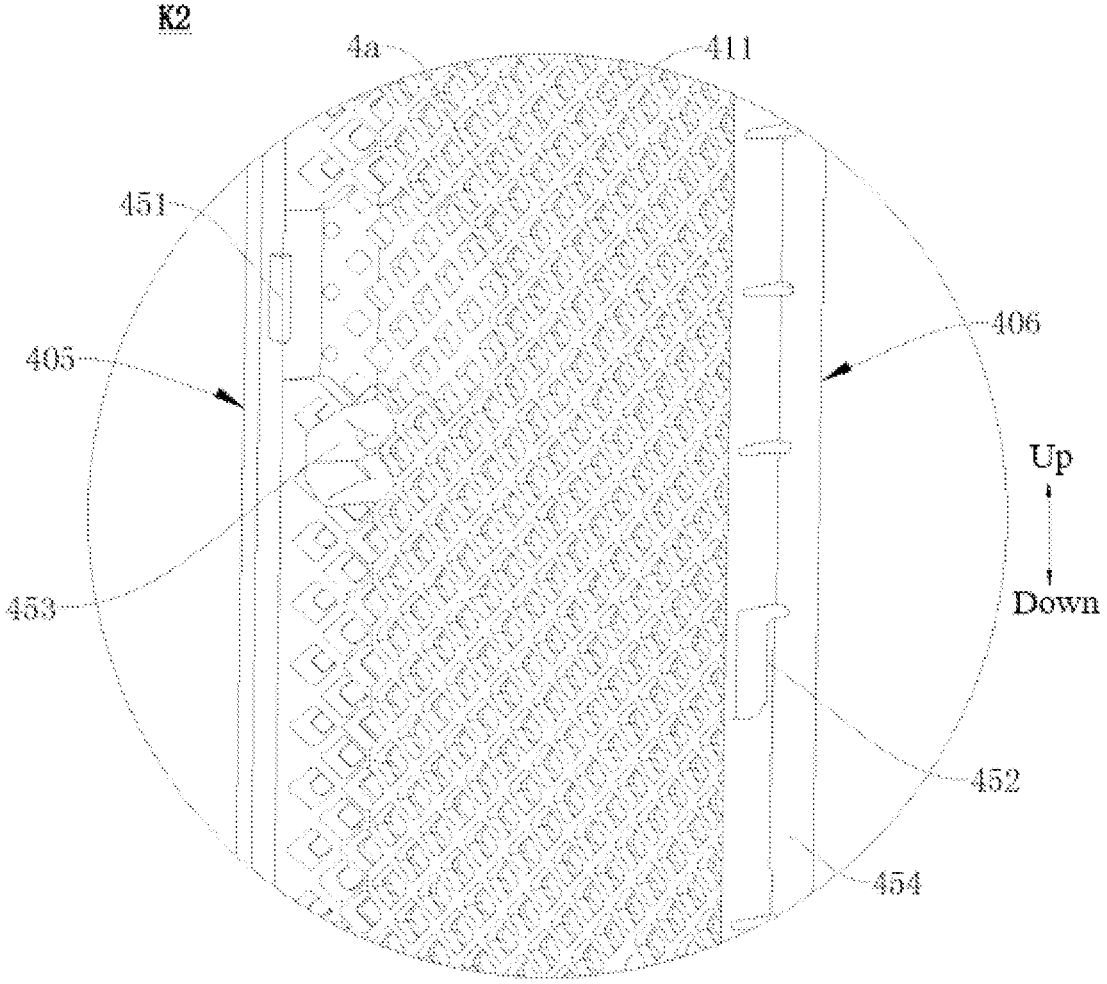
FIG. 29 is a partial enlarged view at a position K2 illustrated in FIG. 27.
Figure 30:
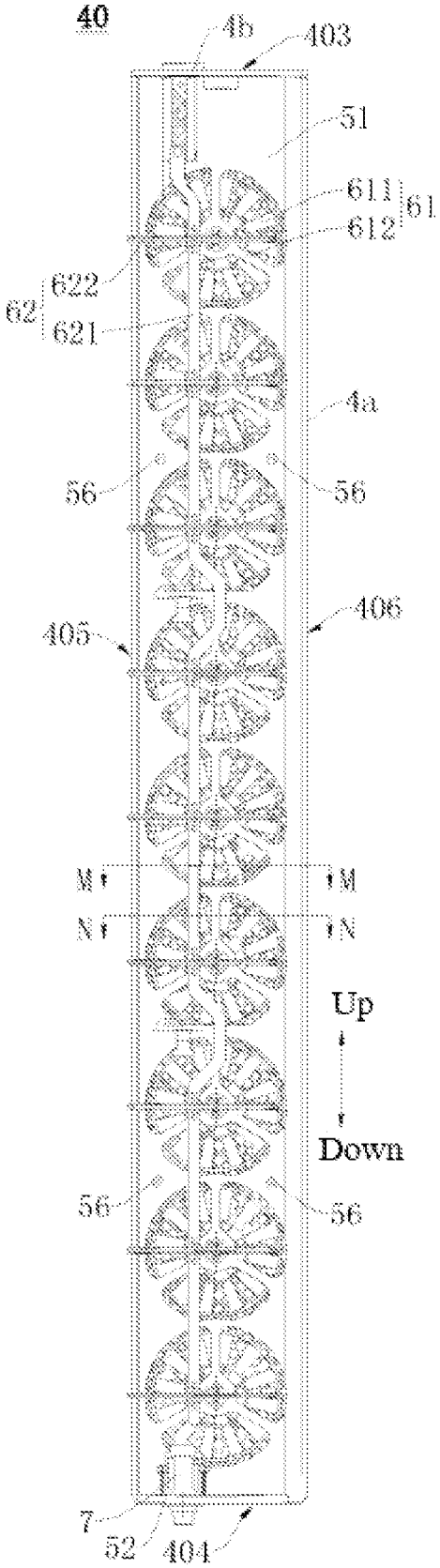
FIG. 30 is a front view of an air guide component according to some embodiments of the present disclosure.
Figure 31:
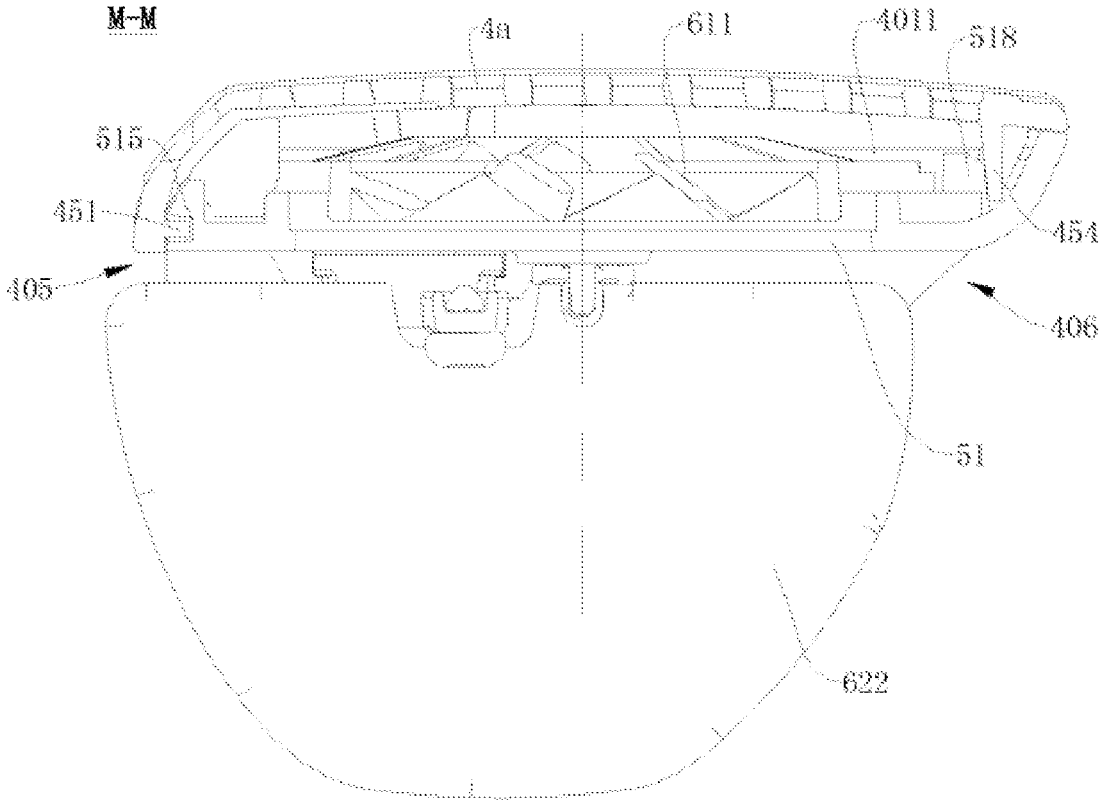
FIG. 31 is a cross-sectional view along a line M-M illustrated in FIG. 30.
Figure 32:
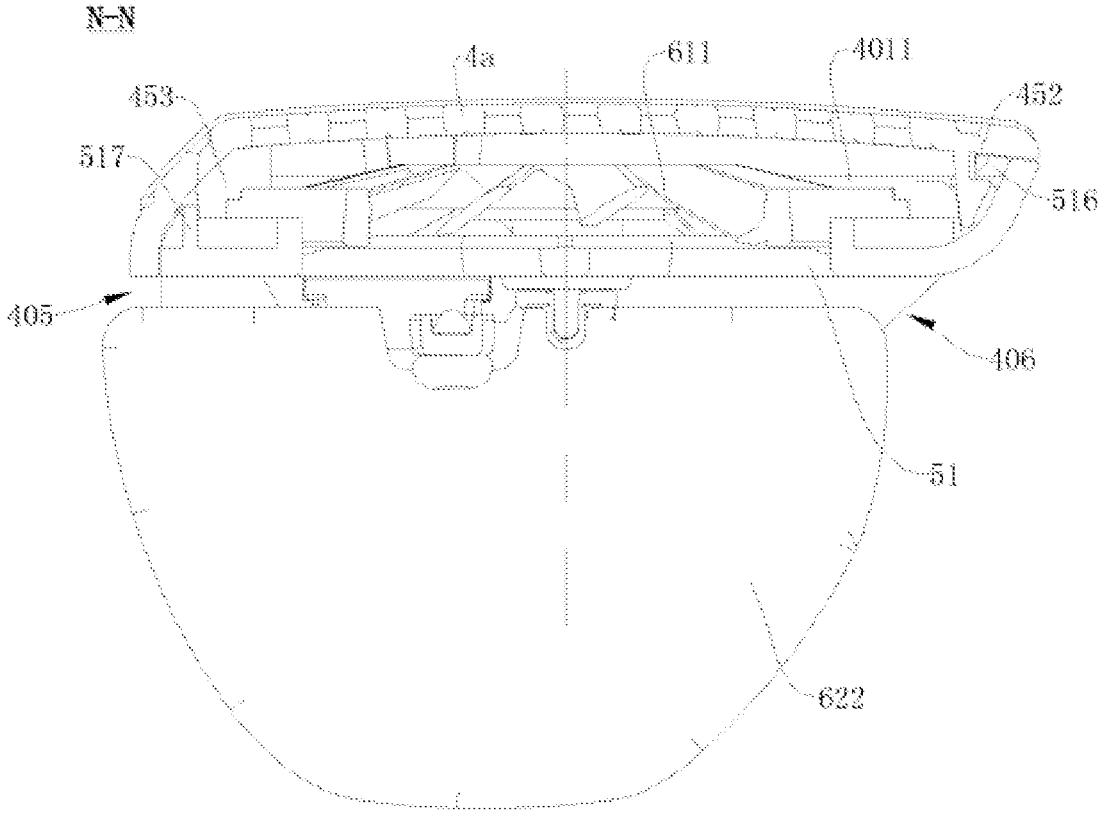
FIG. 32 is a cross-sectional view along a line N-N illustrated in FIG. 30.

According to some embodiments of the present disclosure, referring to FIG. 21 and FIG. 22, an outward facing side wall of the water receiving member 22 may be an outer side wall 222, a water retaining rib 223 may be formed on an inner bottom wall of the water receiver cavity 221. The water retaining rib 223 is disposed adjacent to the outer side wall 222 and spaced apart from the outer side wall 222. Therefore, by disposing the water retaining rib 223 on the inner bottom wall of the water receiver cavity 221 and enabling the water retaining rib 223 to be adjacent to the outward side wall of the water receiving member 22, external airflow can be blocked from entering the water receiving member 22 or the airflow in the water receiving member 22 can be prevented from flowing to the outside. Therefore, an amount of condensate water generated near the outer side wall 222 of the water receiving member 22 is reduced due to a confluence of cold air and hot air. The condensate water can be further effectively prevented from dripping onto the ground.

In some embodiments, referring to FIG. 21 and FIG. 22, the water retaining rib 223 may extend along a circumferential direction of the outer sidewall 222. As a result, an effect of blocking the airflow can be well achieved. Therefore, the amount of condensate water generated near the outer side wall 222 of the water receiving member 22 is reduced due to the confluence of the cold air and the hot air. The condensate water can be further effectively prevented from dripping onto the ground.

In some embodiments, referring to FIG. 21 and FIG. 22, the bottom edge of the flow guide surface 42 adjacent to the water receiving member 22 is located on an inner side of the water retaining rib 223 (the "inner side of the water retaining rib 223" refers to a side of the water retaining rib 223 facing away from the outer side wall 222). Therefore, condensate water flowing to the bottom edge of the flow guide surface 42 through the flow guide surface 42 can flow into a part of the water receiver cavity 221 located on the inner side of the water retaining rib 223. Thus, the condensate water can be prevented from overflowing from a local small region in the water receiver cavity 221.

In some embodiment, one or more water retaining rib 223 may be provided. When a plurality of water retaining ribs 223 is provided, the plurality of water retaining ribs 223 is arranged at intervals in a radial direction of the water receiver cavity 221. The water retaining ribs 223 may extend in a circumferential direction of the outer side wall 222, and a bottom edge of the flow guide surface 42 adjacent to the water receiving member 22 is located on an inner side of a water retaining rib 223 on an innermost side.

Referring to FIG. 33 to FIG. 38, according to some embodiments of the present disclosure, a support member 18 is disposed on an inner wall of the air outlet channel 21, and a cooperation groove 181 is formed on the support member 18. The air guide component 40 is rotatably disposed in the air outlet channel 21, and a cooperation member 54 is disposed on the air guide component 40. In an extension direction of a rotation axis of the air guide component 40, the cooperation member 54 is located between the two end portions of the air guide component 40 and includes a rotation member 541 and an abutment member 542. The rotation member 541 rotatably cooperates with the cooperation groove 181, and the abutment member 542 is located on an axial outer side of the cooperation groove 181 and is adapted to abut against the support member 18 to define axial displacement of the air guide member 40.

In the process that the air guide component 40 rotates in the air outlet channel 21, both ends of the air guide component 40 along the rotation axis may be supported by the inner wall of the air outlet channel 21, but a middle portion of the air guide component 40 (the middle portion may be interpreted as a portion of the air guide component 40 that is located between the two ends of the air guide component 40) is not supported, the rotation of the air guide component 40 may shake, wobble, or even lag. The support member 18 herein may be configured to support the air guide member 40, and therefore the air guide member 40 is more stable during the rotation. In some embodiments, the air guide component 40 may be fitted on the support member 18 through the cooperation between the cooperation groove 181 and the cooperation member 54. In the extension direction of the rotation axis of the air guide component 40, the cooperation member 54 is located between the two ends of the air guide component 40, and therefore the support member 18 can easily cooperate with the middle portion of the air guide component 40. Thus, the middle portion of the air guide component 40 may be supported to allow for stable and smooth rotation of the air guide component 40.

In addition, during the production and fitting of the air guide component 40, the support member 18 can limit the air guide component 40, and therefore the mounting of the air guide component 40 is facilitated. Thus, the fitting efficiency is improved. In some embodiments, the axial displacement of the air guide component 40 can be limited by the abutment member 542 abutting against the support 18. The air guide component 40 may be pre-positioned during the fitting, and therefore the air guide component 40 can be easily mounted in the air outlet channel 21. Meanwhile, a failure of the air guide component 40 caused by large movement during transportation and use can be effectively prevented by limiting the axial displacement of the air guide component 40. For example, in order to facilitate the mounting, there may be a large gap between at least one end of the air guide component 40 and the inner wall of the air outlet channel 21, which may cause the displacement of the air guide component 40 during the transportation and use. By disposing the support member 18 on the inner wall of the air outlet channel 21 and the abutment member 542 on the air guide component 40 abutting against the support member 18, the displacement of the air guide component 40 can be limited, and therefore effectiveness of the air guide component 40 is guaranteed. The cooperation groove 181 of the support member 18 can also limit the radial displacement of the air guide member 40. Since the air guide component 40 is disposed in the air outlet channel 21 and the support member 18 is disposed on the inner wall of the air outlet channel 21, the support member 18 can easily cooperate the air guide component 40. As a result, the air guide component 40 is supported. The rotation member 541 rotatably cooperates with the cooperation groove 181, and the abutment member 542 is located the axial outer side of the cooperation groove 181 and adapted to abut against the support member 18. Therefore, under the premise of guaranteeing that the air guide component 40 rotates relatives to the support member 18, the support member 18 can limit the air guide component 40.

In some embodiments of the present disclosure, as illustrated in FIG. 33 to FIG. 38, the air outlet channel 21 extends in the up-down direction, the rotation axis of the air guide component 40 extends in the up-down direction, and the abutment member 542 is located below the cooperation groove 181. It can be understood that the air outlet channel 21 extending in the up-down direction can increase an air outlet area, and therefore air outlet volume is increased to allow the air conditioner to perform better in the refrigeration or heating. The rotation axis of the air guide component 40 extending in the up-down direction can facilitate the air guide component 40 to open and block the air outlet end of the air outlet channel 21. For example, in order to facilitate the mounting, there may be a large gap between an upper end of the air guide component 40 and the inner wall of the air outlet channel 21, which may cause the displacement of the air guide component 40 during the transportation and use (the air conditioner may be turned upside down during the transportation). However, the abutment member 542 located below the cooperation groove 181 can limit the upward displacement of the air guide component 40, and therefore the effectiveness of the air guide component 40 is guaranteed.

Figure 33:
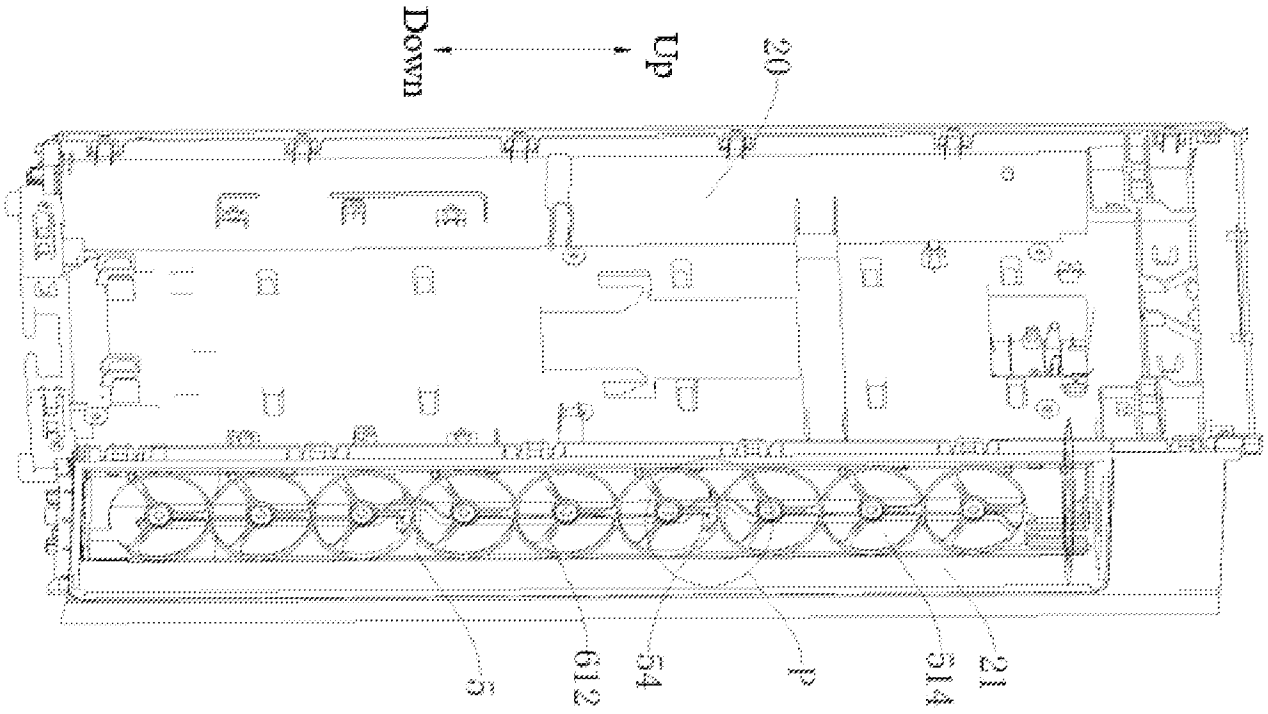
FIG. 33 is a schematic partial structural diagram of an air outlet frame assembly according to some embodiments of the present disclosure.

According to some embodiments of the present disclosure, as illustrated in FIG. 33, a plurality of support members 18 may be provided and spaced apart from each other, a plurality of cooperation members 54 may be provided and spaced apart from each other, and each of the plurality of mating members 54 cooperates with each of the plurality of support members 18 in one-to-one correspondence. Cooperation between the plurality of support members 18 and the plurality of cooperation members 54 can enhance the reliability of the connection between the air guide member 40 and the inner wall of the air outlet channel 21. Moreover, the plurality of support members 18 may further enhance a supporting effect of the support member 18 on the air guide member 40 to allow for more stable and smooth rotation of the air guide component 40. In addition, each of the plurality of cooperation members 54 may include the abutment member 542. A plurality of abutment members 542 abutting against the plurality of support members 18 can further limit the air guide member 40.

As illustrated in FIG. 33 to FIG. 38, in some embodiments of the present disclosure, a peripheral wall of the cooperation groove 181 has a fitting port 1811, and the cooperation member 54 further includes a connection part 543. The connection part 543 is connected between the rotation member 541 and the abutment member 542 and adapted to the rotation member 541 to assemble the cooperation member 54 through the fitting port 1811. On one hand, the connection part 543 can connect the rotation member 541 with the abutment member 542 to allow for rotation and position limiting of the rotation member 541 and the abutment member 542 as a whole. On the other hand, the connection part 543 may also be adapted to the fitting port 1811 of the cooperation groove 181. Therefore, the cooperation member 54 easily cooperates with the support member 18 through the connection member 543. Thus, the air guide component 40 is easily connected to the support member 18.

Referring to FIG. 33 to FIG. 38, according to some embodiments of the present disclosure, a cross section of the connection part 543 is formed as a rectangle, and the connection part 543 has a structure in a width direction is adapted to the fitting port 1811. Therefore, the connection member 543 can be conveniently connected the rotation member 541 with the abutment member 542, and meanwhile, the connection member 543 can be conveniently engaged with the fitting port 1811.

In some embodiments of the present disclosure, as illustrated in FIG. 35 to FIG. 38, the abutment member 542 is formed into an elongated shape, and two ends of the abutment member 542 in a length direction extend out of the rotation member 541 to be adapted to abut against the support member 18. It can be understood that the abutment member 542 of the elongated shape may facilitate the two ends of the abutment member 542 to extend out of the rotation member 541. The abutment member 542 extending out of the rotation member 541 can abut against the support member 18, and therefore the abutment member 542 can conveniently cooperate with the supporting member 18. The axial displacement of the air guide component 40 can be limited by the abutment member 542 abutting against the support 18. The air guide component 40 may be prepositioned during the fitting, and therefore the air guide component 40 can be easily mounted in the air outlet channel 21. Meanwhile, a failure of the air guide component 40 caused by large movement during transportation and use can be effectively prevented by limiting the axial displacement of the air guide component 40. For example, in order to facilitate the mounting, there may be a large gap between at least one end of the air guide component 40 and the inner wall of the air outlet channel 21, which may cause the displacement of the air guide component 40 during the transportation and use. By disposing the support member 18 on the inner wall of the air outlet channel 21 and the abutment member 542 on the air guide component 40 abutting against the support member 18, the displacement of the air guide component 40 can be limited, and therefore effectiveness of the air guide component 40 is guaranteed. The cooperation groove 181 of the support member 18 can also limit the radial displacement of the air guide member 40.

According to some embodiments of the present disclosure, as illustrated in FIG. 35 to FIG. 38, a protrusion member 182 is disposed on the support member 18 and protrudes, and the abutment member 542 is adapted to abut against the protrusion member 182. As a possible implementation, when one protrusion member 182 is provided, one of side walls of the cooperation groove 181 protrudes towards an opposite side wall to be formed as a protrusion member 182; and when two protrusion members 182 are provided, opposite side walls of the two cooperation grooves 181 protrude towards each other to be formed as two protrusion members 182. The formation method of the protrusion member 182 is not limited thereto. The protrusion member 182 can also be a protrusion structure that is injection molded on the side wall of the cooperation groove 181, or is disposed on the side wall of the cooperation groove 181 through the connector. It can be understood that the protrusion member 182 may facilitate the support member 18 to abut against the abutment member 542, and therefore the air guide component 40 is easily limited by the support member 18.

Further, the protrusion member 182 is formed on each of the opposite side walls of the cooperation groove 181. The opposite side wall of the cooperation groove 181 herein can be understood as a side wall corresponding to each of the two ends of the abutment member 542 of the cooperation groove 181 in the length direction of the abutment member 542. The protrusion member 182 is disposed on the each of the opposite side walls of the cooperation groove 181. Similarly, each of the opposite side walls of the matching groove 181 may also be understood as a side wall corresponding to each of the two ends of the abutment member 542 of the cooperation groove 181 in the length direction of the abutment member 542.

According to some embodiments of the present disclosure, referring to FIG. 33 to FIG. 38, the support member 18 is fixed on each of opposite side walls of the air outlet channel 21. Therefore, the support member 18 can be easily fixed. Moreover, each of the opposite side walls of the air outlet channel 21 has a connection point between the support member 18 and the air outlet frame 20, and therefore a connection between the support member 18 and the air outlet frame 20 is more reliable.

Figure 34:
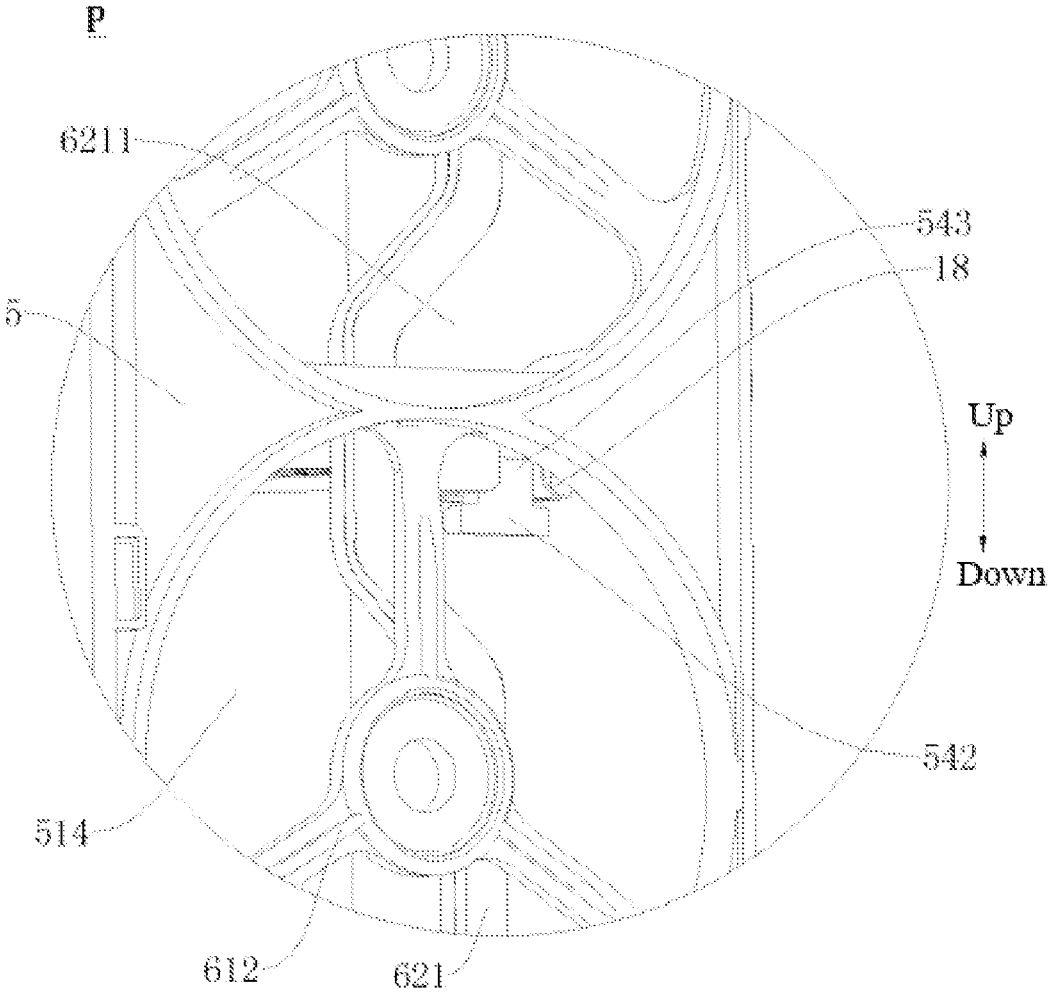
FIG. 34 is a partial enlarged view at a position P illustrated in FIG. 33.
Figure 35:
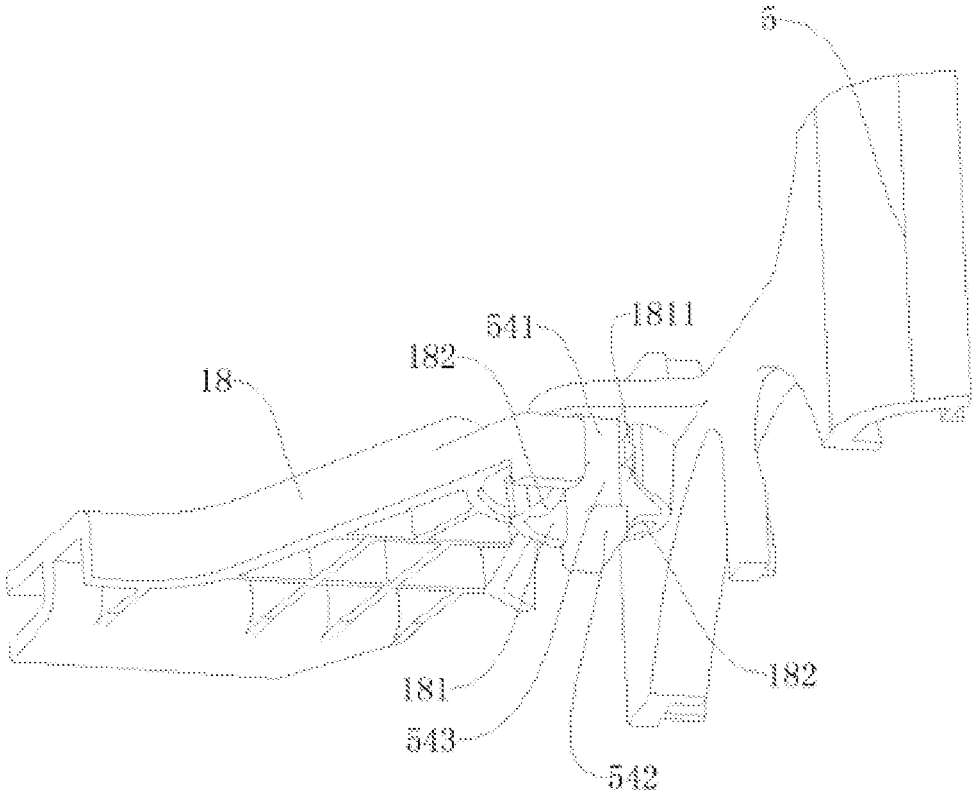
FIG. 35 is a schematic diagram showing fitting of a support member and an inner air guide plate according to some embodiments of the present disclosure.
Figure 36:
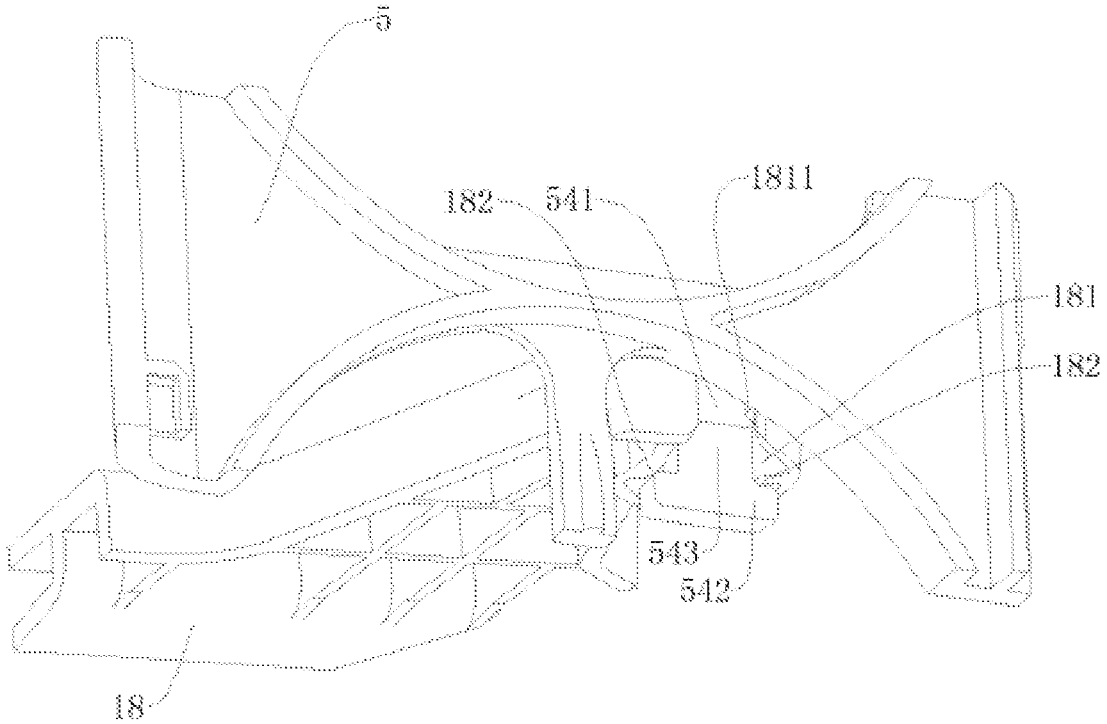
FIG. 36 is a schematic diagram showing fitting of a support member and an inner air guide plate from another angle according to some embodiments of the present disclosure.
Figure 37:
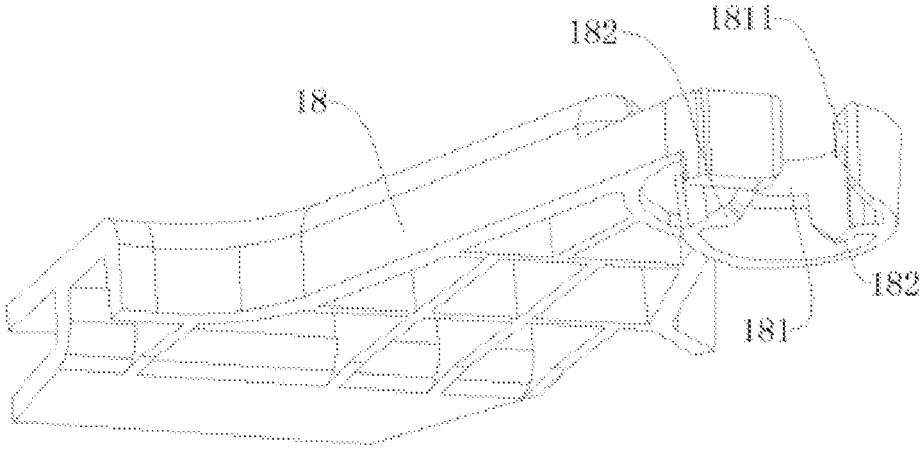
FIG. 37 is a schematic structural diagram of a support member according to some embodiments of the present disclosure.
Figure 38:
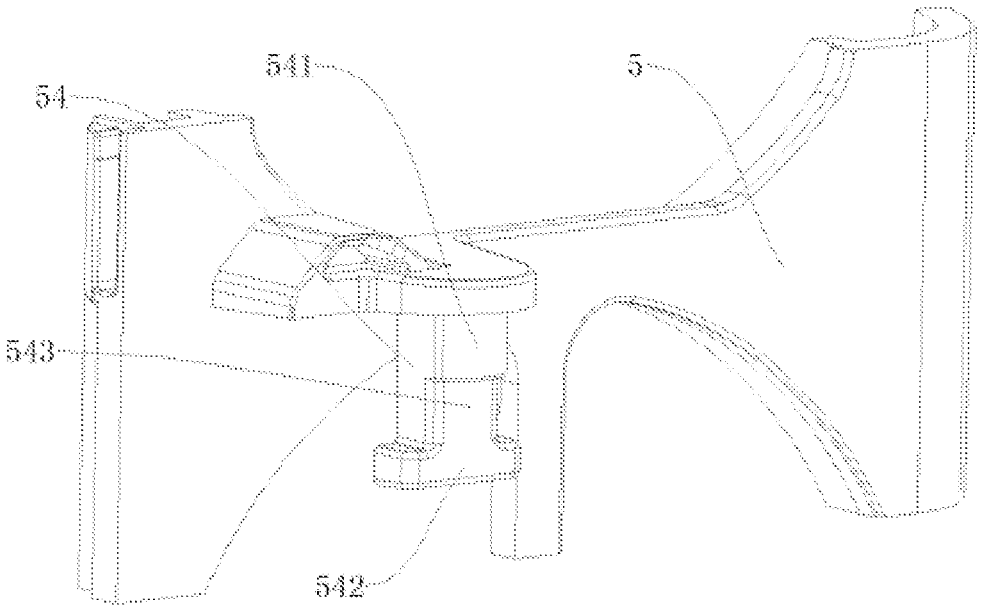
FIG. 38 is a schematic partial structural diagram of an inner air guide plate according to some embodiments of the present disclosure.

According to some embodiments of the present disclosure, as illustrated in FIG. 34, an avoidance groove 6211 configured to avoid the cooperation member 54 is disposed on the connection rod 621. Therefore, interference between the cooperation member 54 and the connection rod 621 can be avoided, facilitating disposing the cooperation member 54 on the air guide component 40. Thus, the air guide component 40 is easily connected to the support member 18.

Referring to FIG. 1 to FIG. 5, according to embodiments of the present disclosure, there is provided an air conditioner. The air conditioner includes an air outlet frame assembly according to the embodiment of the present disclosure.

In the air conditioner according to the embodiments of the present disclosure, by providing the air outlet frame assembly as mentioned above, the mounting and dismounting operation of the air guide component 40 is simple and convenient. In this way, the mounting and dismounting efficiency of the air guide component 40 is enhanced. As a result, the maintenance and cleaning of the air guide component 401 are facilitated. In addition, the connector 7 on the air guide component 401 can be prevented from falling off and becoming lost.

In some embodiments, the air conditioner may be a split air conditioner, or may be an integrated air conditioner. When the air conditioner is the split air conditioner, the air conditioner may be a split wall-mounted air conditioner or a split floor air conditioner. When the air conditioner is the split air conditioner, the air conditioner has an indoor unit 100 and an outdoor unit. The indoor unit includes the air outlet frame 20 assembly described above.

In some embodiments, the air conditioner indoor unit 100 includes a housing 10, a heat exchanger component, a fan component, an air outlet frame 20, and an air guide component 40. The housing 10 includes a front panel 11, a back plate 12, a top cover 14, and a base 13. The air outlet frame 20 is connected to a front end of the back plate 12. The front panel 11 is connected to a front side of the air outlet frame 20. The top cover 14 and the base 13 are connected to an upper side and a lower side of the back plate 12, respectively. Each of the heat exchanger component and the fan component is disposed in the housing 10 and located in a space formed by the air outlet frame 20 and the housing 10. The air outlet frame 20 has at least one air outlet channel 21. The air guide component 40 is rotatably disposed in the air outlet channel 21. An air outlet 16 is formed on the housing 10 at a position opposite to an air outlet side of the air outlet channel 21. The air outlet 16 may be formed between the front panel 11 and the rear back panel 12. An air inlet 15 is formed on the rear back panel 12. The air outlet 16 may also be provided with a door 17, which is slidably disposed in a circumferential direction of the housing 10. The air outlet 16 can be opened and closed by sliding the door 17.

During operation of the air conditioner, the door 17 opens the air outlet 16, and the fan component operates to drive external airflow to enter the housing 10 from the air inlet 15 to exchange heat with the heat exchanger component. Airflow subjected to the heat exchange flows through the air outlet channel 21. In the process of flowing through the air outlet channel 21, the airflow is guided or diffused by the air guide component 40 and finally blown out of the air outlet 16 to the room, and therefore an indoor ambient temperature can be adjusted. When the air conditioner is turned off, the door 17 closes the air outlet 16.

In some embodiments, an operation mode of the air conditioner may include a normal air supply mode and a windless mode. When the air conditioner is in the normal air supply mode, the air guide component 40 rotates to the position where the air outlet end of the air outlet channel 21 is opened, and the airflow mainly flows from one side or two sides of the air guide component 40 to the air outlet 16. When the air conditioner is in the windless mode, the air guide component 40 rotates to the position where the air outlet end of the air outlet channel 21 is closed, and the airflow passes through the air guide component 40, is diffused by the air guide component 40 and blown out of the air outlet 16 more gently.

In some embodiments, the air outlet frame 20 may have one air outlet channel 21. In this case, one air outlet 16 is provided and opposite to the air outlet channel 21. The fan component may include one impeller, and the impeller may be a cross-flow impeller.

In some embodiments, the air outlet frame 20 may also have two air outlet channels 21. In this case, two air outlets 16 are provided, and the two air outlets 16 are opposite to the two air outlet channels 21, respectively. The fan component may include two impellers. Each of the two impellers may be a cross-flow impeller. The two impellers are disposed corresponding to the two air outlet channels 21, respectively. The airflow is driven into the corresponding air outlet channels 21 by the two impellers, respectively.

In some embodiments of the present disclosure, the air conditioner indoor unit 100 may include a heat exchange unit and an air processing unit that are located in the housing 10. The heat exchange unit and the air processing unit may be arranged in the length direction of the housing 10. The heat exchange unit includes the heat exchanger component, the fan component, the air outlet frame 20, and the air guide component 40 that are described above. The air processing unit may have at least one of fresh air function, humidification function, or purification function. The air processing unit can improve indoor environment quality.

In the description of this specification, descriptions with reference to the terms "an embodiment," "some embodiments," "an exemplary embodiment," "an example," "a specific example," or "some examples" etc., mean that specific features, structure, materials or characteristics described in conjunction with the embodiment or example are included in at least one embodiment or example of the present disclosure. In this specification, the schematic representations of the above terms do not necessarily refer to the same embodiment or example. Moreover, the described specific features, structures, materials or characteristics may be combined in any one or more embodiments or examples in a suitable manner.

Although embodiments of the present disclosure have been illustrated and described, it is conceivable for those skilled in the art that various changes, modifications, replacements, and variations can be made to these embodiments without departing from the principles and spirit of the present disclosure. The scope of the present disclosure shall be defined by the claims as appended and their equivalents.

What is claimed is:

1. An air guide component comprising:

an air guide assembly including an air guide plate assembly, the air guide plate assembly including:

an outer air guide plate including an anti-disengagement structure; and an inner air guide plate disposed at an inner side of the outer air guide plate and including a mounting structure having an avoidance port; and a connector disposed at the inner air guide plate and configured to be connected to an air guide drive mechanism that is configured to drive the air guide component to rotate, a part of the connector passing through the avoidance port;

wherein:

the connector is movable between:

a first position, at which the connector is adapted to be connected to the air guide drive mechanism and is mounted and positioned through the mounting structure; and a second position, at which the connector is separated from the air guide drive mechanism and is limited by the mounting structure and the anti-disengagement structure; and the anti-disengagement structure is configured to cooperate with the part of the connector passing through the avoidance port when the connector is at the second position, to restrict a movement of the connector in a first direction and in a direction away from the air guide drive mechanism, and the connector is movable between the first position and the second position in the first direction.

2. The air guide component according to claim 1, wherein:

a rotation axis of the air guide component is parallel to the first direction;

the avoidance port extends in the first direction; and the anti-disengagement structure is located at a side of the connector facing away from the air guide drive mechanism and located between the outer air guide plate and the inner air guide plate.

3. The air guide component according to claim 2, wherein:

the connector includes a connection member and a positioning member that are arranged in the first direction; and the mounting structure has a mounting hole, the connection member being configured to pass through the mounting hole to be connected to the air guide drive mechanism, and the positioning member being configured to partially through the avoidance port.

4. The air guide component according to claim 3, wherein:

the connection member includes a connection post and a first limit stopper formed at an outer peripheral wall of the connection post; and an inner peripheral wall of the mounting hole is provided with a second limit stopper configured to abut against the first limit stopper in the first direction when the connector is located at the first position, to restrict a movement of the connector in the first direction and in a direction towards the air guide drive mechanism.

5. The air guide component according to claim 3, wherein the positioning member includes:

a positioning member body located at a side of the inner air guide plate facing away from the outer air guide plate; and a positioning protrusion disposed at a side of the positioning member body in a second direction perpendicular to the first direction, the positioning protrusion passing through the avoidance port and limiting the positioning member in a third direction perpendicular to both the first direction and the second direction.

6. The air guide component according to claim 5, wherein:

the mounting structure includes a limit buckle formed at the side of the inner air guide plate facing away from the outer air guide plate and disposed at two opposite sides of the positioning member body in the third direction, a limit groove being formed between the limit buckle and the inner air guide plate; and the positioning member body is configured to cooperate with the limit groove, to limit the positioning member in the second direction.

7. The air guide component according to claim 6, wherein the positioning member body is configured to cooperate with the limit groove, to limit the positioning member in the second direction and the third direction.

8. The air guide component according to claim 6, wherein a plug protrusion is formed at each of two opposite side walls of the positioning member body in the third direction, the plug protrusion being located at a side of the limit buckle adjacent to the connection member when the connector is located at the first position, the plug protrusion being located at a side of the limit buckle facing away from the connection member when the connector is located at the second position, and during insertion and pulling of the connector in the first direction, the plug protrusion being pressed against the limit buckle when located in the limit groove.

9. The air guide component according to claim 8, wherein;

an elastic opening is formed at each of two opposite ends of the positioning member body in the third direction and extends in the first direction, an elastic arm being formed between the elastic opening and each of the two opposite side walls of the positioning member body in the third direction, and the plug protrusion being formed at the elastic arm; or the mounting structure further includes limit rib plates each extending in the first direction and located at one of the two opposite sides of the positioning member body in the third direction, and the plug protrusion abuts against the corresponding limit rib plate in the third direction when the connector is located at the first position.

10. The air guide component according to claim 4, wherein:

a cross section of the connection post has a polygonal shape; and a cross section of a part of the mounting hole cooperating with the connection post has a polygonal shape adapted to the polygonal shape of the cross section of the connection post.

11. The air guide component according to claim 3, wherein:

the inner air guide plate includes:

an inner air guide plate body; and an inner extension located at an end of the inner air guide plate body in the first direction and located at a side of the inner air guide plate body facing away from the outer air guide plate, an angle being formed between the inner extension and the inner air guide plate body; and the mounting hole is formed at the first inner extension, and the avoidance port is formed at the inner air guide plate body.

12. The air guide component according to claim 1, wherein:

the outer air guide plate is provided with an air diffusion structure and is detachably connected to the inner air guide plate; and the air guide assembly further includes:

an air diffusion fan blade assembly disposed at the air guide plate assembly, the air diffusion fan blade assembly being at least partially located in an accommodation cavity formed by the outer air guide plate and the inner air guide plate, and the inner air guide plate having an air flowing hole formed at a position at the inner air guide plate corresponding to the air diffusion fan blade assembly; and a louver mechanism disposed at a side of the inner air guide plate facing away from the outer air guide plate.

13. The air guide component according to claim 12, wherein the inner air guide plate is snapped with the outer air guide plate through a buckle assembly.

14. The air guide component according to claim 13, wherein each of two side edges of the outer air guide plate in a width direction is snapped with a corresponding side edge of the inner air guide plate through the buckle assembly.

15. The air guide component according to claim 14, wherein the buckle assembly includes an outer plate snap member disposed at the outer air guide plate and an inner plate snap member disposed at the inner air guide plate, the outer plate snap member being snapped and engaged with the inner plate snap member in a length direction of the outer air guide plate.

16. The air guide component according to claim 15, wherein:

the air guide plate assembly includes a first end and a second end along a length of the air guide plate, and a first side and a second side along a width of the air guide plate;

the outer plate snap member includes at least one first snap block disposed at the first side, and the inner plate snap member includes at least one first snap groove formed at the first side, each of the at least one first snap groove having an open end close to the first end in a length direction of the air guide plate assembly and a closed end;

the outer plate snap member includes at least one second snap groove formed at the second side, and the inner plate snap member includes at least one second snap block disposed at the second side, the snap groove having an open end close to the second end in the length direction of the air guide plate assembly and a closed end; and when the outer air guide plate moves relative to the inner air guide plate in a direction from the first end to the second end, the at least one first snap block is snapped into the at least one first snap groove from the open end of the at least one first snap groove, and the at least one second snap block is snapped into the at least one second snap groove from the open end of the at least one second snap groove.

17. The air guide component according to claim 16, wherein:

the at least one first snap block includes a plurality of first snap blocks arranged at intervals in the length direction of the air guide plate assembly, and the at least one first snap groove includes a plurality of first snap grooves arranged at intervals in the length direction of the air guide plate assembly, each of the plurality of first snap blocks being snapped into a corresponding one of the plurality of first snap grooves; and the at least one second snap block includes a plurality of second snap blocks arranged at intervals in the length direction of the air guide plate assembly, and the at least one second snap groove includes a plurality of second snap grooves arranged at intervals in the length direction of the air guide plate assembly, each of the plurality of second snap blocks being snapped into a corresponding one of the plurality of second snap grooves.

18. The air guide component according to claim 16, wherein:

the first snap groove has an open end close to the first side in a width direction of the air guide plate assembly;

the outer air guide plate is provided with at least one limit buckle on the first side; and the inner air guide plate is provided with a limit rib on the first side, the limit rib being located at a side of the first snap groove facing away from the first side, and the at least one limit buckle being limited at a side of the limit rib facing away from the first snap groove.

19. An air guide component comprising:

an air guide assembly including an air guide plate assembly, the air guide plate assembly including:

an outer air guide plate including an anti-disengagement structure; and an inner air guide plate disposed at an inner side of the outer air guide plate and including a mounting structure having an avoidance port; and a connector disposed at the inner air guide plate and configured to be connected to an air guide drive mechanism that is configured to drive the air guide component to rotate, a part of the connector passing through the avoidance port;

wherein:

the connector is movable between:

a first position, at which the connector is adapted to be connected to the air guide drive mechanism and is mounted and positioned through the mounting structure; and a second position, at which the connector is separated from the air guide drive mechanism and is limited by the mounting structure and the anti-disengagement structure;

a rotation axis of the air guide component is parallel to a first direction;

the connector is movable between the first position and the second position in the first direction;

the avoidance port extends in the first direction; and the anti-disengagement structure is located at a side of the connector facing away from the air guide drive mechanism and located between the outer air guide plate and the inner air guide plate, and the anti-disengagement structure is configured to cooperate with the part of the connector passing through the avoidance port when the connector is at the second position, to restrict a movement of the connector in the first direction and in a direction away from the air guide drive mechanism.

20. An air guide component comprising:

an air guide assembly including an air guide plate assembly, the air guide plate assembly including:

an outer air guide plate including an anti-disengagement structure; and an inner air guide plate disposed at an inner side of the outer air guide plate and including a mounting structure having an avoidance port; and a connector disposed at the inner air guide plate and configured to be connected to an air guide drive mechanism that is configured to drive the air guide component to rotate, a part of the connector passing through the avoidance port;

wherein:

the connector is movable between:

a first position, at which the connector is adapted to be connected to the air guide drive mechanism and is mounted and positioned through the mounting structure; and a second position, at which the connector is separated from the air guide drive mechanism and is limited by the mounting structure and the anti-disengagement structure;

the outer air guide plate is provided with an air diffusion structure and is detachably connected to the inner air guide plate; and the air guide assembly further includes:

an air diffusion fan blade assembly disposed at the air guide plate assembly, the air diffusion fan blade assembly being at least partially located in an accommodation cavity formed by the outer air guide plate and the inner air guide plate, and the inner air guide plate having an air flowing hole formed at a position at the inner air guide plate corresponding to the air diffusion fan blade assembly; and a louver mechanism disposed at a side of the inner air guide plate facing away from the outer air guide plate.

* * * * *